United States Patent [19]

Fujimaki et al.

[11] Patent Number: 4,975,350

[45] Date of Patent: Dec. 4, 1990

[54] PHOTORECEPTOR HAVING A METAL-FREE PHTHALOCYANINE CHARGE GENERATING LAYER

[75] Inventors: Yoshihide Fujimaki; Akira Hirano; Yasuo Suzuki, all of Hachioji, Japan

[73] Assignee: Konica Corporation, Tokyo, Japan

[21] Appl. No.: 216,906

[22] PCT Filed: Oct. 20, 1987

[86] PCT No.: PCT/JP87/00803

§ 371 Date: Aug. 1, 1988

§ 102(e) Date: Aug. 1, 1988

[87] PCT Pub. No.: WO88/02880

PCT Pub. Date: Apr. 21, 1988

[30] Foreign Application Priority Data

| | | | |
|---|---|---|---|
| Oct. 20, 1986 | [JP] | Japan | 61-249094 |
| Dec. 15, 1986 | [JP] | Japan | 61-299203 |
| Dec. 15, 1986 | [JP] | Japan | 61-299204 |
| Dec. 15, 1986 | [JP] | Japan | 61-299205 |
| Dec. 15, 1986 | [JP] | Japan | 61-299206 |
| Dec. 30, 1986 | [JP] | Japan | 61-315164 |
| Dec. 30, 1986 | [JP] | Japan | 61-315165 |

[51] Int. Cl.[5] ..... G03G 5/10

[52] U.S. Cl. ..... 430/59; 430/73; 430/76

[58] Field of Search ..... 430/58, 59, 72, 73, 430/74, 75, 76, 77

[56] References Cited

U.S. PATENT DOCUMENTS

| | | | |
|---|---|---|---|
| 4,755,443 | 7/1988 | Suzuki et al. | 430/59 |
| 4,800,145 | 1/1989 | Nelson et al. | 430/58 |

FOREIGN PATENT DOCUMENTS 61-34547 2/1986 Japan .

*Primary Examiner*—John L. Goodrow

*Attorney, Agent, or Firm*—Frishauf, Holtz, Goodman & Woodward

[57] ABSTRACT

A photoreceptor including a carrier transporting layer containing a carrier transporting material and a binder material, and a carrier generating layer containing a carrier generating material and a binder material, the layers being placed one over the other in order of mention, characterized in that said carrier generating layer contains a metal-free phthalocyanine having main peaks of Bragg angles $2\theta$ at least at 7.5 degrees±0.2 degrees, 9.1 degrees ±0.2 degrees, 16.7 degrees±0.2 degrees, 17.3 degrees±0.2 degrees, and 22.3 degrees±0.2 degrees in relation to CuK$\alpha$ characteristic X rays (wavelength 1.541 Å), and in that said carrier generating layer also contains a carrier transporting material.

7 Claims, 27 Drawing Sheets

INFRARED ABSORPTION SPECTRUM

INFRARED ABSORPTION SPECTRUM

FIG. 8

| | CARRIER GENERATING LAYER | | | | | CARRIER TRANSPORTING LAYER | | | EVALUATION ITEM | | | |
|---|---|---|---|---|---|---|---|---|---|---|---|---|
| | CGM | CTM | CTM /CGM | BINDER | THICKNESS OF LAYER | CTM | BINDER | THICKNESS OF LAYER | $V_A$(V) | E1/2 (erg/cm2) | $V_R$(V) | IMAGE QUALITY |
| EXAMPLE 1 | 1.0g | CTM-1 3.0g | 3.0 | 4g | 4μm | CTM-1 9g | 10g | 16μm | 750 | 5.0 | 15 | ◎ |
| " 2 | 1.5g | " 1.5g | 1.0 | " | " | " " | " | " | 810 | 5.9 | 20 | ◎ |
| " 3 | 1.0g | " 2.0g | 2.0 | " | " | " " | " | " | 780 | 5.6 | 18 | ◎ |
| " 4 | 1.0g | " 5.0g | 5.0 | " | " | " " | " | " | 720 | 4.5 | 13 | ◎ |
| " 5 | 0.5g | " 3.5g | 7.0 | " | " | " " | " | " | 870 | 6.2 | 20 | ◎ |
| " 6 | 0.5g | " 5.0g | 10.0 | " | " | " " | " | " | 920 | 5.8 | 18 | ○ |
| " 7 | 3.0g | " 1.5g | 0.5 | " | " | " " | " | " | 950 | 7.7 | 23 | ○ |
| " 8 | 1.0g | CTM-2 3.0g | 3.0 | " | 1μm | CTM-2 " | " | " | 860 | 7.0 | 28 | ○ |
| " 9 | 1.0g | " " | " | " | 2μm | " " | " | " | 820 | 5.0 | 18 | ◎ |
| " 10 | 1.0g | " " | " | " | 6μm | " " | " | " | 780 | 4.5 | 12 | ◎ |
| " 11 | 1.0g | " " | " | " | 10μm | " " | " | " | 730 | 4.1 | 22 | ○ |
| COMP. EXP. 1 | CGM-1 1.0g | CTM-1 3.0g | 3.0 | " | 4μm | CTM-1 " | " | " | 500 | 11.2 | 20 | x |
| " 2 | CGM-2 1.0g | CTM-1 3.0g | 3.0 | " | " | " " | " | " | 450 | 13.5 | 35 | x |
| " 3 | 1.0g | — | 0.0 | " | " | " " | " | " | 1210 | 28.5 | 155 | x |

IN THE TABLE
CGM : CARRIER GENERATING MATERIAL CTM: CARRIER TRANSPORTING MATERIAL
CGM USED IN EXAMPLE 1 THROUGH 11 AND COM. EXP. 3: METAL-FREE PHTHALOCYANINE HAVING MAJOR PEAKS AT 2=7.5±0.2, 9.1±0.2, 16.7±0.2, 17.3±0.2, AND 22.3±0.2 DEGREES (COMPOUND A)
CGM-1: θ TYPE METAL-FREE PHTHALOCYANINE HAVING MAJOR PEAKS AT 2=7.6±0.2, 9.2±0.2, 16.8±0.2, 17.4±0.2, 20.4±0.2, AND 20.9±0.2 DEGREES
CGN-2: θ TYPE METAL-FREE PHTHALOCYANINE HAVING MAJOR PEAKS AT 2=7.6±0.2, 9.2±0.2, 16.8±0.2, 17.4±0.2, 21.5±0.2, AND 27.5±0.2 DEGREES

CTM-1

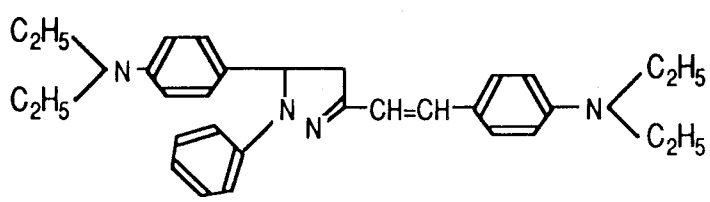

CTM-2

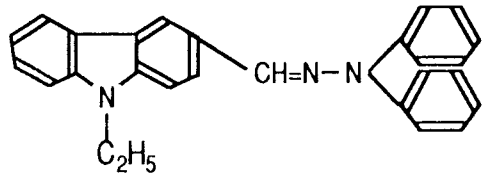

FIG. 9

| | CARRIER GENERATING LAYER | | | | | CARRIER TRANSPORTING LAYER | | | EVALUATION ITEM | | | |
|---|---|---|---|---|---|---|---|---|---|---|---|---|
| | CGM | CTM | CTM /CGM | BINDER | THICKNESS OF LAYER | CTM | BINDER | THICKNESS OF LAYER | $V_A$(V) | E1/2 (erg/cm2) | $V_R$(V) | IMAGE QUALITY |
| EXAMPLE 12 | 1.0g | CTM-1 3.0g | 3.0 | 4g | 4μm | CTM-1 9g | 10g | 1μm | 780 | 4.6 | 12 | ◎ |
| " 13 | 1.5g | " 1.5g | 1.0 | " | " | " " | " | " | 830 | 5.5 | 17 | ◎ |
| " 14 | 1.0g | " 2.0g | 2.0 | " | " | " " | " | " | 810 | 5.2 | 13 | ◎ |
| " 15 | 1.0g | " 5.0g | 5.0 | " | " | " " | " | " | 740 | 4.1 | 10 | ◎ |
| " 16 | 0.5g | " 3.5g | 7.0 | " | " | " " | " | " | 890 | 5.9 | 16 | ◎ |
| " 17 | 0.5g | " 5.0g | 10.0 | " | " | " " | " | " | 940 | 5.4 | 14 | ○ |
| " 18 | 3.0g | " 1.5g | 0.5 | " | " | " " | " | " | 970 | 7.1 | 20 | ○ |
| " 19 | 1.0g | CTM-2 3.0g | 3.0 | " | 1μm | CTM-2 " | " | " | 880 | 6.5 | 24 | ○ |
| " 20 | 1.0g | " " | " | " | 2μm | " " | " | " | 850 | 4.5 | 13 | ◎ |
| " 21 | 1.0g | " " | " | " | 6μm | " " | " | " | 810 | 4.1 | 10 | ◎ |
| " 22 | 1.0g | " " | " | " | 10μm | " " | " | " | 750 | 3.7 | 19 | ○ |
| COMP. EXP. 4 | 1.0g | — | 0 | " | " | " " | " | " | 1300 | 21.0 | 115 | x |

IN THE TABLE
CGM : CARRIER GENERATING MATERIAL CTM: CARRIER TRANSPORTING MATERIAL
CGM USED IN EXAMPLE 12 THROUGH 22 AND COM. EXP. 4: METAL-FREE PHTHALOCYANINE HAVING MAJOR PEAKS AT 2θ=7.7, 9.3, 16.9, 17.5, 22.4, AND 28.8 DEGREES (COMPOUND B)

CTM-1

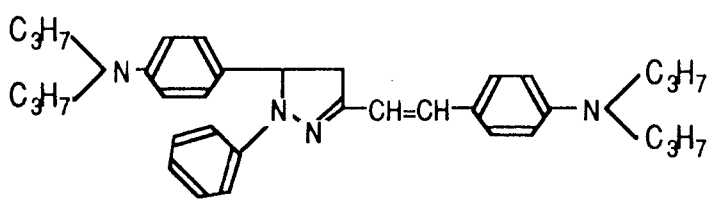

CTM-2

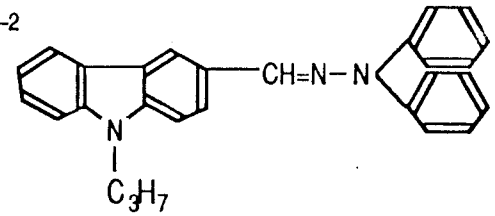

| | CARRIER GENERATING LAYER | | | | | CARRIER TRANSPORTING LAYER | | | EVALUATION ITEM | | | | | | | |
|---|---|---|---|---|---|---|---|---|---|---|---|---|---|---|---|---|
| | | | | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER | CTM | BINDER | THICKNESS OF LAYER | $V_A$(V) | E1/2 (erg/cm2) | $V_R$(V) | $V_A$(V) | E1/2 (erg/cm2) | $V_R$(V) | INI-TIAL | ON 10,000th COPYING |
| EXAMPLE I-1 | 1.0g | I-37 3.0g | 3.0 | POLYCARBONATE 4 | 4μm | I-37 | 10g | 16μm | 870 | 4.7 | 8 | 810 | 4.5 | 7 | | o |
| " 2 | 1.5g | " 1.5g | 1.0 | " | " | " | " | " | 950 | 5.3 | 6 | 900 | 5.0 | 5 | o | o |
| " 3 | 1.0g | " 2.0g | 2.0 | " | " | " | " | " | 910 | 5.1 | 10 | 850 | 4.9 | 8 | | o |
| " 4 | " | " 5.0g | 5.0 | " | " | " | " | " | 840 | 4.6 | 7 | 780 | 4.5 | 6 | | o |
| " 5 | 0.5g | I-67 3.5g | 7.0 | " | " | I-67 | " | " | 920 | 5.8 | 14 | 870 | 5.4 | 13 | o | o |
| " 6 | " | " 5.0g | 10.0 | " | " | " | " | " | 880 | 5.5 | 12 | 830 | 5.1 | 11 | o | o |
| " 7 | 3.0g | " 1.5g | 0.5 | " | " | " | " | " | 950 | 4.9 | 6 | 840 | 4.6 | 5 | o | o |
| " 8 | 1.0g | I-43 3.0g | 3.0 | " | 1μm | I-43 | " | " | 1050 | 9.0 | 6 | 990 | 8.7 | 6 | o | o |
| " 9 | " | " " | " | " | 2μm | " | " | " | 970 | 7.0 | 7 | 900 | 6.6 | 8 | | o |
| " 10 | " | " " | " | " | 6μm | " | " | " | 910 | 5.3 | 13 | 830 | 5.0 | 11 | | o |
| " 11 | " | " " | " | " | 10μm | " | " | " | 850 | 4.6 | 14 | 700 | 4.4 | 12 | o | o |
| COMP. EXP. I-1 | 1.0 | CTM-1 " | " | " | 4μm | I-37 | " | " | 1080 | 10.5 | 21 | 1010 | 10.2 | 28 | x | x |
| 2 | 1.0 | CTM-2 " | " | " | " | " | " | " | 1050 | 11.2 | 25 | 970 | 10.5 | 32 | x | x |
| 3 | " | – | 0 | " | " | " | " | " | 1160 | 18.5 | 58 | 1030 | 18.5 | 75 | x | x |
| 4 | CGM-1 1.0 | I-37 3.0 | 3.0 | " | " | " | " | " | 730 | 15.5 | 32 | 680 | 16.0 | 40 | x | x |
| 5 | CGM-2 " | " " | " | " | " | " | " | " | 660 | 17.0 | 28 | 620 | 17.2 | 36 | | |

IN THE TABLE

CGM : CARRIER GENERATING MATERIAL CTM: CARRIER TRANSPORTING MATERIAL

CGM USED IN EXAMPLE 1 THROUGH 11 AND COM. EXP. 1 THROUGH 3: METAL-FREE PHTHALOCYANINE COMPOUND A HAVING MAJOR PEAKS AT 2 =7.5±0.2, 9.1±0.2, 16.7±0.2, 17.3±0.2, AND 22.3±0.2 DEGREES (COMPOUND A)

CGM-1: τ TYPE METAL-FREE PHTHALOCYANINE HAVING MAJOR PEAKS AT 2θ=7.6±0.2, 9.2±0.2, 16.8±0.2, 17.4±0.2, 20.4±0.2, AND 20.9±0.2 DEGREES

CGM-2: η TYPE METAL-FREE PHTHALOCYANINE HAVING MAJOR PEAKS AT 2θ=7.6±0.2, 9.2±0.2, 16.8±0.2, 17.4±0.2, 21.5±0.2, AND 27.5±0.2 DEGREES

CTM-1

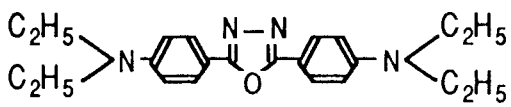

CTM-1

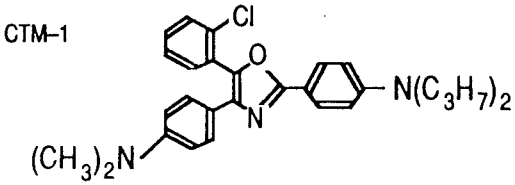

FIG. 11

| | CARRIER GENERATING LAYER | | | | CARRIER TRANSPORTING LAYER | | | EVALUATION ITEM | | | | | | | | |
|---|---|---|---|---|---|---|---|---|---|---|---|---|---|---|---|---|
| | | | | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER | CTM | BINDER | THICKNESS OF LAYER | $V_A$(V) | E1/2 (erg/cm2) | $V_R$(V) | $V_A$(V) | E1/2 (erg/cm2) | $V_R$(V) | INI-TIAL | ON 10,000th COPYING |
| EXAMPLE I-12 | 1.0g | I-37 3.0g | 3.0 | POLYCARBONATE 4 | 4μm | I-37 | 10g | 16μm | 890 | 4.2 | 4 | 850 | 4.0 | 3 | ◎ | ◎ |
| " 13 | 1.5g | " 1.5g | 1.0 | " | " | " | " | " | 980 | 4.9 | 3 | 940 | 4.5 | 2 | ◎ | ◎ |
| " 14 | 1.0g | " 2.0g | 2.0 | " | " | " | " | " | 940 | 4.9 | 5 | 900 | 4.5 | 4 | ◎ | ◎ |
| " 15 | " | " 5.0g | 5.0 | " | " | " | " | " | 870 | 4.3 | 3 | 830 | 4.3 | 4 | ◎ | ◎ |
| " 16 | 0.5g | I-67 3.5g | 7.0 | " | " | I-67 | " | " | 940 | 5.5 | 10 | 890 | 4.9 | 9 | ○ | ○ |
| " 17 | " | " 5.0g | 10.0 | " | " | " | " | " | 900 | 5.2 | 8 | 850 | 4.9 | 8 | ○ | ○ |
| " 18 | 3.0g | " 1.5g | 0.5 | " | " | " | " | " | 960 | 4.5 | 3 | 900 | 4.2 | 2 | ○ | ○ |
| " 19 | 1.0g | I-43 3.0g | 3.0 | " | 1μm | I-43 | " | " | 1060 | 8.5 | 5 | 1010 | 8.4 | 5 | ○ | ○ |
| " 20 | " | " " | " | " | 2μm | " | " | " | 980 | 6.5 | 4 | 930 | 6.2 | 5 | ◎ | ◎ |
| " 21 | " | " " | " | " | 6μm | " | " | " | 920 | 4.9 | 8 | 870 | 4.7 | 6 | ◎ | ◎ |
| " 22 | " | " " | " | " | 10μm | " | " | " | 870 | 4.3 | 9 | 800 | 4.0 | 8 | ○ | ○ |
| COMP. EXP. | 1.0g | CTM-1 " | " | " | 4μm | I-37 | " | " | 1100 | 10.0 | 16 | 1020 | 9.5 | 22 | x | x |
| 7.0 | " | – | 0.0 | " | " | " | " | " | 1070 | 10.4 | 20 | 990 | 9.8 | 25 | x | x |

IN THE TABLE
CGM : CARRIER GENERATING MATERIAL CTM: CARRIER TRANSPORTING MATERIAL
CGM : METAL-FREE PHTHALOCYANINE COMPOUND B HAVING MAJOR PEAKS AT 2θ=7.7±0.2, 9.3±0.2, 16.9±0.2, 17.6±0.2, 22.4±0.2, AND 28.8±0.2 DEGREES

CTM-1

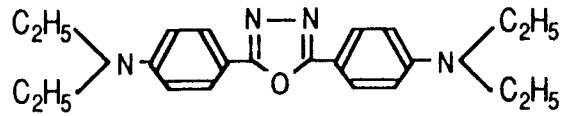

FIG. 12

| | PHOTOSENSITIVE LAYER | | | | | EVALUATION ITEM | | | | | | | |
|---|---|---|---|---|---|---|---|---|---|---|---|---|---|
| | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER (μm) | $V_A$(V) | E1/2 (erg/cm2) | $V_R$(V) | $V_A$(V) | E1/2 (erg/cm2) | $V_R$(V) | INI-TIAL | ON 10,000th COPYING |
| EXAMPLE I-23 | 1.0g | I-47 3.0g | 3.0 | 4 | 22 | 810 | 4.7 | 13 | 720 | 4.3 | 15 | ◎ | ○ |
| " I-24 | 1.5g | " 1.5g | 1.0 | " | " | 850 | 5.0 | 12 | 780 | 4.7 | 14 | ◎ | ○ |
| " I-25 | 2.0g | " 1.0g | 0.5 | " | " | 980 | 5.2 | 16 | 900 | 5.0 | 19 | ○ | ○ |
| " I-26 | 5.0g | " " | 0.2 | " | " | 680 | 3.9 | 12 | 600 | 3.6 | 13 | ○ | ○ |
| " I-27 | 1.0g | " 5.0g | 5.0 | " | " | 790 | 4.2 | 18 | 710 | 3.9 | 20 | ◎ | ○ |
| " I-28 | 0.5g | " 3.5g | 7.0 | " | " | 920 | 6.7 | 15 | 840 | 6.5 | 18 | ○ | ○ |
| " I-29 | " | " 5.0g | 10.0 | " | " | 880 | 6.5 | 11 | 790 | 6.2 | 14 | ○ | ○ |
| " I-30 | 1.0g | I-54 3.0g | 3.0 | " | 15 | 740 | 6.0 | 11 | 670 | 5.7 | 13 | ○ | ○ |
| " I-31 | " | " " | 3.0 | " | 30 | 1250 | 8.5 | 20 | 1130 | 8.1 | 25 | ○ | ○ |
| " I-32 | " | " " | " | " | 40 | 1580 | 11.0 | 27 | 1440 | 10.5 | 32 | ○ | ○ |
| " I-33 | " | " " | " | " | 50 | 1750 | 12.4 | 32 | 1600 | 11.5 | 36 | ○ | ○ |
| " I-34 | " | " " | " | " | 10 | 660 | 5.6 | 8 | 600 | 5.3 | 10 | ○ | ○ |
| COMP. EXP. I-8 | " | CTM-1 " | " | " | 22 | 890 | 12.0 | 28 | 840 | 11.7 | 34 | x | x |
| 9 | " | – | 0.0 | " | " | 950 | 15.5 | 85 | 900 | 17.0 | 105 | x | x |
| 10 | CGM-1 1.0 | I-47 3.0 | 3.0 | " | " | 750 | 21.0 | 31 | 680 | 20.0 | 36 | x | x |
| 11 | CGM-2 " | " " | " | " | " | 730 | 24.5 | 40 | 640 | 24.0 | 45 | x | x |

FIG. 13

IN THE TABLE

CGM : CARRIER GENERATING MATERIAL CTM: CARRIER TRANSPORTING MATERIAL

CGM USED IN EXAMPLE 23 THROUGH 34 AND COM. EXP. 8 AND 9: METAL-FREE PHTHALOCYANINE COMPOUND A HAVING MAJOR PEAKS AT 2θ=7.5±0.2, 9.1±0.2, 16.7±0.2, 17.3±0.2, AND 22.3±0.2 DEGREES (COMPOUND A)

CGM–1: τ TYPE METAL-FREE PHTHALOCYANINE COMPOUND A HAVING MAJOR PEAKS AT 2θ=7.6±0.2, 9.2±0.2, 16.8±0.2, 17.4±0.2, 20.4±0.2, AND 20.9±0.2 DEGREES

CTM–1: η TYPE METAL-FREE PHTHALOCYANINE COMPOUND A HAVING MAJOR PEAKS AT 2θ=7.6±0.2, 9.2±0.2, 16.8±0.2, 17.4±0.2, 21.5±0.2, AND 27.5±0.2 DEGREES

FIG. 14

| | PHOTOSENSITIVE LAYER | | | | | EVALUATION ITEM | | | | | | | |
|---|---|---|---|---|---|---|---|---|---|---|---|---|---|
| | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER (μm) | $V_A$(V) | E1/2 (erg/cm2) | $V_R$(V) | $V_A$(V) | E1/2 (erg/cm2) | $V_R$(V) | INI-TIAL | ON 10,000th COPYING |
| EXAMPLE I-35 | 1.0g | I-47 3.0g | 3.0 | 4 | 22 | 830 | 4.3 | 11 | 780 | 4.2 | 14 | O | O |
| " I-36 | 1.5g | " 1.5g | 1.0 | " | " | 870 | 4.7 | 10 | 810 | 4.5 | 12 | O | O |
| " I-37 | 2.0g | " 1.0g | 0.5 | " | " | 1010 | 4.9 | 14 | 950 | 4.7 | 17 | O | O |
| " I-38 | 5.0g | " " | 0.2 | " | " | 720 | 3.6 | 10 | 680 | 3.6 | 12 | O | O |
| " I-39 | 1.0g | " 5.0g | 5.0 | " | " | 830 | 3.8 | 16 | 780 | 3.7 | 19 | O | O |
| " I-40 | 0.5g | " 3.5g | 7.0 | " | " | 930 | 6.2 | 13 | 860 | 6.0 | 17 | O | O |
| " I-41 | " | " 5.0g | 10.0 | " | " | 900 | 6.1 | 10 | 830 | 6.0 | 13 | O | O |
| " I-42 | 1.0g | I-54 3.0g | 3.0 | " | 15 | 700 | 5.6 | 9 | 640 | 5.3 | 11 | O | O |
| " I-43 | " | " " | 3.0 | " | 30 | 1280 | 8.1 | 18 | 1200 | 7.9 | 22 | O | O |
| " I-44 | " | " " | " | " | 40 | 1620 | 10.5 | 24 | 1550 | 10.2 | 29 | O | O |
| " I-45 | " | " " | " | " | 50 | 1810 | 12.0 | 30 | 1700 | 11.5 | 33 | O | O |
| " I-46 | " | " " | " | " | 10 | 690 | 5.2 | 7 | 630 | 4.8 | 9 | O | O |
| COMP. EXP. I-12 | " | CTM-1 " | " | " | 22 | 920 | 11.0 | 25 | 880 | 10.5 | 32 | x | x |
| 13 | " | – | 0.0 | " | " | 980 | 14.0 | 70 | 930 | 13.0 | 83 | x | x |

IN THE TABLE
CGM : CARRIER GENERATING MATERIAL CTM: CARRIER TRANSPORTING MATERIAL
CGM METAL-FREE PHTHALOCYANINE COMPOUND B HAVING MAJOR PEAKS AT 2θ=7.7±0.2, 9.3±0.2, 16.9±0.2, 17.6±0.2, 22.4±0.2 AND 28.8±0.2 DEGREES

CTM-1

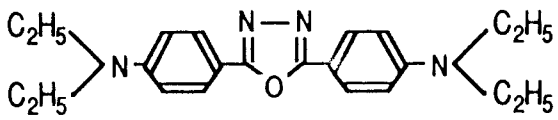

| | CARRIER GENERATING LAYER | | | | | CARRIER TRANSPORTING LAYER | | | EVALUATION ITEM | | | | | | | |
|---|---|---|---|---|---|---|---|---|---|---|---|---|---|---|---|---|
| | | | | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER | CTM | BINDER | THICKNESS OF LAYER | $V_A$(V) | E1/2 (erg/cm2) | $V_R$(V) | $V_A$(V) | E1/2 (erg/cm2) | $V_R$(V) | INI-TIAL | ON 10,000th COPYING |
| EXAMPLE I-47 | 1.0g | I'-8 3.0g | 3.0 | POLYCARBONATE 4 | 4μm | I'-8 | 10g | 16μm | 910 | 5.0 | 11 | 830 | 4.7 | 14 | | O |
| " 48 | 1.5g | " 1.5g | 1.0 | " | " | " | " | " | 980 | 5.7 | 9 | 920 | 5.3 | 11 | O | O |
| " 49 | 1.0g | " 2.0g | 2.0 | " | " | " | " | " | 950 | 5.5 | 13 | 880 | 5.4 | 16 | | O |
| " 50 | " | " 5.0g | 5.0 | " | " | " | " | " | 870 | 4.9 | 10 | 810 | 4.7 | 14 | | O |
| " 51 | 0.5g | I'-15 3.5g | 7.0 | " | " | I'-15 | " | " | 950 | 6.0 | 17 | 860 | 5.8 | 23 | O | O |
| " 52 | " | " 5.0g | 10.0 | " | " | " | " | " | 910 | 5.7 | 14 | 830 | 5.7 | 17 | O | O |
| " 53 | 3.0g | " 1.5g | 0.5 | " | " | " | " | " | 990 | 5.2 | 8 | 920 | 5.1 | 11 | O | O |
| " 54 | 1.0g | I'-33 3.0g | 3.0 | " | 1μm | I'-33(2.5g) I'-34(5.0g) | " | " | 1090 | 9.0 | 16 | 1000 | 8.8 | 20 | O | O |
| " 55 | " | " " | " | " | 2μm | " | " | " | 1000 | 7.3 | 14 | 910 | 7.1 | 17 | | O |
| " 56 | " | " " | " | " | 6μm | " | " | " | 950 | 5.5 | 16 | 870 | 5.3 | 19 | | O |
| " 57 | " | " " | " | " | 10μm | " | " | " | 880 | 4.9 | 17 | 810 | 4.8 | 21 | O | O |
| COMP. EXP. I-14 | " | CTM-1 " | " | " | 4μm | I'-8 | " | " | 1120 | 11.2 | 26 | 1020 | 11.5 | 42 | x | x |
| 15 | " | – | 0.0 | " | " | " | " | " | 1270 | 20.0 | 63 | 1090 | 19.0 | 82 | x | x |
| 16 | CGM-1 1.0 | I'-8 3.0g | 3.0 | " | " | " | " | | 770 | 16.0 | 40 | 700 | 16.5 | 52 | x | x |
| 17 | CGM-2 " | " " | " | " | " | " | " | | 680 | 18.0 | 35 | 620 | 18.7 | 41 | x | x |

IN THE TABLE
CGM : CARRIER GENERATING MATERIAL AND CTM: CARRIER TRANSPORTING MATERIAL
CGM : METAL-FREE PHTHALOCYANINE COMPOUND A HAVING MAJOR PEAKS AT 2θ=7.7±0.2, 9.3±0.2, 16.9±0.2, 17.6±0.2, 22.4±0.2, AND 28.8±0.2 DEGREES
CGM-1: τ TYPE METAL-FREE PHTHALOCYANINE HAVING MAJOR PEAKS AT 2θ=7.6±0.2, 9.2±0.2, 16.8±0.2, 17.4±0.2, 20.4±0.2, AND 20.9±0.2 DEGREES
CGM-2: η TYPE METAL-FREE PHTHALOCYANINE HAVING MAJOR PEAKS AT 2θ=7.6±0.2, 9.2±0.2, 16.8±0.2, 17.4±0.2, 21.5±0.2, AND 27.5±0.2 DEGREES

*FIG. 15*

| | CARRIER GENERATING LAYER | | | | | CARRIER TRANSPORTING LAYER | | | EVALUATION ITEM | | | | | | | |
|---|---|---|---|---|---|---|---|---|---|---|---|---|---|---|---|---|
| | | | | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER | CTM | BINDER | THICKNESS OF LAYER | $V_A$(V) | E1/2 (erg/cm 2) | $V_R$(V) | $V_A$(V) | E1/2 (erg/cm 2) | $V_R$(V) | INI-TIAL | ON 10,000th COPYING |
| EXAMPLE I-58 | 1.0 | I'-8 3.0 | 3.0 | POLYCARBONATE 4 | 4μm | I'-8 | 10g | 16μm | 930 | 4.8 | 9 | 860 | 4.6 | 11 | ◎ | ○ |
| " 59 | 1.5 | " 1.5 | 1.0 | " | " | " | " | " | 1000 | 5.4 | 7 | 950 | 5.2 | 10 | ○ | ○ |
| " 60 | 1.0 | " 2.0 | 2.0 | " | " | " | " | " | 970 | 5.1 | 10 | 920 | 4.7 | 13 | ◎ | ◎ |
| " 61 | " | " 5.0 | 5.0 | " | " | " | " | " | 890 | 4.7 | 8 | 840 | 4.3 | 10 | ◎ | ◎ |
| " 62 | 0.5 | I'-15 3.5 | 7.0 | " | " | I'-15 | " | " | 970 | 5.7 | 13 | 930 | 5.5 | 16 | ○ | ○ |
| " 63 | " | " 5.0 | 10.0 | " | " | " | " | " | 930 | 5.3 | 11 | 850 | 5.1 | 13 | ○ | ○ |
| " 64 | 3.0 | " 1.5 | 0.5 | " | " | " | " | " | 1020 | 5.0 | 6 | 950 | 4.6 | 10 | ○ | ○ |
| " 65 | 1.0 | I'-33 3.0 | 3.0 | " | 1μm | I'-33 | " | " | 1100 | 8.8 | 15 | 1020 | 8.7 | 19 | ○ | ○ |
| " 66 | " | " " | " | " | 2μm | " | " | " | 1020 | 6.9 | 14 | 970 | 6.5 | 18 | ◎ | ○ |
| " 67 | " | " " | " | " | 6μm | " | " | " | 970 | 5.3 | 13 | 910 | 4.9 | 17 | ◎ | ○ |
| " 68 | " | " " | " | " | 10μm | " | " | " | 900 | 4.6 | 14 | 850 | 4.3 | 17 | ○ | ○ |
| COMP. EXP. I-18 | 0 | CTM-1 " | " | " | 4μm | I'-8 | " | " | 1150 | 10.5 | 21 | 1060 | 10.0 | 32 | x | x |
| 19 | " | – | 0.0 | " | " | " | " | " | 1230 | 19.0 | 50 | 1150 | 18.0 | 65 | x | x |

IN THE TABLE
CGM : CARRIER GENERATING MATERIAL AND CTM: CARRIER TRANSPORTING MATERIAL
CGM : METAL-FREE PHTHALOCYANINE COMPOUND B HAVING MAJOR PEAKS AT 2θ=7.7±0.2, 9.3±0.2, 16.9±0.2, 17.6±0.2, AND 22.3±0.2 DEGREES

CTM-1

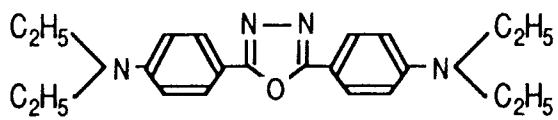

FIG. 16

| | PHOTOSENSITIVE LAYER | | | | | EVALUATION ITEM | | | | | | | |
|---|---|---|---|---|---|---|---|---|---|---|---|---|---|
| | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER | $V_A$(V) | EI/2 (erg/cm$^2$) | $V_R$(V) | $V_A$(V) | EI/2 (erg/cm$^2$) | $V_R$(V) | INI-TIAL | ON 10,000th COPYING |
| EXAMPLE I-69 | 1.0 | I-3 3.0 | 3.0 | 4 | 22 | 840 | 5.3 | 16 | 760 | 5.0 | 18 | ◎ | ○ |
| " I-70 | 1.5 | " 1.5 | 1.0 | " | " | 880 | 5.7 | 15 | 810 | 5.3 | 17 | ◎ | ○ |
| " I-71 | 2.0 | " 1.0 | 0.5 | " | " | 1010 | 5.9 | 17 | 900 | 5.6 | 20 | ○ | ○ |
| " I-72 | 5.0 | " " | 0.2 | " | " | 710 | 4.4 | 14 | 630 | 4.1 | 17 | ○ | ○ |
| " I-73 | 1.0 | " 5.0 | 5.0 | " | " | 830 | 4.7 | 20 | 740 | 4.4 | 24 | ◎ | ○ |
| " I-74 | 0.5 | " 3.5 | 7.0 | " | " | 940 | 7.1 | 16 | 820 | 6.7 | 19 | ○ | ○ |
| " I-75 | " | " 5.0 | 10.0 | " | " | 910 | 6.9 | 13 | 780 | 6.5 | 16 | ○ | ○ |
| " I-76 | 1.0 | I-25 1.0 +I-33 2.0 | 3.0 | " | 15 | 770 | 6.5 | 12 | 700 | 6.2 | 15 | ○ | ○ |
| " I-77 | " | " " | " | " | 30 | 1300 | 9.0 | 23 | 1200 | 8.6 | 27 | ○ | ○ |
| " I-78 | " | " " | | | 40 | 1620 | 12.0 | 30 | 1500 | 11.0 | 34 | ○ | ○ |
| " I-79 | " | " " | " | " | 50 | 1800 | 13.5 | 35 | 1650 | 12.5 | 38 | ○ | ○ |
| " I-80 | " | " " | " | " | 10 | 720 | 6.2 | 10 | 650 | 5.9 | 11 | ○ | ○ |
| COM. EXP. I I-20 | CTM-1 1.0 | I-13 3.0 | " | " | 22 | 810 | 23.0 | 34 | 720 | 25.0 | 37 | x | x |
| 21 | CTM-2 " | " " | " | " | " | 790 | 26.0 | 45 | 710 | 29.2 | 49 | x | x |

IN THE TABLE

CGM: CARRIER GENERATING MATERIAL AND CTM: CARRIER TRANSPORTING MATERIAL

CGM USED IN EXAMPLE IN EXAMPLE 23 THROUGH 34 AND COM. EXP. 8 THROUGH 9: METAL-FREE PHTHALOCYANINE COMPOUND A HAVING MAJOR PEAKS AT $2\theta$=7.5+0.2, 9.1+0.2, 16.7+0.2, 17.3+0.2, AND 22.3+0.2 DEGREES (COMPOUND A)

CGM-1: $\tau$ TYPE METAL-FREE PHTHALOCYANINE HAVING MAJOR PEAKS AT $2\theta$=7.6+0.2, 9.2+0.2, 16.8+0.2, 17.4+0.2, 20.4+0.2, AND 20.9+0.2 DEGREES CTM-2: $\eta$ TYPE METAL-FREE PHTHALOCYANINE HAVING MAJOR PEAKS AT $2\theta$=7.6+0.2, 9.2+0.2, 16.8+0.2, 17.4+0.2, 21.5+0.2, AND 27.5+0.2 DEGREES

*FIG. 17*

| | PHOTOSENSITIVE LAYER | | | | | EVALUATION ITEM | | | | | | | |
|---|---|---|---|---|---|---|---|---|---|---|---|---|---|
| | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER (μm) | $V_A$(V) | E1/2 (erg/cm2) | $V_R$(V) | $V_A$(V) | E1/2 (erg/cm2) | $V_R$(V) | INI-TIAL | ON 10,000th COPYING |
| EXAMPLE I-81 | 1.0 | I'-13 3.0 | 3.0 | 4 | 22 | 850 | 5.0 | 14 | 790 | 4.8 | 16 | ◎ | ○ |
| " I-82 | 1.5 | " 1.5 | 1.0 | " | " | 900 | 5.3 | 13 | 820 | 5.1 | 15 | ◎ | ○ |
| " I-83 | 2.0 | " 1.0 | 0.5 | " | " | 1030 | 5.6 | 15 | 930 | 5.5 | 17 | ○ | ○ |
| " I-84 | 5.0 | " 1.0 | 0.2 | " | " | 730 | 4.2 | 11 | 660 | 4.2 | 13 | ○ | ○ |
| " I-85 | 1.0 | " 5.0 | 5.0 | " | " | 860 | 4.4 | 19 | 880 | 4.3 | 21 | ◎ | ○ |
| " I-86 | 0.5 | " 3.5 | 7.0 | " | " | 960 | 6.8 | 14 | 880 | 6.5 | 16 | ○ | ○ |
| " I-87 | 0.5 | " 5.0 | 10.0 | " | " | 930 | 6.6 | 11 | 850 | 6.3 | 13 | ○ | ○ |
| " I-88 | 1.0 | I'-25 3.0 | 3.0 | " | 15 | 790 | 6.2 | 10 | 720 | 6.0 | 12 | ○ | ○ |
| " I-89 | " | " " | " | " | 30 | 1320 | 8.5 | 20 | 1210 | 8.2 | 22 | ○ | ○ |
| " I-90 | " | " " | " | " | 40 | 1650 | 11.2 | 28 | 1530 | 10.9 | 31 | ○ | ○ |
| " I-91 | " | " " | " | " | 50 | 1830 | 12.5 | 32 | 1700 | 12.2 | 36 | ○ | ○ |
| " I-92 | " | " " | " | " | 10 | 750 | 5.7 | 8 | 680 | 5.4 | 10 | ○ | ○ |

IN THE TABLE
CGM : CARRIER GENERATING MATERIAL CTM: CARRIER TRANSPORTING MATERIAL
CGM : METAL-FREE PHTHALOCYANINE COMPOUND B HAVING MAJOR PEAKS AT $2\theta$=7.7±0.2, 9.3±0.2, 16.9±0.2, 17.6±0.2, AND 22.3±0.2 DEGREES

*FIG. 18*

| | CARRIER GENERATING LAYER | | | | | CARRIER TRANSPORTING LAYER | | | EVALUATION ITEM | | | | | | | |
|---|---|---|---|---|---|---|---|---|---|---|---|---|---|---|---|---|
| | | | | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER | CTM (g) | BINDER (g) | THICKNESS OF LAYER | $V_A$(V) | EI/2 (erg/cm$^2$) | $V_R$(V) | $V_A$(V) | EI/2 (erg/cm$^2$) | $V_R$(V) | INI-TIAL | ON 10,000th COPYING |
| EXAMPLE II-1 | 1.0g | II-16 3.0g | 3.0 | POLYCARBONATE 4 | 4μm | II-16 | 10g | 16g | 900 | 5.5 | 13 | 840 | 5.3 | 16 | ◎ | ○ |
| " 2 | 1.5g | " 1.5g | 1.0 | " | " | " | " | " | 980 | 6.2 | 11 | 920 | 6.0 | 13 | ○ | ○ |
| " 3 | 1.0g | " 2.0g | 2.0 | " | " | " | " | " | 940 | 5.9 | 15 | 880 | 5.6 | 18 | ◎ | ○ |
| " 4 | 1.0g | " 5.0g | 5.0 | " | " | " | " | " | 870 | 5.3 | 13 | 820 | 5.0 | 15 | ○ | ○ |
| " 5 | 0.5g | II-23 3.5g | 7.0 | " | " | II-23 | " | " | 990 | 6.3 | 20 | 910 | 6.0 | 25 | ○ | ○ |
| " 6 | 1.5g | " 5.0g | 10.0 | " | " | " | " | " | 940 | 6.0 | 17 | 860 | 5.7 | 20 | ○ | ○ |
| " 7 | 3.0g | " 1.5g | 0.5 | " | " | " | " | " | 1010 | 5.6 | 11 | 930 | 5.3 | 14 | ○ | ○ |
| " 8 | 1.0g | II-25 3.0g | 3.0 | " | 1μm | II-25 | " | " | 1100 | 9.0 | 11 | 1010 | 8.7 | 14 | ○ | ○ |
| " 9 | 1.0g | I " 3.0g | 3.0 | " | 2μm | " | " | " | 980 | 7.6 | 12 | 910 | 7.2 | 15 | ◎ | ○ |
| " 10 | " | " " | " | " | 6μm | " | " | " | 920 | 6.0 | 19 | 840 | 5.8 | 25 | ◎ | ○ |
| " 11 | " | " " | " | " | 10μm | " | " | " | 900 | 5.3 | 20 | 800 | 5.0 | 23 | ○ | ○ |
| COMP. EXP. II-1 | 1.0g | CTM-1 " | " | " | 4μm | II-16 | " | " | 1130 | 12.0 | 30 | 1020 | 11.6 | 34 | x | x |
| 2 | 1.0g | CTM-2 " | " | " | " | " | " | " | 1090 | 13.0 | 37 | 980 | 12.5 | 40 | x | x |
| 3 | " | – | 0.0 | " | " | " | " | " | 1250 | 20.5 | 75 | 1100 | 20.0 | 87 | x | x |
| 4 | CGM-1 1.0 | II-16 3.0 | 3.0 | " | " | " | " | " | 830 | 17.0 | 45 | 760 | 17.5 | 50 | x | x |
| 5 | CGM-2 " | II-23 " | " | " | " | II-23 | " | " | 780 | 20.0 | 38 | 720 | 20.5 | 42 | x | x |

IN THE TABLE

CGM: CARRIER GENERAITNG MATERIAL CTM: CARRIER TRANSPORTING MATERIAL

CGM USED IN EXAMPLE 1 THROUGH 11 AND COM. EXP. 1 THROUGH 3: METAL-FREE PHTHALOCYANINE HAVING MAJOR PEAKS AT 2θ=7.5±0.2, 9.1=0.2, 16.7=0.2, 17.3=0.2, AND 22.3=0.2 DEGREES (COMPOUND A)

CGM-1: τ TYPE METAL-FREE PHTHALOCYANINE HAVING MAJOR PEAKS AT 2θ=7.6±0.2, 9.2±0.2, 16.8±0.2, 17.4±0.2, 20.4+0.2, AND 20.9±0.2 DEGREES

CGM-2: η TYPE METAL-FREE PHTHALOCYANINE HAVING MAJOR PEAKS AT 2θ=7.6±0.2, 9.2±0.2, 16.8±0.2, 17.4±0.2, 21.5+0.2, AND 27.5±0.2 DEGREES

CTM-1

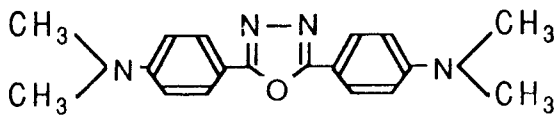

CTM-2

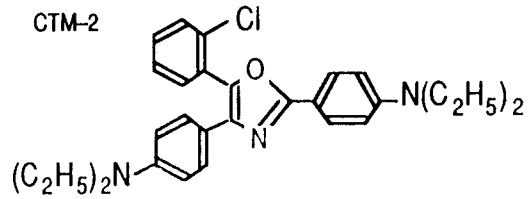

FIG. 19

| | CARRIER GENERATING LAYER | | | | | CARRIER TRANSPORTING LAYER | | | EVALUATION ITEM | | | | | | | |
|---|---|---|---|---|---|---|---|---|---|---|---|---|---|---|---|---|
| | | | | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER | CTM | BINDER | THICKNESS OF LAYER | $V_A$(V) | E1/2 (erg/cm 2) | $V_R$(V) | $V_A$(V) | E1/2 (erg/cm 2) | $V_R$(V) | INI-TIAL | ON 10,000th COPYING |
| EXAMPLE II-12 | 1.0g | II-16 3.0g | 3.0 | POLYCARBONATE 4 | 4μm | II-16 | 10g | 16μm | 920 | 5.3 | 12 | 860 | 5.0 | 14 | | ○ |
| " 13 | 1.5g | " 1.5g | 1.0 | " | " | " | " | " | 1000 | 6.0 | 10 | 950 | 5.7 | 12 | ○ | ○ |
| " 14 | 1.0g | " 2.0g | 2.0 | " | " | " | " | " | 950 | 5.7 | 14 | 910 | 5.5 | 15 | ◎ | ○ |
| " 15 | " | " 5.0g | 5.0 | " | " | " | " | " | 900 | 5.0 | 12 | 850 | 4.6 | 14 | ◎ | ○ |
| " 16 | 0.5g | II-23 3.5g | 7.0 | " | " | II-23 | " | " | 1010 | 6.4 | 18 | 960 | 6.0 | 20 | ○ | ○ |
| " 17 | " | " 5.0g | 10.0 | " | " | " | " | " | 960 | 6.0 | 15 | 900 | 5.6 | 18 | ○ | ○ |
| " 18 | 3.0g | " 1.5g | 0.5 | " | " | " | " | " | 1050 | 5.5 | 10 | 990 | 5.0 | 12 | ○ | ○ |
| " 19 | 1.0g | II-25 3.0g | 3.0 | " | 1μm | II-25 | " | " | 1120 | 8.6 | 5 | 1050 | 8.1 | 7 | ○ | ○ |
| " 20 | 1.0g | " 3.0g | 3.0 | " | 2μm | " | " | " | 1000 | 7.5 | 5 | 930 | 7.2 | 8 | ◎ | ○ |
| " 21 | 1.0 | " " | " | " | 6μm | " | " | " | 950 | 5.6 | 17 | 860 | 5.3 | 17 | ◎ | ○ |
| " 22 | 1.0 | " " | " | " | 10μm | " | " | " | 930 | 5.0 | 18 | 840 | 4.6 | 18 | ○ | ○ |
| COMP. EXP. II-6 | 1.0 | CTM-1 " | " | " | 4μm | CTM-1 | " | " | 1210 | 14.0 | 40 | 1100 | 13.0 | 45 | x | x |
| 7 | 1.0 | – | 0.0 | " | " | " | " | " | 1300 | 25.5 | 85 | 1120 | 25.0 | 103 | x | x |

IN THE TABLE
CGM : CARRIER GENERATING MATERIAL AND CTM: CARRIER TRANSPORTING MATERIAL
CGM : METAL-FREE PHTHALOCYANINE COMPOUND B HAVING MAJOR PEAKS AT 2θ=7.7±0.2, 9.3±0.2, 16.9±0.2, 17.6±0.2, 22.4±0.2, AND 28.8±0.2 DEGREES

CTM-1

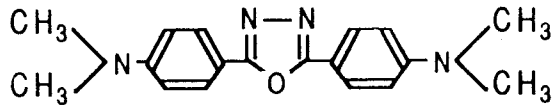

FIG. 20

| | PHOTOSENSITIVE LAYER | | | | | EVALUATION ITEM | | | | | | | |
|---|---|---|---|---|---|---|---|---|---|---|---|---|---|
| | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER | $V_A$(V) | E1/2 (erg/cm$^2$) | $V_R$(V) | $V_A$(V) | E1/2 (erg/cm$^2$) | $V_R$(V) | INI-TIAL | ON 10,000th COPYING |
| EXAMPLE II-23 | 1.0 | IΓ-10 3.0 | 3.0 | 4 | 22 | 860 | 5.0 | 13 | 780 | 4.9 | 15 | ◎ | o |
| " 24 | 1.5 | " 1.5 | 1.0 | " | " | 910 | 5.2 | 11 | 820 | 5.0 | 14 | ◎ | o |
| " 25 | 2.0 | " 1.0 | 0.5 | " | " | 1040 | 5.4 | 13 | 950 | 5.3 | 15 | o | o |
| " 26 | 5.0 | " 1.0 | 0.2 | " | " | 750 | 4.1 | 10 | 680 | 4.0 | 12 | o | o |
| " 27 | 1.0 | " 5.0 | 5.0 | " | " | 860 | 4.4 | 15 | 780 | 4.1 | 18 | ◎ | o |
| " 28 | 0.5 | " 3.5 | 7.0 | " | " | 970 | 6.9 | 12 | 890 | 6.7 | 15 | o | o |
| " 29 | 0.5 | " 5.0 | 10.0 | " | " | 950 | 6.7 | 10 | 880 | 6.4 | 11 | o | o |
| " 30 | 1.0 | II-20 3.0 | 3.0 | " | 15 | 800 | 6.2 | 9 | 710 | 6.0 | 12 | o | o |
| " 31 | " | " " | " | " | 30 | 1350 | 8.8 | 20 | 1200 | 8.4 | 24 | o | o |
| " 32 | " | " " | " | " | 40 | 1680 | 11.8 | 25 | 1520 | 11.3 | 28 | o | o |
| " 33 | " | " " | " | " | 50 | 1850 | 13.0 | 30 | 1700 | 12.5 | 38 | o | o |
| " 34 | " | " " | " | " | 10 | 740 | 5.8 | 8 | 650 | 5.4 | 12 | o | o |
| COM. EXP. II-8 | 1.0 | II-2 3.0 | 3.0 | " | 22 | 910 | 13.0 | 32 | 850 | 12.0 | 38 | x | x |
| " 9 | " | " " | 0.0 | " | " | 950 | 15.5 | 85 | 900 | 17.0 | 105 | x | x |
| " 10 | CGM-1 1.0 | II-10 3.0 | 3.0 | " | 4 | 840 | 24.0 | 34 | 760 | 23.0 | 40 | x | x |
| " 11 | CGM-2 1.0 | " 3.0 | " | " | " | 820 | 27.0 | 45 | 740 | 25.5 | 50 | x | x |

IN THE TABLE

CGM: CARRIER GENERATING MATERIAL AND CTM: CARRIER TRANSPORTING MATERIAL
CGM USED IN EXAMPLE IN EXAMPLE 23 THROUGH 34 AND COM. EXP. 8 AND 9: METAL-FREE PHTHALOCYANINE COMPOUND A HAVING MAJOR PEAKS AT 2θ=7.5+0.2, 9.1+0.2, 16.7+0.2, 17.3+0.2, AND 22.3+0.2 DEGREES (COMPOUND A)

CGM-1: τ TYPE METAL-FREE PHTHALOCYANINE HAVING MAJOR PEAKS AT 2θ=7.6+0.2, 9.2+0.2, 16.8+0.2, 17.4+0.2, 20.4+0.2, AND 20.9+0.2 DEGREES

CTM-2: η TYPE METAL-FREE PHTHALOCYANINE HAVING MAJOR PEAKS AT 2θ=7.6+0.2, 9.2+0.2, 16.8+0.2, 17.4+0.2, 21.5+0.2, AND 27.5+0.2 DEGREES

CTM-2

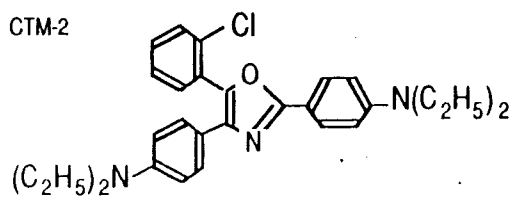

FIG. 21

| | PHOTOSENSITIVE LAYER | | | | | EVALUATION ITEM | | | | | | | |
|---|---|---|---|---|---|---|---|---|---|---|---|---|---|
| | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER μm | $V_A$(V) | EI/2 (erg/cm 2) | $V_R$(V) | $V_A$(V) | EI/2 (erg/cm 2) | $V_R$(V) | INI-TIAL | ON 10,000th COPYING |
| EXAMPLE II-35 | 1.0 | II-10 3.0 | 3.0 | 4 | 22 | 880 | 4.8 | 11 | 800 | 4.6 | 13 | ◎ | ○ |
| " 36 | 1.5 | " 1.5 | 1.0 | " | " | 940 | 5.0 | 8 | 860 | 4.7 | 10 | ◎ | ○ |
| " 37 | 2.0 | " 1.0 | 0.5 | " | " | 1060 | 5.2 | 11 | 1000 | 5.0 | 14 | ○ | ○ |
| " 38 | 5.0 | " 1.0 | 0.2 | " | " | 770 | 3.8 | 9 | 710 | 3.5 | 12 | ○ | ○ |
| " 39 | 1.0 | " 5.0 | 5.0 | " | " | 880 | 4.2 | 13 | 800 | 3.9 | 16 | ○ | ○ |
| " 40 | 0.5 | " 3.5 | 7.0 | " | " | 990 | 6.7 | 9 | 910 | 6.5 | 11 | ○ | ○ |
| " 41 | 0.5 | " 5.0 | 10.0 | " | " | 970 | 6.5 | 8 | 880 | 6.2 | 10 | ○ | ○ |
| " 42 | 1.0 | II-20 3.0 | " | " | 15 | 820 | 5.9 | 6 | 750 | 5.5 | 8 | ○ | ○ |
| " 43 | " | " " | " | " | 30 | 1380 | 8.5 | 16 | 1250 | 8.0 | 18 | ○ | ○ |
| " 44 | " | " " | " | " | 40 | 1700 | 11.3 | 22 | 1550 | 11.0 | 28 | ○ | ○ |
| " 45 | " | " " | " | " | 50 | 1880 | 12.5 | 27 | 1700 | 12.1 | 35 | ○ | ○ |
| " 46 | " | " " | " | " | 10 | 760 | 5.5 | 6 | 700 | 5.3 | 9 | ○ | ○ |
| COMP. EXP. II-12 | 1.0 | CTM-1 3.0 | 3.0 | " | 22 | 930 | 11.3 | 28 | 890 | 10.2 | 35 | x | x |
| " 13 | 1.0 | – | 0.0 | " | 22 | 980 | 14.0 | 70 | 930 | 13.0 | 83 | x | x |

IN THE TABLE,
CGM: CARRIER GENERATING MATERIAL AND CTM:CARRIER TRANSPORTING MATERIAL
CGM: METAL-FREE PHTHALOCYANINE COMPOUND B HAVING MAJOR PEAKS AT 2θ=7.7±0.2, 9.3±0.2, 16.9±0.2, 17.6±0.2, 22.4±0.2 AND 28.8±0.2 DEGREES

CTM-1

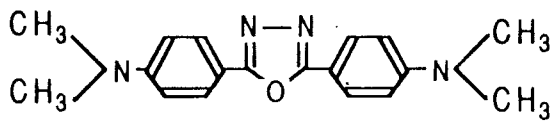

FIG. 22

| | CARRIER GENERATING LAYER | | | | | CARRIER TRANSPORTING LAYER | | | EVALUATION ITEM | | | | | | | |
|---|---|---|---|---|---|---|---|---|---|---|---|---|---|---|---|---|
| | | | | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER (μm) | CTM | BINDER (g) | THICKNESS OF LAYER (μm) | $V_A$(V) | E1/2 (erg/cm2) | $V_R$(V) | $V_A$(V) | E1/2 (erg/cm2) | $V_R$(V) | INI-TIAL | ON 10,000th COPYING |
| EXAMPLE III-1 | 1.0g | III-16 3.0 | 3.0 | POLYCAR-BONATE 4 | 4 | III-5 | 10g | 16μm | 830 | 4.4 | 7 | 750 | 4.1 | 7 | ◎ | ○ |
| " 2 | 1.0g | " 5.0 | 5.0 | " | " | " | " | " | 800 | 4.3 | 6 | 740 | 4.0 | 6 | ◎ | ○ |
| " 3 | 0.5g | III-12 3.5 | 7.0 | " | " | III-12 | " | " | 860 | 5.5 | 13 | 790 | 5.3 | 14 | ◎ | ○ |
| " 4 | 0.5g | " 5.0 | 10.0 | " | " | " | " | " | 840 | 5.3 | 10 | 780 | 5.1 | 11 | ○ | ○ |
| " 5 | 1.0g | " 1.5 | 0.5 | " | " | " | " | " | 900 | 4.7 | 5 | 800 | 4.3 | 5 | ○ | ○ |
| " 6 | 1.0g | III-29 3.0 | 3.0 | " | 1 | III-29 | " | " | 1100 | 9.3 | 8 | 1030 | 8.9 | 8 | ○ | ○ |
| " 7 | 3.0g | " 3.0 | 3.0 | " | 2 | " | " | " | 1020 | 7.2 | 9 | 950 | 6.8 | 10 | ◎ | ○ |
| " 8 | 1.0g | " 3.0 | 3.0 | " | 6 | " | " | " | 950 | 5.5 | 15 | 880 | 5.2 | 16 | ◎ | ○ |
| " 9 | 1.0g | " 3.0 | 3.0 | " | 10 | " | " | " | 890 | 4.8 | 17 | 750 | 4.5 | 18 | ○ | ○ |
| COMP. EXP. III-1 | CGM-1 1.0 | III-5 3.0 | 3.0 | " | 4 | III-5 | " | " | 700 | 15.0 | 30 | 650 | 15.0 | 39 | x | x |
| 2 | CGM-2 1.0 | III-5 3.0 | 3.0 | " | 4 | III-5 | " | " | 640 | 16.0 | 27 | 590 | 16.5 | 35 | x | x |

IN THE TABLE
CGM : CARRIER GENERATING MATERIAL
CTM: CARRIER TRANSPORTING MATERIAL
CGM USED IN EXAMPLE 1 THROUGH 9: METAL-FREE PHTHALOCYANINE COMPOUND A HAVING MAJOR PEAKS AT $2\theta$=7.5±0.2, 9.1±0.2, 16.7±0.2, 17.3±0.2, AND 22.3±0.2 DEGREES
CGM-1: $\tau$ TYPE METAL-FREE PHTHALOCYANINE HAVING MAJOR PEAKS AT $2\theta$=7.6±0.2, 9.2±0.2, 16.8±0.2, 17.4±0.2, 20.4±0.2, AND 20.9±0.2 DEGREES
CGM-2: $\eta$ TYPE METAL-FREE PHTHALOCYANINE HAVING MAJOR PEAKS AT $2\theta$=7.6±0.2, 9.2±0.2, 16.8±0.2, 17.4±0.2, 21.5±0.2, AND 27.5±0.2 DEGREES

FIG. 23

| | CARRIER GENERATING LAYER | | | | | CARRIER TRANSPORTING LAYER | | | EVALUATION ITEM | | | | | | | |
|---|---|---|---|---|---|---|---|---|---|---|---|---|---|---|---|---|
| | | | | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER (μm) | CTM | BINDER (g) | THICKNESS OF LAYER (μm) | $V_A$(V) | E1/2 (erg/cm2) | $V_R$(V) | $V_A$(V) | E1/2 (erg/cm2) | $V_R$(V) | INI-TIAL | ON 10,000th COPYING |
| EXAMPLE III-10 | 1.0 | III-5 3.0 | 3.0 | POLYCAR-BONATE 4 | 4 | III-5 | 10g | 16μm | 850 | 4.2 | 6 | 780 | 4.0 | 6 | ◎ | ◎ |
| " 11 | 0.5 | III-12 3.5 | 7.0 | " | " | III-12 | " | " | 870 | 5.2 | 12 | 800 | 5.0 | 12 | ◎ | ◎ |
| " 12 | 1.0 | III-29 3.0 | 3.0 | " | 1 | III-29 | " | " | 1130 | 9.0 | 7 | 1060 | 8.7 | 8 | ○ | ○ |

IN THE TABLE
CGM : CARRIER GENERATING MATERIAL
CTM: CARRIER TRANSPORTING MATERIAL
CGM : METAL-FREE PHTHALOCYANINE COMPOUND B HAVING MAJOR PEAKS AT 2θ=7.7±0.2, 9.3±0.2, 16.9±0.2, 17.6±0.2, 22.4±.02 AND 28.8±0.2 DEGREES

*FIG. 24*

| | PHOTOSENSITIVE LAYER | | | | | EVALUATION ITEM | | | | | | | |
|---|---|---|---|---|---|---|---|---|---|---|---|---|---|
| | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER (μm) | $V_A$(V) | E1/2 (erg/cm2) | $V_R$(V) | $V_A$(V) | E1/2 (erg/cm2) | $V_R$(V) | INI-TIAL | ON 10,000th COPYING |
| EXAMPLE III-13 | 1.0 | III-10 3.0 | 3.0 | 4 | 22 | 790 | 4.6 | 12 | 700 | 4.3 | 16 | ◎ | ○ |
| " 14 | 5.0 | " 1.0 | 0.2 | " | " | 710 | 4.1 | 11 | 630 | 4.0 | 13 | ○ | ○ |
| " 15 | 1.0 | " 5.0 | 5.0 | " | " | 760 | 4.4 | 17 | 690 | 4.3 | 23 | ◎ | ○ |
| " 16 | 0.5 | " 3.5 | 7.0 | " | " | 900 | 6.8 | 15 | 800 | 6.5 | 19 | ○ | ○ |
| " 17 | 0.5 | " 5.0 | 10.0 | " | " | 850 | 6.3 | 12 | 770 | 6.0 | 16 | ○ | ○ |
| " 18 | 1.0 | III-30 3.0 | 3.0 | " | 30 | 1130 | 7.3 | 20 | 1000 | 7.0 | 27 | ○ | ○ |
| COMP. EXP. " III-3 | CGM-1 1.0 | III-10 3.0 | 3.0 | " | 22 | 730 | 20.0 | 30 | 650 | 20.0 | 36 | x | x |
| " 4 | CGM-2 1.0 | " 3.0 | " | " | " | 700 | 22.0 | 38 | 620 | 21.5 | 44 | x | x |

IN THE TABLE
CGM : CARRIER GENERATING MATERIAL
CTM: CARRIER TRANSPORTING MATERIAL
CGM USED IN EXAMPLE 13 THROUGH 18: METAL-FREE PHTHALOCYANINE COMPOUND A HAVING MAJOR PEAKS AT 2θ=7.5±0.2, 9.1±0.2, 16.7±0.2, 17.3±0.2, AND 22.3±0.2 DEGREES

CGM-1: τ TYPE METAL-FREE PHTHALOCYANINE HAVING MAJOR PEAKS AT 2θ=7.6±0.2, 9.2±0.2, 16.8±0.2, 17.4±0.2, 20.4±0.2, AND 20.9±0.2 DEGREES

CGM-2: η TYPE METAL-FREE PHTHALOCYANINE HAVING MAJOR PEAKS AT 2θ=7.6±0.2, 9.2±0.2, 16.8±0.2, 17.4±0.2, 21.5±0.2, AND 27.5±0.2 DEGREES

*FIG. 25*

| | PHOTOSENSITIVE LAYER | | | | | EVALUATION ITEM | | | | | | | |
|---|---|---|---|---|---|---|---|---|---|---|---|---|---|
| | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER (μm) | $V_A$(V) | E1/2 (erg/cm2) | $V_R$(V) | $V_A$(V) | E1/2 (erg/cm2) | $V_R$(V) | INI-TIAL | ON 10,000th COPYING |
| EXAMPLE III-19 | 1.0 | III-10 3.0 | 3.0 | 4 | 22 | 800 | 4.4 | 11 | 700 | 4.1 | 15 | ◎ | ○ |
| " 20 | 1.0 | III-30 3.0 | " | " | 30 | 1150 | 7.0 | 18 | 1000 | 6.5 | 24 | ○ | ○ |

IN THE TABLE
CGM : CARRIER GENERATING MATERIAL
CTM: CARRIER TRANSPORTING MATERIAL
CGM: METAL-FREE PHTHALOCYANINE COMPOUND B HAVING MAJOR PEAKS AT 2θ=7.7±0.2, 9.3±0.2, 16.9±0.2, 17.6±0.2, 22.4±0.2 AND 28.8±0.2 DEGREES

*FIG. 26*

| | CARRIER GENERATING LAYER | | | | | CARRIER TRANSPORTING LAYER | | | EVALUATION ITEM | | | | | | | |
|---|---|---|---|---|---|---|---|---|---|---|---|---|---|---|---|---|
| | | | | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER μm | CTM (g) | BINDER (g) | THICKNESS OF LAYER μm | $V_A$(V) | EI/2 (erg/cm$^2$) | $V_R$(V) | $V_A$(V) | EI/2 (erg/cm$^2$) | $V_R$(V) | INI-TIAL | ON 10,000th COPYING |
| EXAMPLE III-21 | 1.0 | III-3 3.0 | 3.0 | POLYCARBONATE 4 | 4 | III-3 | 10g | 16μm | 870 | 4.6 | 9 | 800 | 4.4 | 10 | ◎ | ○ |
| " 22 | 1.0 | " 5.0 | 5.0 | " | " | " | " | " | 850 | 4.5 | 8 | 830 | 4.3 | 8 | ◎ | ○ |
| " 23 | 0.5 | III-13 3.5 | 7.0 | " | " | III-13 | " | " | 840 | 5.2 | 11 | 760 | 5.0 | 11 | ◎ | ○ |
| " 24 | 0.5 | " 5.0 | 10.0 | " | " | " | " | " | 820 | 5.0 | 9 | 740 | 4.8 | 10 | ○ | ○ |
| " 25 | 3.0 | " 1.5 | 0.5 | " | " | " | " | " | 890 | 4.6 | 6 | 800 | 4.2 | 6 | ○ | ○ |
| " 26 | 1.0 | III-34 3.0 | 3.0 | " | 1 | III-34 | " | " | 1130 | 9.5 | 10 | 1050 | 9.0 | 10 | ○ | ○ |
| " 27 | 1.0 | " 3.0 | 3.0 | " | 2 | " | " | " | 1040 | 7.4 | 12 | 970 | 7.0 | 13 | ◎ | ○ |
| " 28 | 3.0 | " 3.0 | 3.0 | " | 6 | " | " | " | 960 | 5.5 | 17 | 880 | 5.1 | 18 | ◎ | ○ |
| " 29 | 1.0 | " 3.0 | 3.0 | " | 10 | " | " | " | 910 | 4.9 | 20 | 770 | 4.6 | 20 | ○ | ○ |
| COMP. EXP. III-5 | CGM-1 1.0 | III-3 3.0 | 3.0 | " | 4 | III-3 | " | " | 730 | 16.0 | 33 | 660 | 16.5 | 41 | x | x |
| " III-6 | CGM-2 1.0 | III-3 3.0 | 3.0 | " | " | III-3 | " | " | 660 | 17.5 | 29 | 600 | 18.0 | 37 | x | x |

IN THE TABLE
CGM : CHARGE GENERATING MATERIAL
CTM : CHARGE TRANSPORTING MATERIAL
CGM : METAL-FREE PHTHALOCYANINE COMPOUND A HAVING MAJOR PEAKS AT 2θ=7.7± 0.2, 9.3+0.2, 16.9+0.2, 17.6+0.2 AND 22.3+0.2 DEGREES (EXAMPLE 21 THROUGH 29)
CGM-1: τ TYPE METAL-FREE PHTHALOCYANINE HAVING MAJOR PEAKS AT 2θ=7.6+0.2, 9.2+0.2, 16.8+0.2, 17.4+0.2, 20.4+0.2, AND 20.9+0.2 DEGREES
CGM-2: η TYPE METAL-FREE PHTHALOCYANINE HAVING MAJOR PEAKS AT 2θ=7.6+0.2, 9.2+0.2, 16.8+0.2, 17.4+0.2, 21.5+0.2, AND 27.5+0.2 DEGREES

FIG. 27

| | CARRIER GENERATING LAYER | | | | | CARRIER TRANSPORTING LAYER | | | EVALUATION ITEM | | | | | | | |
|---|---|---|---|---|---|---|---|---|---|---|---|---|---|---|---|---|
| | | | | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER (μm) | CTM | BINDER (g) | THICKNESS OF LAYER (μm) | $V_A$(V) | E1/2 (erg/cm2) | $V_R$(V) | $V_A$(V) | E1/2 (erg/cm2) | $V_R$(V) | INI-TIAL | ON 10,000th COPYING |
| EXAMPLE III'-30 | 1.0 | III'-3 3.0 | 3.0 | POLYCAR-BONATE 4 | 4 | III'-3 | 10g | 16μm | 890 | 4.4 | 7 | 830 | 4.2 | 7 | — | — |
| " 31 | 0.5 | III'-13 3.5 | 7.0 | " | " | III'-13 | " | " | 850 | 5.0 | 9 | 780 | 4.7 | 10 | — | — |
| " 32 | 1.0 | III'-34 3.0 | 3.0 | " | 1 | III'-34 | " | " | 1150 | 9.0 | 9 | 1080 | 8.7 | 9 | — | — |

IN THE TABLE
CGM : CARRIER GENERATING MATERIAL
CTM: CARRIER TRANSPORTING MATERIAL
CGM : METAL-FREE PHTHALOCYANINE COMPOUND A HAVING MAJOR PEAKS AT 2θ=7.7±0.2, 9.3±0.2, 16.9±0.2, 17.6±0.2, AND 22.3±.02 DEGREES

*FIG. 28*

| | PHOTOSENSITIVE LAYER | | | | | EVALUATION ITEM | | | | | | | |
|---|---|---|---|---|---|---|---|---|---|---|---|---|---|
| | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER (μm) | $V_A$(V) | E1/2 (erg/cm2) | $V_R$(V) | $V_A$(V) | E1/2 (erg/cm2) | $V_R$(V) | INI-TIAL | ON 10,000th COPYING |
| EXAMPLE III-33 | 1.0 | III'-16 3.0 | 3.0 | 4 | 22 | 820 | 5.1 | 14 | 730 | 4.9 | 17 | ◎ | ○ |
| " 34 | 5.0 | III'-16 1.0 | 0.2 | " | " | 690 | 4.2 | 12 | 610 | 4.0 | 15 | ○ | ○ |
| " 35 | 1.0 | " 5.0 | 5.0 | " | " | 810 | 4.5 | 18 | 730 | 4.3 | 23 | ◎ | ○ |
| " 36 | 0.5 | " 3.5 | 7.0 | " | " | 920 | 7.0 | 15 | — | — | — | ○ | ○ |
| " 37 | 0.5 | " 5.0 | 10.0 | " | " | 880 | 6.6 | 12 | — | — | — | ○ | ○ |
| " 38 | 1.0 | III'-37 3.0 | 3.0 | " | 30 | 1260 | 7.5 | 21 | 1150 | 7.2 | 25 | ○ | ○ |
| COMP. EXP. " III-7 | CGM-1 1.0 | III'-16 3.0 | 3.0 | " | 22 | 790 | 22.0 | 32 | 710 | 23.0 | 36 | x | x |
| " III-8 | CGM-2 1.0 | III'-37 3.0 | " | " | " | 770 | 25.2 | 39 | 700 | 26.0 | 44 | x | x |

IN THE TABLE
CGM : CARRIER GENERATING MATERIAL
CTM: CARRIER TRANSPORTING MATERIAL
CGM: METAL-FREE PHTHALOCYANINE COMPOUND A HAVING MAJOR PEAKS AT
$2\theta$=7.5±0.2, 9.1±0.2, 16.7±0.2, 17.3±0.2, AND 22.3±0.2 DEGREES (EXAMPLE 33 THROUGH 38)

CGM-1: $\tau$ TYPE METAL-FREE PHTHALOCYANINE HAVING MAJOR PEAKS AT $2\theta$=7.6±0.2, 9.2±0.2, 16.8±0.2, 17.4±0.2, 20.4±0.2, AND 20.9±0.2 DEGREES CGM-2: $\eta$ TYPE METAL-FREE PHTHALOCYANINE HAVING MAJOR PEAKS AT $2\theta$=7.6±0.2, 9.2±0.2, 16.8±0.2, 17.4±0.2, 21.5±0.2, AND 27.5±0.2 DEGREES

*FIG. 29*

| | PHOTOSENSITIVE LAYER | | | | | EVALUATION ITEM | | | | | | | |
|---|---|---|---|---|---|---|---|---|---|---|---|---|---|
| | | | | | | INITIAL CHARACTERISTICS | | | CHARACTERISTICS ON 10,0000th COPYING | | | IMAGE QUALITY | |
| | CGM (g) | CTM (g) | CTM /CGM | BINDER (g) | THICKNESS OF LAYER (μm) | $V_A$(V) | E1/2 (erg/cm2) | $V_R$(V) | $V_A$(V) | E1/2 (erg/cm2) | $V_R$(V) | INI-TIAL | ON 10,000th COPYING |
| EXAMPLE III-39 | 1.0 | III'-16 3.0 | 3.0 | 4 | 22 | 840 | 5.0 | 12 | 750 | 4.8 | 15 | O | O |
| " 40 | 1.0 | III'-37 3.0 | " | " | 30 | 1280 | 7.2 | 19 | 1180 | 7.0 | 23 | O | O |

IN THE TABLE
CGM : CARRIER GENERATING MATERIAL
CTM: CARRIER TRANSPORTING MATERIAL
CGM: METAL-FREE PHTHALOCYANINE COMPOUND B HAVING MAJOR PEAKS AT 2θ=7.7±0.2, 9.3±0.2, 16.9±0.2, 17.6±0.2, 22.4±0.2 AND 28.8±0.2 DEGREES

*FIG. 30*

PHOTORECEPTOR HAVING A METAL-FREE PHTHALOCYANINE CHARGE GENERATING LAYER

FIELD OF THE INVENTION

The present invention relates to photoreceptors, and, in particular, to electrophotographic photoreceptors.

BACKGROUND OF THE INVENTION

Hitherto, electrophotographic photoreceptors being photosensitive to visible rays have been widely used in copying machines, printers, and the like.

For such electrophotographic photoreceptors, inorganic photoreceptors having a photosensitive layer composed principally of an inorganic photoconductive material, such as selenium, zinc oxide, or cadmium sulfide, are widely used. However, these inorganic photoreceptors are not always satisfactory in various performance characteristics, such as photosensitivity, thermal stability, humidity resistance, and service durability, which are required of an electrophotographic photoreceptor for use in copying machines and the like. for example, selenium is liable to become crystallized under heat or by stains with fingerprints or otherwise, thus possibly deteriorating the foregoing characteristics of the electrophotographic photoreceptor. Photoreceptors in which cadmium sulfide is used are found unsatisfactory in humidity resistance and durability, and those in which zinc oxide is used have a disadvantage in respect to durability. Further, electrophotographic photoreceptors in which selenium or cadmium sulfide is used incur considerable limitations in manufacturing and in handling.

To overcome these problems on such inorganic photoconductive materials, attempts have been made to use various kinds of photoconductive materials in a photosensitive layer of an electrophotographic photoreceptor and, in recent years, various research and development works have been actively made which are directed to this end. For example, Japanese Patent Examined Publication No. 10496/1975 discloses an organic photoreceptor having a photosensitive layer containing poly-N-vinylcarbazole and 2,4,7-trinitro-9-fluorenone. However, this photoreceptor is still unsatisfactory in respect of sensitivity and durability. In view of this deficiency there has been developed an electrophotographic photoreceptor of the function divided type in which two separate layers are provided in place of a photosensitive layer, one as a carrier generating layer and the other as a carrier transporting layer, the two layers respectively containing a carrier generating material and a carrier transporting material. According to this arrangement, a carrier generating function and a carrier transporting function can be separately allotted to different materials so that the materials assigned to the different functions can be individually selected from wide ranges of materials. Therefore, electrophotographic photoreceptors having any desired performance characteristics can be comparatively easily produced. Thus, it is expected that an organic photoreceptor can be provided which has high sensitivity and high durability.

A number of different materials have hitherto been proposed as carrier generating materials effective for use in a carrier generating layer of such function divided type electrophotographic photoreceptor. The use of an inorganic material as such is disclosed in, for example, Japanese Patent Examined Publication No. 16198/1968 in which amorphous selenium is used. A carrier generating layer having an amorphous selenium content is used in combination with a carrier transporting layer containing an organic carrier transporting material. However, the carrier generating layer which comprises amorphous selenium involves the difficulty that, as already mentioned, the selenium is liable to become crystallized under heat or otherwise with the result of the layer being deteriorated in its performance characteristics. For use of organic materials as carrier generating materials, organic dyes and organic pigments may be mentioned by way of example. Photoreceptors having a photosensitive layer containing, for example, a bisazo compound are already known through various publications including Japanese Patent Publication Open to Public Inspection (hereinafter referred to as Japanese Patent O.P.I. Publication) Nos. 37543/1972, 22834/1980, 79632/1979, and 116040/1981.

However, such known bisazo compound is of low sensitivity to light rays in a long wavelength range, though it exhibits comparatively good sensitivity in a short or medium wavelength range. Therefore, it has been difficult to use such compound in laser printers employing a semiconductor laser beam source on which expectations for high reliability are placed.

Gallium-aluminum-arsenic (Ga-Al-As)-based light emitting elements which are widely used today as a semiconductor laser have an oscillation wavelength of more than 750 nm or so. Various attempts have hitherto been made to provide an electrophotographic photoreceptor which is highly sensitive to light beams of such a long wavelength. For example, one approach considered is that a sensitizer is added to a photosensitive material, such as Se or CdS, which is highly sensitive to rays in a visible light range, to thereby make the material sensitive to long wavelength light rays. With this approach, however, there is some problem yet to be solved, because Se and CdS are, as earlier mentioned, not well resistant to such environmental conditions as temperature and humidity. Whilst, many known organic photoconductive materials have a limitation in sensitivity in that, as already stated, they are usually only sensitive to visible light rays within a wavelength range of not more than 700 nm, and there are few such materials which have good sensitivity to light rays in a longer wavelength range.

Of these materials, phthalocyanine compounds as one type of organic photoconductive materials are known as having a wider sensitivity range, than other organic photoconductive materials, which extends into a longer wavelength range. Phthalocyanines of various crystal forms have been found in the process of $\alpha$-type phthalocyanines being converted into $\beta$-type phthalocyanines having a stable crystal form. As an example of such phthalocyanine compound having good photoconductivity, mention may be made of $\tau$-type metal-free phthalocyanines as disclosed in Japanese Patent O.P.I. Publication No. 182639/1983. In an X-ray diffraction spectrum as given in FIG. 10, such -type metal-free phthalocyanine shows Bragg angle 2 peaks at 7.6, 9.2, 16.8, 17.4, 20.4, and 20.9 degrees respectively in relation to a CuK$\alpha$ characteristic X-ray (wavelength 1.541 Å) (which X-ray is hereinafter referred to as CuK$\alpha$ (1.541 Å)).

In an infrared absorption spectrum, there are four intense absorption bands in a wavelength range of 700 to 760 $cm^{-1}$ in which an intensemost band is seen at 752±2 $cm^{-1}$, two absorption bands of substantially same intensity in a wavelength range of 1320 to 1340 $cm^{-1}$, and a characteristic absorption band at 3288±2 $cm^{-1}$.

However, the difficulty with such $\tau$-type metal-free phthalocyanine is that production of same requires a complicated and difficult process such that an $\tau$-type phthalocyanine is subjected to wet kneading together with grinding auxiliaries, such as sodium chloride and the like, and an inert organic solvent, such as ethylene glycol, at 50°-180° C., preferably at 60°-130° C., for 5 to 20 hours. Therefore, it is not always possible to obtain a $\alpha$-type phthalocyanine having a given crystal form; accordingly, where such phthalocyanine is used as a carrier generating material, the resulting electrophotographic photoreceptor has no sufficient characteristic stability.

There are also known other phthalocyanine compounds, for example, $\chi$-type metal-free phthalocyanines as disclosed in Japanese Patent Examined Publication No. 4338/1974. As compared with aforesaid $\chi$-type metal-free phthalocyanines, the $\chi$-type metal-free phthalocyanines are easier to produce and have greater crystalline stability and higher potential stability to repeated use in the case where they are used as carrier generating materials in electrophotographic photoreceptors, but still they are found unsatisfactory.

Now, known photoreceptors in which an organic photoconductive material is used are usually employed in negative charging application.

The reason for this is that where such a photoreceptor is used for negative charging, greater hole mobility is available in a carrier, and this fact is advantageous from the standpoint of photosensitivity or the like.

However, it has been found that such use for negative charging involves the following problems. One problem is that ozone is likely to be produced in the atmosphere during the process of negative charging by a charging unit, which leads to deterioration on the ambient conditions. Another problem is that the development of a photoreceptor for negative charging requires a positive polarity toner which is difficult to produce in view of its triboelectric sequence relative to ferromagnetic carrier particles.

As such, it has been proposed to use for positive charging a photoreceptor in which an organic photoconductive material is used. For example, there has been suggested a positive-charging type photoreceptor including a carrier generating layer and a carrier transporting layer placed thereon which is formed on a material having high electron transporting capability. The trouble with this photoreceptor is that the carrier transporting layer contains trinitrofluorenone or the like, such a material is carcinogenic. Whilst, it may be conceivable that a positive-charging type photoreceptor comprises a carrier transporting layer having high hole transport capability and a carrier generating layer placed thereon. Such layer arrangement is not suitable for practical purposes because a very thin carrier generating layer is present on the top side, which means lack in abrasion resistance.

In U.S. Pat. No. 3,615,411 there is disclosed a positive-charging type photoreceptor in which thiapyrilium salt (a carrier generating material) is used in such a way that it can form a eutectic complex in conjunction with polycarbonate (a binder resin). However, this photoreceptor has a drawback that it is liable to excessive memory effect and ghost image formation. The specification of U.S. Pat. No. 8,357,989 discloses a photoreceptor containing phthalocyanine. This photoreceptor has difficulties in that phthalocyanine is liable to characteristic changes depending upon its crystal form and must be strictly controlled with respect to its crystal form, and in that phthalocyanine does not provide any good sensitivity to light rays of short wavelength and is a cause of excessive memory phenomena. Therefore, it is unsuitable for use in copying machines in which light rays in a visible light wavelength range are used as a light source.

For aforesaid reasons it has been considered to be unrealistic to employ for positive charging any photoreceptor in which an organic photoconductive material is used, and hence such photoreceptor has been employed exclusively for negative charging.

The primary object of the present invention is to provide a photoreceptor which has sufficient sensitivity to light rays in a comparatively long wavelength range, such as semiconductor laser beams, and which is operable under positive charging and, in particular, less liable to ozone generation and superior in various performance qualities, such as abrasion resistance, potential stability, and memory and residual potential characteristics.

DISCLOSURE OF THE INVENTION

Accordingly, the invention relates to a photoreceptor including a carrier transporting layer containing a carrier transporting material and a binder material, and a carrier generating layer containing a carrier generating material and a binder material, the layers being placed one over the other in order of mention, characterized in that the carrier generating layer contains a metal-free phthalocyanine having main peaks of Bragg angles $2\theta$ at least at 7.6 degrees±0.2 degrees, 9.1 degrees±0.2 degrees, 16.7 degrees±0.2 degrees, 17.3 degrees±0.2 degrees, and 22.3 degrees±0.2 degrees in relation to CuK$\alpha$ characteristic X rays (wavelength, 1.541 Å), and in that the carrier generating layer also contains a carrier transporting material.

According to the invention, a function-separated type photoreceptor having a carrier generating layer laid on a carrier transporting layer which is suitable for use under positive charging is provided wherein a metal-free phthalocyanine having said main Bragg angle peaks is used as a carrier generating material, which results in improved potential stability in case of repeated use of the photoreceptor, reduced memory effect, reduced residual potential, and increased crystal form stability of the phthalocyanine itself, with a further advantage that the the photoreceptor is easy to manufacture. In addition, the use of the metal-free phthalocyanine provides high sensitivity to light rays in a long wavelength range, the photoreceptor being thus suitable for use with semiconductor laser units and the like.

The photoreceptor according to the invention has its carrier generating layer disposed on the top side, and therefore it is of positive charge type design. However, by the carrier generating layer being formed relatively thick it is possible to sufficiently overcome the aforesaid difficulty with the prior art in respect of abrasion resistance. For example, the carrier generating layer is formed to a thickness of 0.6 to 10 $\mu$m (preferably 1 to 8 $\mu$m), which thickness is far much greater than a usually conceivable thickness level (which is of the order of 0.2 $\mu$m for a negative charge type), whereby it is possible to provide improved abrasion resistance and even increased sensitivity. Generally, provision of such a thick carrier generating layer will results in a relative decrease in the concentration of the carrier generating material in the carrier generating layer, but it is noted in this connection that according to the invention the carrier generating layer has a carrier transporting material contained therein so that transport capabilities with respect to positive and negative carriers (holes and electrons) generated within the carrier generating layer are increased rather than being decreased. The inclusion of the carrier transporting material in the carrier generating layer makes it possible to provide a layer arrangement which can withstand positive charging (in which the carrier generating layer is formed so thick on the top side). Provided, however, that the carrier transporting material should preferably match the carrier generating material in terms of ionized potential.

In the photoreceptor of the present invention, a particular type of carrier transporting material is included in said "layer", and this fact makes it possible to technically solve aforesaid problems. The term "particular type of carrier transporting material" herein means any of the following compounds, namely, compounds expressed by general formula [I] (triphenylamine compounds), amine derivatives expressed by general formula [I'], compounds expressed by general formula [II] (carbazole derivatives), compounds expressed by general formulas [III], [III'] (hydrazone compounds), compounds expressed by general formula [IV] (hydrazone compounds), compounds expressed by general formula [V] (pyrazoline compounds), and compounds expressed by general formula [VI] (hydrazone compounds).

The reason why such a particular carrier transporting material is selected as mentioned above is that there appears to be a certain pattern of selectivity involved in the injection of carriers from said metal-free phthalocyanine, that is a carrier generating material, into the carrier transporting material within the "layer".

The selection of such carrier transporting material in accordance with the invention permits efficient carrier injection because an ionized potential well matched with the metal-free phthalocyanine of the invention can be obtained, and accordingly mobility of carriers generated within the "layer" can be improved rather than being lowered when the thickness of the "layer" is increased and/or then the concentration of the binder material is increased. Thus, satisfactory performance quality can be constantly assured in respect of sensitivity, residual potential, memory characteristics, and sensitivity and charge potential characteristics in case of repeated use.

The carrier transporting materials of the invention have high hole transport capabilities, and therefore it is possible to obtain a photoreceptor suitable for use under positive charging by inclusion of such material in said "layer".

In said "layer" as a constituent layer of the photoreceptor of the invention, the carrier generating material and the carrier transporting material, both in grain form, should preferably be bound together with a binder material (i.e. dispersed in pigment form in the layer). Then, the abrasion resistance and durability of the "layer" are enhanced, and possible memory phenomena are minimized, good stability being achieved in residual potential. Said "layer" being constructed as above described, the compatibility of the carrier transporting material with the binder material has a bearing on the characteristics of the photosensitive layer. In this respect, however, it is pointed out that the carrier transporting materials of the invention have good compatibility with the binder material.

Where a photoreceptor is used under positive charging, unlike the case in which it is used under negative charging, ozone generation can be limited to a low level, but yet some minor degree of ozone generation is inevitable. However, the charge transporting material of the invention is not liable to deterioration due to ozone adsorption; therefore, lack of image sharpness and other image defects are unlikely to occur with the photoreceptor of the invention.

Furthermore, the charge transport material of the invention is non-hazardous, environmentally preferable, and chemically stable.

The carrier transporting materials which can be especially preferably used are compounds expressed by general formulas [I], [I'], [II], [III], and [III'].

As stated above, according to the invention it is possible to provide a photoreceptor suitable for use under positive charging. The photoreceptor of the invention exhibits various characteristic performance features expected on a positive-charge type photoreceptor and can solve such problems involved in negative charging as described with respect to the prior art. That is, ozone generation can be minimized for furtherance of improved environmental conditions, and accordingly problems such as discharge irregularities due to discharge electrode staining can be prevented. Another advantage is that toners of negative polarity which are easy to manufacture can be used. The photoreceptor, being of the function divided type, is highly sensitive, highly durable, and facilitates selection of material for its construction.

According to the invention, aforesaid metal-free phthalocyanine has, for example, such an X-ray diffraction spectrum as illustrated in FIG. 1. As shown, the metal-free phthalocyanine has Bragg angle peaks (with tolerance of $2\theta \pm 0.2$ degrees) at 7.5, 9.1, 16.7, 17.3, and 22.8 degrees in relation to CuK$\alpha$ (1.541 Å) X-ray. At Bragg angle of 22.8 degrees, it has a unique peak which cannot be seen with a $\tau$-type metal-free phthalocyanines. Also, as can be characteristically seen from FIG. 1, an infrared absorption spectrum of said metal-free phthalocyanine shows three peaks at 746 $cm^{-1}$ and $700^{-1}$ to 760 $cm^{-1}$, and peaks of equal intensity at 1318 $cm^{-1}$ and 1330 $cm^{-1}$.

According to the invention, it is possible to use a metal-free phthalocyanine having such an X-ray diffraction spectrum as shown in FIG. 3 in which there are main Bragg angle 2 (with tolerance, $2\theta \pm 0.2$ degrees) at 7.7, 9.3, 16.9, 17.5, 22.4, and 28.8 degrees in relation to CuK$\alpha$ (1.541 Å) X-rays, and in which the ratio of peak intensity at Bragg angle of 16.9 degrees to peak intensity at Bragg angle of 9.3 degrees is 0.8–1.0 and respective peak intensity ratios at Bragg angles of 22.4 and 28.8 degrees to the peak intensity at said Bragg angle of 9.3 degrees are more than 0.4. This phthalocyanine, as compared with the one illustrated in FIG. 1, has a characteristic peak at Bragg angle of 28.8 degrees.

As is apparent from FIG. 3, this phthalocyanine is different from the $\tau$-type metal-free phthalocyanine shown in FIG. 10 in that while said $\tau$-type has a peak intensity ratio of 0.9–1.0 for peak at Bragg angle of 16.9 degrees to peak at Bragg angle of 9.2 degrees which corresponds to said former peak intensity ratio, it has no Bragg angle comparable to Bragg angles of 22.4 and 28.8 degrees and, therefore, no peak intensity ratio corresponding to said latter peak intensity ratio. The phthalocyanine is also different from the metal-free phthalocyanine shown in FIG. 1 in that while the phthalocyanine of FIG. 1 has a peak intensity ratio of 0.4–0.6 for peak at Bragg angle of 16.7 degrees to peak at Bragg angle of 9.1 degrees which corresponds to said former intensity ratio, it has no Bragg angle comparable to Bragg angle of 28.8 degrees, it has no peak intensity ratio corresponding to said latter peak intensity ratio.

The metal-free phthalocyanine in FIG. 3 shows such an infrared absorption spectrum as illustrated in which there are preferably four absorption bands in the wave range of 700–760 $cm^{-1}$ with absorption maximum at $720\pm2$ $cm^{-1}$, and characteristic absorption bands at $1320\pm2$ $cm^{-1}$ and $3288\pm3$ $cm^{-1}$ In this respect, the phthalocyanine in FIG. 3 is different from the $\tau$-type metal-free phthalocyanine which, as already mentioned, has four absorption bands in the wave range of 700–760 $cm^{-1}$ with absorption maximum at $752\pm2$ $cm^{-1}$, and two absorption bands, not one, in the wave range of 1320–1340 $cm^{-1}$. This metal-free phthalocyanine is different from the metal-free phthalocyanine of FIG. 1 in respect of peak intensity ratio in the wave range of 700–760 $cm^{-1}$, and also in that it has no absorption band at 1330 $cm^{-1}$ and has a characteristic absorption band at $3288\pm3$ $cm^{-1}$.

The metal-free phthalocyanine in FIG. 3, in its visible and near infrared absorption spectrum, should preferably have an absorption maximum in a region of 770 nm to less than 790 nm as illustrated by solid line in FIG. 5, being different from $\tau$-type metal-free phthalocyanines which, as shown by broken line in FIG. 6, have an absorption maximum in a region of 790–820, and in most case at approximately 810 nm.

To prepare aforesaid metal-free phthalocyanine according to the invention, an $\alpha$-type metal-free phthalocyanine is agitated for a period of time sufficient to allow crystal transformation thereof or subjected to milling under mechanical distortion force (e.g. kneading), whereby the metal-free phthalocyanine of FIG. 1 is obtained. Then, this metal-free phthalocyanine is subjected to solvent treatment, for example, dispersion in a non-polar solvent, such as tetrahydrofuran, thereby the metal-free phthalocyanine of FIG. 8 is obtained. For the purpose of agitating, or milling through mixing, dispersion media commonly employed in dispersing, emulsifying, or mixing pigments, such as glass beads, steel beads, alumina balls, and flint pebbles, are used. It is noted, however, such dispersion media are not always needed. Attriting assistants may be used which are commonly used for pigments. For use as such attriting assistants, sodium chloride, sodium bicarbonate, and Glauber's salt may be mentioned, for example. Such attriting assistants are not always needed, however.

Where a solvent is required in connection with agitating, mixing, and attriting operation, the solvent is preferably in liquid form at temperatures at which such operation is carried out. For this purpose, it is preferable to use more than one kind of solvent selected from the group consisting of alcohol-based solvents, such as glycerin, ethylene glycol, ethylene glycol, diethylene glycol, polyethylene glycol-based solvents, Cellosolve solvents, such as ethylene glycol monomethylether and ethylene glycol monoethylether, ketone-based solvents, and esterketone-based solvents.

Typical of the apparatuses employed in the process of aforesaid crystal transformation are general agitating machines, such as homomixer, disperser, agitator, stirrer, kneader, Banbury mixer, ball mill, sand mill, attritor.

The metal-free-phthalocynines of the invention which are produced in manner as above described are advantageous in that since the method of manufacturing same does not necessarily require attriting assistants, the phthalocyanines can be so designed that no removal of such assistant is required, and in that the phthalocyanines need not be placed under strict temperature control and can be easily controlled at, for example, room temperature. In these respects, the phthalocyanines according to the invention are different from $\tau$-type phthalocyanines which are such that the process for manufacturing of same requires attriting assistants and which require strict temperature control.

Furthermore, the metal-free phthalocyanines according to the invention have a very stable crystal form and are not liable to transformation into other crystal forms even when they are immersed in organic solvents, such as acetone, tetrahydrofuran, toluene, ethyl acetate, and 1,2-dichloroethane, or when they are subjected to heat tests, for example, by being allowed to stand at an atmosphere of 200° C. for more than 50 hours, or when they are subjected to any mechanical distortional force as in milling, for example, in which respect they have a definite advantage over the conventional $\tau$-type phthalocyanines (in which respect the phthalocyanine of FIG. 3 is especially advantageous). This makes it possible that the metal-free phthalocyanines of the invention are produced with reduced quality variation, and facilitates the manufacture thereof: and in addition, it results in improved performance characteristics, such as potential stability in case of repeated use of a photoreceptor in which any of said phthalocyanines is used.

The metal-free phthalocyanines which are used in the present invention are represented by the following structural formula, and based on thermodynamic status, they are categorized into two types, namely, those in FIG. 1 and those in FIG. 3.

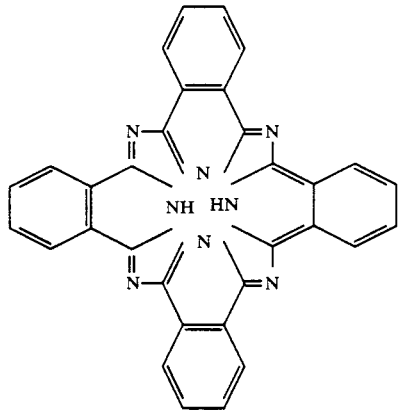

Other carrier generating materials may be used in combination with such a metal-free phthalocyanines. Among such other useful carrier generating materials are, for example, metal-free phthalocyanines of the $\alpha$-type, the $\beta$-type, the $\gamma$-type, the $\tau$-type, the $\tau'$-type, the $\eta$-type, and the $\eta'$-type. In addition, phthalocyanine pigments other then mentioned above, azo pigments, anthraquinone pigments, perylene pigments, polycyclic quinone pigments, and methine stearate pigments are available.

As examples of azo pigments the following are mentioned.

(A-1)

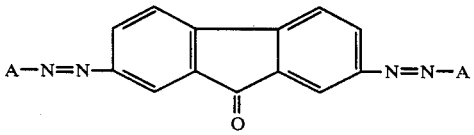

(A-2)

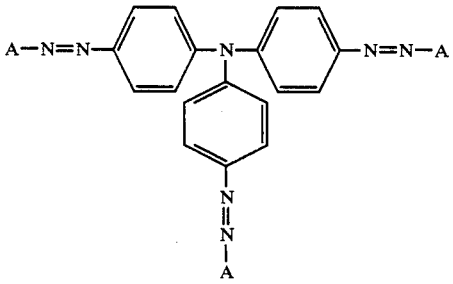

(A-3)

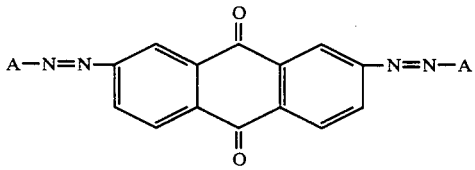

(A-4)

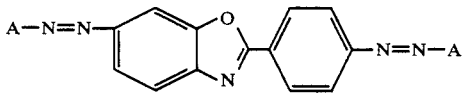

$$A-N=N-Ar^1-CH=CH-Ar^2-N=N-A \quad \text{(A-5)}$$

$$A-N=N-Ar^1-CH=CH-Ar^2-CH=CH-Ar^3-N=N-A \quad \text{(A-6)}$$

(A-7)

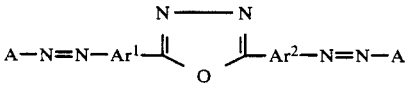

$$A-N=N-Ar^1-N=N-Ar^2-N=N-A \quad \text{(A-8)}$$

$$A-N=N-Ar^1-N=N-Ar^2-N=N-Ar^3-N=N-A \quad \text{(A-9)}$$

$$A-N=N-Ar^1-\overset{R^1}{\underset{|}{C}}=\overset{R^2}{\underset{|}{C}}-Ar^2-N=N-A \quad \text{(A-10)}$$

$$A-N=N-Ar^1-\overset{R^1}{\underset{|}{C}}=\overset{R^2}{\underset{|}{C}}-Ar^2-\overset{R^3}{\underset{|}{C}}=\overset{R^4}{\underset{|}{C}}-Ar^3-N=N-A \quad \text{(A-11)}$$

(A-12)

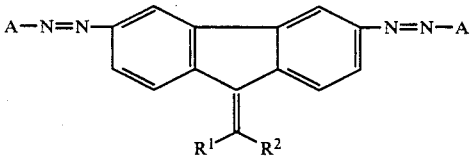

[In the above formulas, $Ar^1$, $Ar^2$, and $Ar^3$:

substituted or unsubstituted carbocyclic aromatic groups;

$R^1$, $R^2$, $R^3$, and $R^4$:

electron attractive groups or hydrogen atoms, at least one of $R^1$–$R^4$ being an electron attractive group, such as a cyano group:

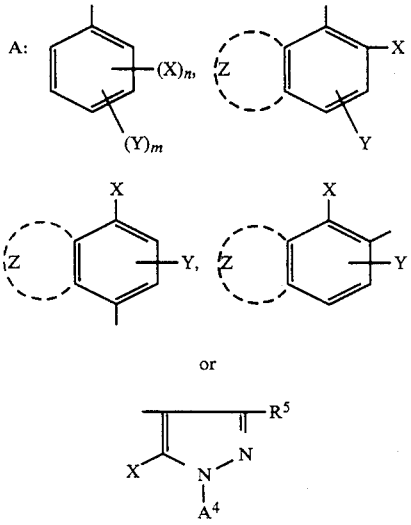

(X is a hydroxy group,

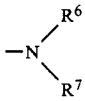

<in which $R^6$ and $R^7$ represent hydrogen atoms, or substituted or unsubstituted alkyl groups; $R^8$ represents a substituted or unsubstituted alkyl group, or substituted or unsubstituted aryl group>

Y: represents a hydrogen or halogen atom, a substituted or unsubstituted alkyl, alkoxy, carboxyl, or sulfo group, or a substituted or unsubstituted carbamoyl group, or a substituted or unsubstituted sulfamoyl group (provided that where m is not less than 2, they may be different groups);

Z: represents a group of atoms necessary for forming a substituted or unsubstituted carbocyclic aromatic ring or a substituted or unsubstituted heterocyclic aromatic ring;

$R^5$: represents a hydrogen atom, or a substituted or unsubstituted amino group, or a substituted or unsubstituted carbamoyl group, carboxyl group, or ester group thereof;

$A^4$: represents a substituted or unsubstituted aryl group;

n: represents an integer of 1 or 2;

m: represents an integer of 0–4.)]

Polycyclic quinone pigments of the following general formula [A-II] group can be also used as carrier generating materials.

General formula [A-III]

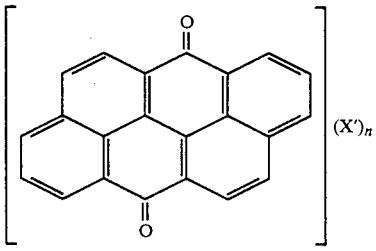

-continued

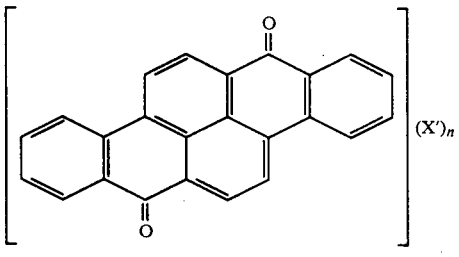

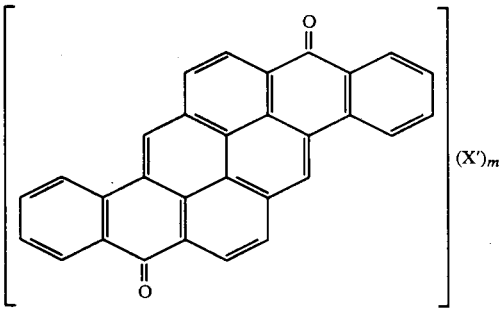

(in which X' represents a halogen atom, a nitro group, a cyano group, an acryl group, or a carboxyl group; n represents an integer of 0–4, and m represents an integer of 0–6.)

In order to form a photosensitive layer for an electrophotographic photoreceptor according to the invention, as FIG. 6 shows by way of example, a carrier transporting layer 3 having aforesaid carrier transporting material dispersed in a binder is formed on a photoconductive support 1, and then a carrier generating layer 2 having said carrier generating material and the carrier transporting material dispersed in a binder is formed on the carrier transporting layer 3, whereby a photosensitive layer 4 is formed. In FIG. 7, an intermediate layer 5 is provided between a photosensitive layer 4 of same construction as the one shown in FIG. 6 and the photoconductive support 1 so that injection of free electrons from the photoconductive layer 1 into the photosensitive layer 4 can be effectively prevented. The intermediate layer 5 may be formed on a high polymeric material of the type described earlier as a binder resin, organic polymeric materials, such as polyvinyl alcohol, ethyl cellulose, and carboxy methyl cellulose, or aluminum oxide.

In FIGS. 6 and 7, a protection layer (film) may be formed on the outer surface in order to provide improved abrasion resistance. For example, the surface may be covered with a synthetic resin film by coating.

For the purpose of forming a photosensitive layer of the above described construction, the carrier generating layer 2 may be provided according to the following methods:

(a) coating a solution prepared by dissolving the carrier generating material in a suitable solvent, or a solution prepared from said solution by incorporating a binder thereinto;

(b) coating a dispersion prepared by finely dispersing the carrier generating material in a dispersion medium by a hall mill, a homomixer, or the like, and if required, mixing a binder thereinto.

In these methods, uniform dispersion can be obtained by allowing particles to be dispersed under the action of an ultrasonic force.

For the solvents or dispersion media which can be used for the formation of a carrier generating layer, the following may be mentioned by way of example: n-butylamine, diethylamine, ethylenediamine, isopropanolamine, triethanolamine, triethylene-diamine, N, N-diethyl formamide, acetone, methyl ethyl ketone, cyclohexanone, benzene, toluene, xylene, chloroform, 1,2-dichloroethane, dichloromethane, tetrahydrofuran, dioxane, methanol, ethanol, isopropanol, ethyl acetate, butyl acetate, and dimethyl sulfoxide.

Where a binder is used for the purpose of forming a carrier generating layer or a carrier transporting layer, any desired binder may be used, but for this purpose a high polymeric material having hydrophobic nature, high dielectric constant, and electrical insulating film forming ability is preferred. As examples of such polymeric material the following are mentioned without limitation thereto:

(a) polycarbonate;
(b) polyester;
(c) methacrylate resin;
(d) acrylic resin;
(e) polyvinyl chloride;
(f) polyvinylidene chloride;
(g) polystyrene;
(h) polyvinyl acetate;
(i) styrene-butadiene copolymer;
(j) vinylidene chloride-acrylonitrile copolymer;
(k) vinyl chloride-vinyl acetate copolymer;
(l) vinyl chloride-vinyl acetate-maleic anhydride copolymer;
(m) silicon resin;
(n) silicon-alkyd resin;
(o) phenol-formaldehyde resin
(p) styrene-alkyd resin;
(q) poly-N-vinyl carbazole
(r) polyvinyl butyral;

These binders may be used alone or in a combination of two or more kinds.

For the carrier transporting materials which can be used in the invention, the following may be mentioned.

A photoreceptor comprising at least either a compound expressed by the following general formula [I] or a compound expressed by the following general formula [I'] is preferably used.

General Formula [I]:

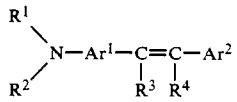

in which $R^1$ and $R^2$: represent substituted or unsubstituted alkyl or aryl groups; for a substituent group, an alkyl, an alkoxy, a substituted amino, or a hydroxyl group, a halogen atom, or an aryl group is used;

$Ar^1$ and $Ar^2$: represent substituted or unsubstituted aryl groups; for a substituent group, a halogen atom, or a hydroxy, an alkyl, an alkoxy, a substituted amino, or an aryl group is used;

$R^3$ and $R^4$: represent substituted or unsubstituted aryl groups, or hydrogen atoms; for a substituent group, a halogen atom, a hydroxy, an alkyl, an alkoxy, a substituted amino, or an aryl group is used.]

General formula [I']:

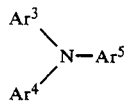

[in which $Ar^3$ and $Ar^4$: represent substituted or unsubstituted phenyl group; for a substituent group, a halogen atom, or an alkyl, a nitro, or an alkoxy group is used.

$Ar^5$: represent substituted or unsubstituted phenyl, naphthyl, anthryl, fluorenyl, or heterocyclic groups, for a substituent group, an alkyl or an alkoxy group, a halogen atom, a hydroxyl, an aryloxy, an aryl, an amino, a nitro, a piperidino, a morpholino, a naphthyl, an anthryl, or a substituted amino group is used. Provided that an acyl, an alkyl, an aryl, or an aralkyl group is used as a substituent for a substituted amino group.)

Nextly, to illustrate the styryl compounds expressed by the foregoing general formula [I] which can be used as carrier transporting materials in the present invention, those having the following structural formula may be mentioned by way of example, but needless to say the useful styryl compounds are not limited to those shown.

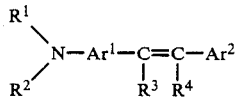

| Compound No. | $-R^1$ | $-R^2$ | $-R^3$ | $-R^4$ | $-Ar^1$ | $-Ar^2$ |
|---|---|---|---|---|---|---|
| I-1 | 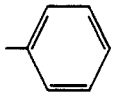 | 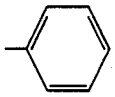 | $-H$ | 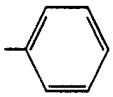 | 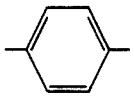 | 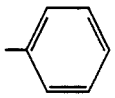 |
| I-2 | 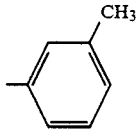 | " | " | " | " | 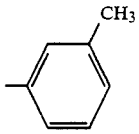 |
| I-3 | 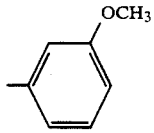 | " | " | " | " | 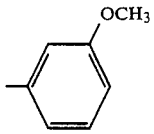 |
| I-4 | $-CH_3$ | $-CH_3$ | " | $-H$ | " | 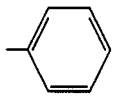 |
| I-5 | $-C_2H_5$ | $-C_2H_5$ | " | " | " | " |
| I-6 | " | " | " | " | " | 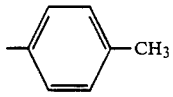 |
| I-7 | " | " | " | " | " | 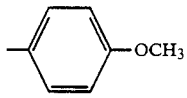 |
| I-8 | 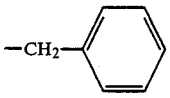 | 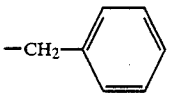 | " | " | " | 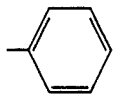 |
| I-9 | 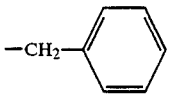 | 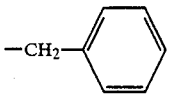 | $-H$ | 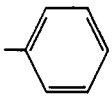 | 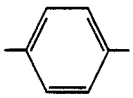 | 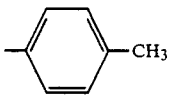 |

-continued
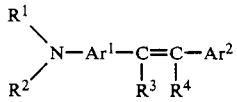
| Compound No. | $-R^1$ | $-R^2$ | $-R^3$ | $-R^4$ | $-Ar^1$ | $-Ar^2$ |
|---|---|---|---|---|---|---|
| I-10 | " | " | " | " | " | 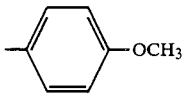 |
| I-11 | " | " | $-H$ | $-H$ | 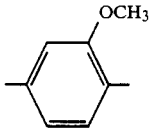 | 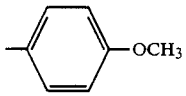 |
| I-12 | $-C_2H_5$ | " | " | " | 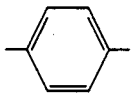 | " |
| I-13 | 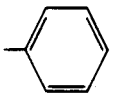 | 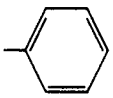 | " | " | " | 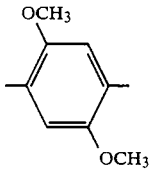 |
| I-14 | " | " | " | " | " | 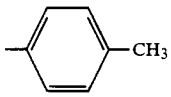 |
| I-15 | " | " | " | " | " | 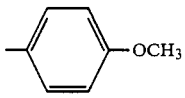 |
| I-16 | " | " | " | " | " | 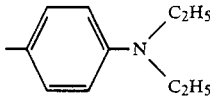 |
| I-17 | " | " | " | " | " | 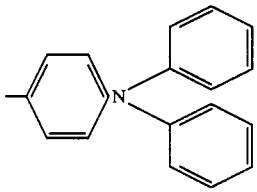 |
| I-18 | " | " | " | " | 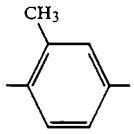 | 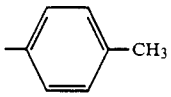 |
| I-19 | 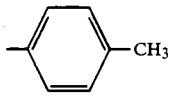 | 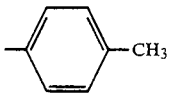 | $-H$ | $-H$ | 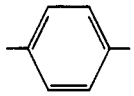 | 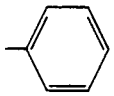 |

-continued
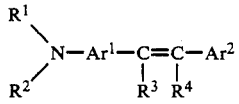
| Compound No. | $-R^1$ | $-R^2$ | $-R^3$ | $-R^4$ | $-Ar^1$ | $-Ar^2$ |
|---|---|---|---|---|---|---|
| I-20 | " | " | " | " | " | 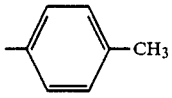 |
| I-21 | " | " | $-H$ | $-H$ | 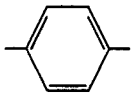 | 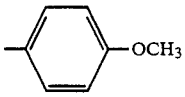 |
| I-22 | " | " | $-H$ | $-H$ | 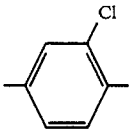 | 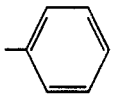 |
| I-23 | " | " | " | " | 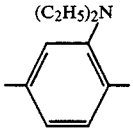 | 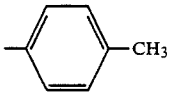 |
| I-24 | 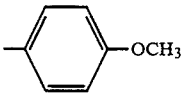 | 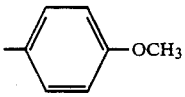 | " | " | 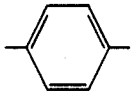 | 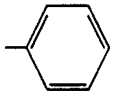 |
| I-25 | " | " | " | " | " | 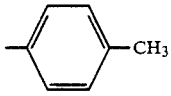 |
| I-26 | " | " | " | " | " | 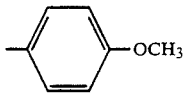 |
| I-27 | " | " | " | " | 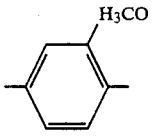 | 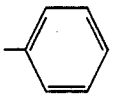 |
| I-28 | $-C_2H_5$ | $-C_2H_5$ | " | " | 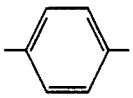 | 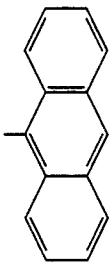 |

-continued
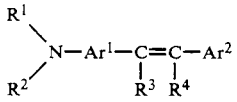
| Compound No. | $-R^1$ | $-R^2$ | $-R^3$ | $-R^4$ | $-Ar^1$ | $-Ar^2$ |
|---|---|---|---|---|---|---|
| I-29 | 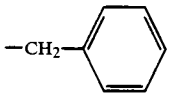 | 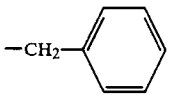 | −H | −H | 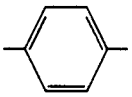 | 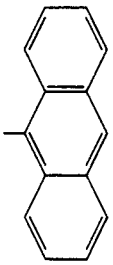 |
| I-30 | " | " | " | " | 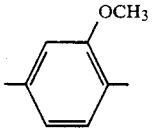 | " |
| I-31 | 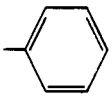 | 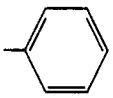 | " | " | 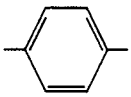 | 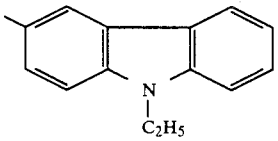 |
| I-32 | " | " | " | " | 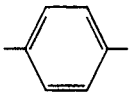 | 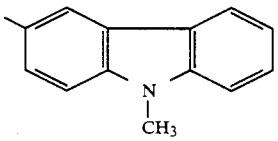 |
| I-33 | 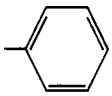 | 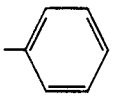 | −H | −H | 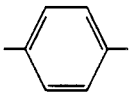 | 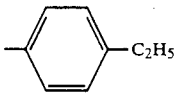 |
| I-34 | " | " | " | " | " | 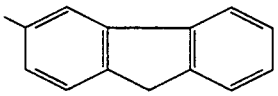 |
| I-35 | 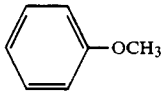 | " | " | " | " | 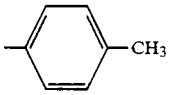 |
| I-36 | " | " | " | " | " | 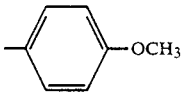 |
| I-37 | 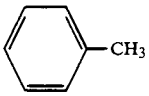 | " | " | " | " | " |
| I-38 | 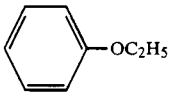 | " | " | " | " | 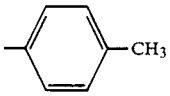 |

-continued
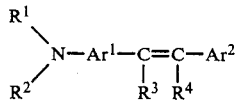
| Compound No. | $-R^1$ | $-R^2$ | $-R^3$ | $-R^4$ | $-Ar^1$ | $-Ar^2$ |
|---|---|---|---|---|---|---|
| I-39 | 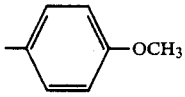 | 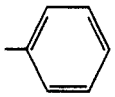 | —H | —H | 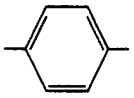 | 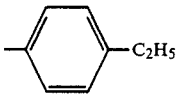 |
| I-40 | " | " | " | " | " | 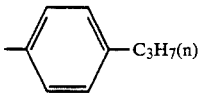 |
| I-41 | " | " | " | " | " | 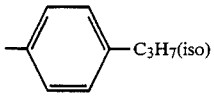 |
| I-42 | " | " | " | " | " | 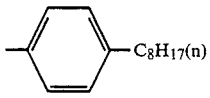 |
| I-43 | " | " | " | " | " | 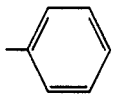 |
| I-44 | " | " | " | " | " | 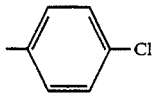 |
| I-45 | " | " | " | " | " | 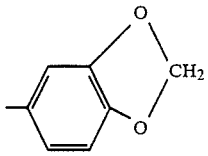 |
| I-46 | " | " | " | " | " | 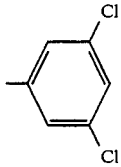 |
| I-47 | " | " | " | " | " | 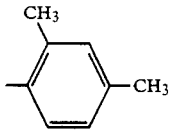 |
| I-48 | " | " | " | " | " | 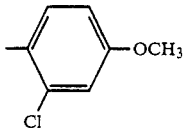 |

-continued
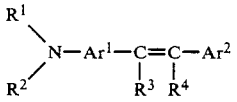
| Compound No. | $-R^1$ | $-R^2$ | $-R^3$ | $-R^4$ | $-Ar^1$ | $-Ar^2$ |
|---|---|---|---|---|---|---|
| I-49 | 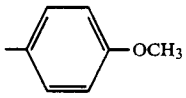 | 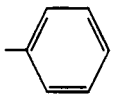 | $-H$ | $-H$ | 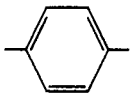 | 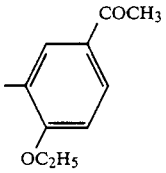 |
| I-50 | " | " | " | " | " | 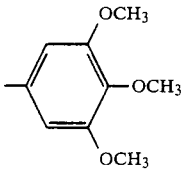 |
| I-51 | " | " | " | " | " | 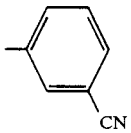 |
| I-52 | " | " | " | " | " | 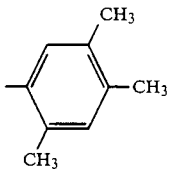 |
| I-53 | " | " | " | " | " | 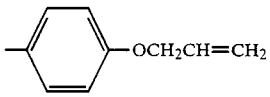 |
| I-54 | 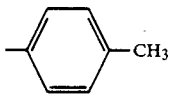 | " | " | " | " | 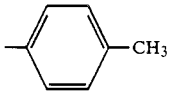 |
| I-55 | " | " | " | " | " | 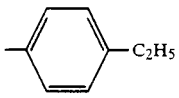 |
| I-56 | " | " | " | " | " | 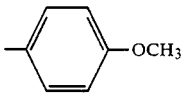 |
| I-57 | " | " | " | " | " | 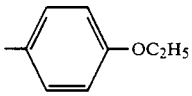 |
| I-58 | " | " | " | " | " | 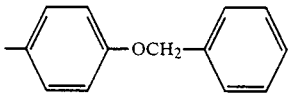 |

-continued
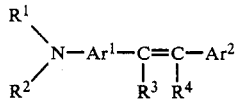
| Compound No. | —R¹ | —R² | —R³ | —R⁴ | —Ar¹ | —Ar² |
|---|---|---|---|---|---|---|
| I-59 | 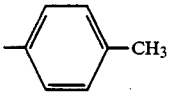 | 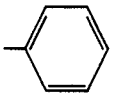 | —H | —H | 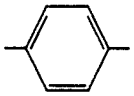 | 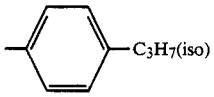 |
| I-60 | " | " | " | " | " | 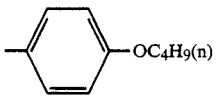 |
| I-61 | " | " | " | " | " | 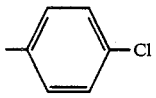 |
| I-62 | " | " | " | " | " | 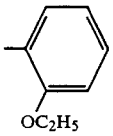 |
| I-63 | " | " | " | " | " | 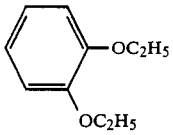 |
| I-64 | " | " | " | " | " | 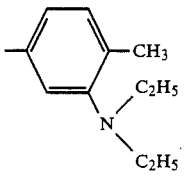 |
| I-65 | " | " | " | " | " | 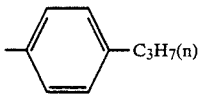 |
| I-66 | 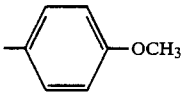 | 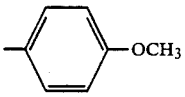 | —H | —H | " | 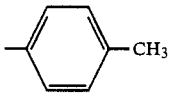 |
| I-67 | —H | 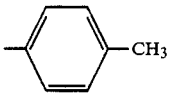 | " | " | " | 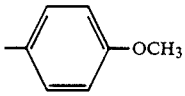 |
| I-68 | " | " | " | " | " | 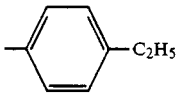 |
| I-69 | 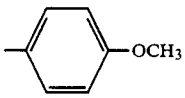 | 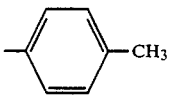 | H | H | 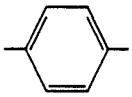 | 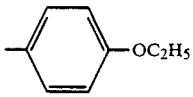 |

-continued
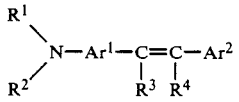
| Compound No. | $-R^1$ | $-R^2$ | $-R^3$ | $-R^4$ | $-Ar^1$ | $-Ar^2$ |
|---|---|---|---|---|---|---|
| I-70 | " | " | " | " | " | 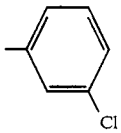 |
| I-71 | " | " | " | " | " | 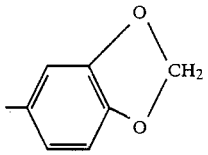 |
| I-72 | " | " | " | " | 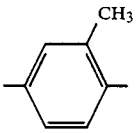 | 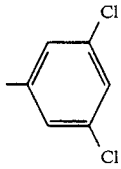 |
| I-73 | " | " | " | " | 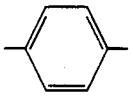 | 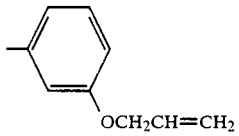 |
| I-74 | 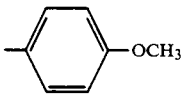 | 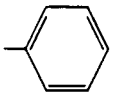 | " | " | " | 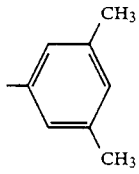 |
| I-75 | 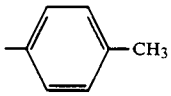 | " | " | " | " | " |
| I-76 | 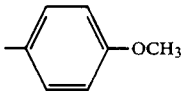 | 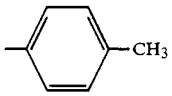 | " | " | " | " |
| I-77 | 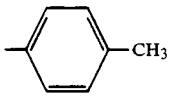 | 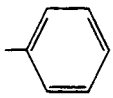 | $-H$ | $-H$ | " | 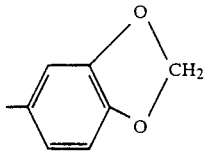 |
| I-78 | 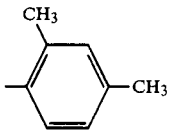 | " | $-CH_3$ | " | " | 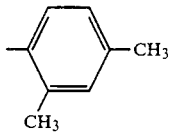 |

-continued

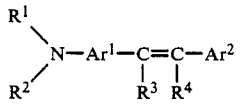

| Compound No. | $-R^1$ | $-R^2$ | $-R^3$ | $-R^4$ | $-Ar^1$ | $-Ar^2$ |
|---|---|---|---|---|---|---|
| I-79 | 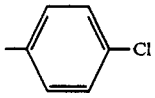 | 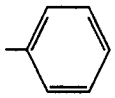 | $-CH_3$ | $-H$ | 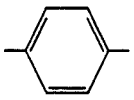 | 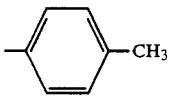 |
| I-80 | 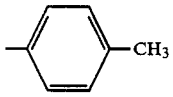 | 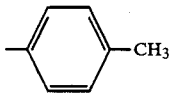 | $-H$ | $-CH_3$ | " | 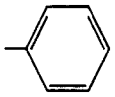 |
| I-81 | 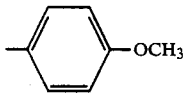 | 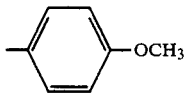 | " | " | " | 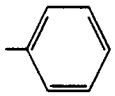 |

Again, to illustrate the amine derivatives expressed by the foregoing general formula [I'] which can be used as carrier transporting materials in the present invention, those having following structural formula may be mentioned by way of example, but needless to say the useful amine derivatives are not limited to those shown:

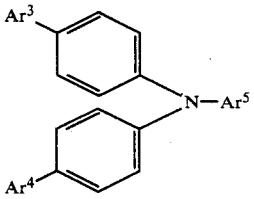

| Compound No. | $-Ar^3$ | $-Ar^4$ | $-Ar^5$ |
|---|---|---|---|
| I'-1 | $-H$ | $-H$ | 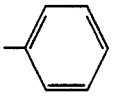 |
| I'-2 | " | " | 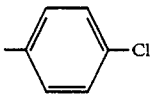 |
| I'-3 | $-Br$ | $-Br$ | 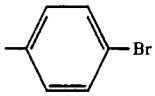 |
| I'-4 | $-H$ | $-H$ | 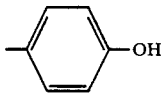 |
| I'-5 | " | " | 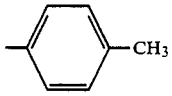 |

-continued

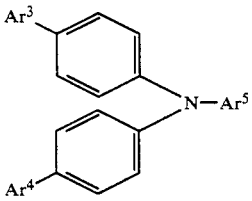

| Compound No. | $-Ar^3$ | $-Ar^4$ | $-Ar^5$ |
|---|---|---|---|
| I'-6 | " | " | 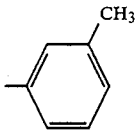 |
| I'-7 | " | " | 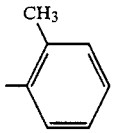 |
| I'-8 | $-CH_3$ | $-H$ | 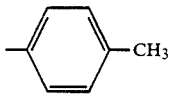 |
| I'-9 | " | $-CH_3$ | " |
| I'-10 | $-H$ | $-H$ | 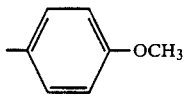 |
| I'-11 | $-H$ | $-H$ | 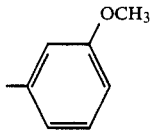 |

-continued
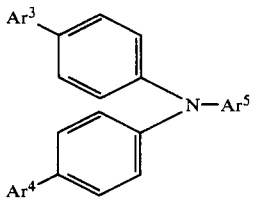
| Compound No. | $-Ar^3$ | $-Ar^4$ | $-Ar^5$ |
|---|---|---|---|
| I'-12 | " | " | 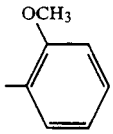 |
| I'-13 | $-OCH_3$ | " | 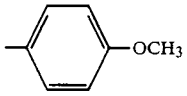 |
| I'-14 | " | $-OCH_3$ | " |
| I'-15 | $-CH_3$ | $-H$ | " |
| I'-16 | $-H$ | " | 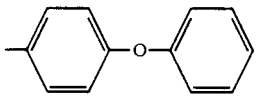 |
| I'-17 | " | " | 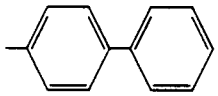 |
| I'-18 | " | " | 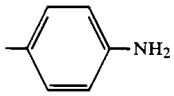 |
| I'-19 | " | " | 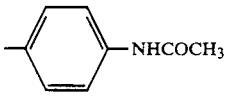 |
| I'-20 | $-H$ | $-H$ | 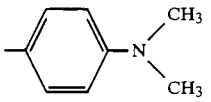 |
| I'-21 | $-H$ | $-H$ | 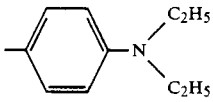 |
| I'-22 | " | " | 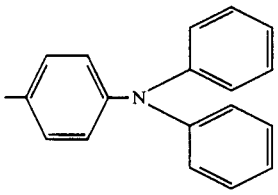 |
-continued
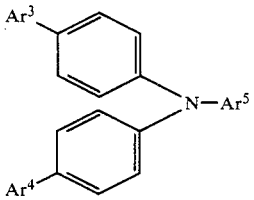
| Compound No. | $-Ar^3$ | $-Ar^4$ | $-Ar^5$ |
|---|---|---|---|
| I'-23 | " | " | 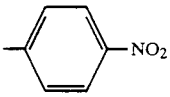 |
| I'-24 | $-NO_2$ | " | 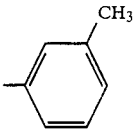 |
| I'-25 | $-H$ | " | 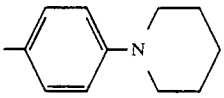 |
| I'-26 | " | " | 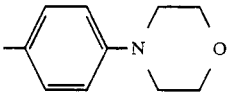 |
| I'-27 | " | " | 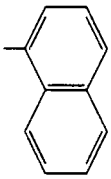 |
| I'-28 | $-CH_3$ | $-CH_3$ | " |
| I'-29 | $-H$ | $-H$ | 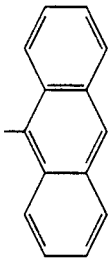 |
| I'-30 | $-CH_3$ | $-CH_3$ | 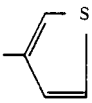 |
| I'-31 | $-H$ | $-H$ | 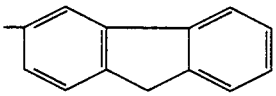 |
| I'-32 | $-CH_3$ | $-CH_3$ | 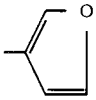 |

-continued

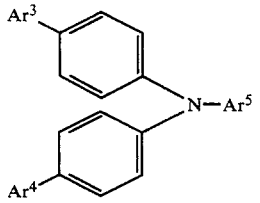

| Compound No. | —Ar3 | —Ar4 | —Ar5 |
|---|---|---|---|
| I'-33 | —H | —H | 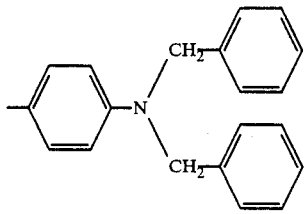 |

In the invention, a photoreceptor comprising a compound expressed by the following general formula [II] is preferably used.

General formula [II]:

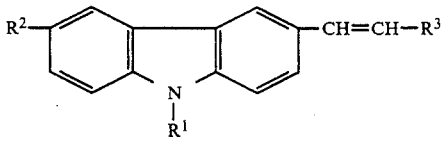

(in which $R^1$: represents a substituted or unsubstituted aryl group;

$R^2$: represents a hydrogen or halogen atom, a substituted or unsubstituted alkyl, alkoxy, or amino group, or a substituted amino group, or a hydroxyl group; and $R^3$: represents a substituted or unsubstituted aryl group, or a substituted or unsubstituted heterocyclic group.)

Nextly, to illustrate the carbazole derivatives expressed by the foregoing general formula [II] which can be used as carrier transporting materials in the present invention, those having the following structural formula may be mentioned by way of example, but needless to say the useful carbazole derivatives are not limited to those shown.

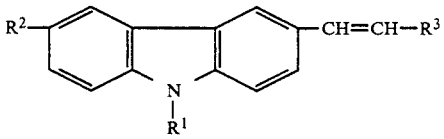

| Compound No. | —R2 | —R1 | —R3 |
|---|---|---|---|
| II-1 | —H | 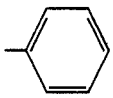 | 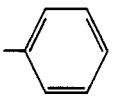 |
| II-2 | " | " | 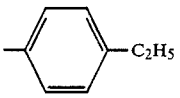 |
| II-3 | " | " | 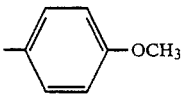 |
| II-4 | " | " | 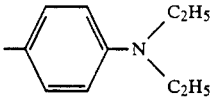 |
| II-5 | " | " | 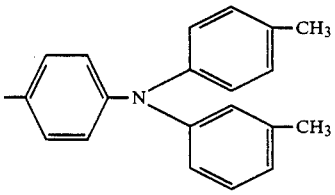 |

-continued
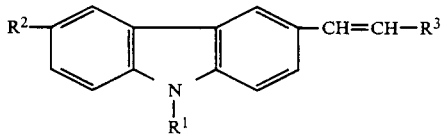
| Compound No. | —R2 | —R1 | —R3 |
|---|---|---|---|
| II-6 | " | 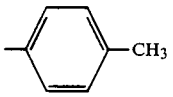  | 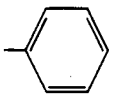 |
| II-7 | " | " | 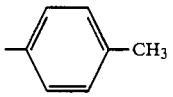  |
| II-8 | " | " | 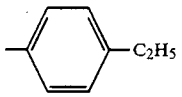  |
| II-9 | " | " | 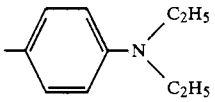  |
| II-10 | " | " | 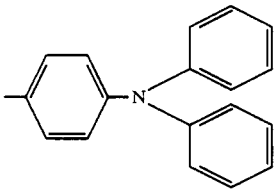  |
| II-11 | " | 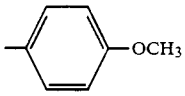  | 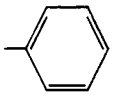 |
| II-12 | " | " | 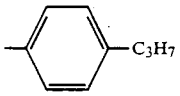  |
| II-13 | " | 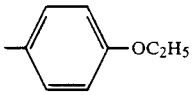  | 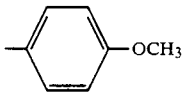  |
| II-14 | " | 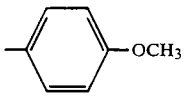  | 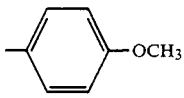  |
| II-15 | —H | 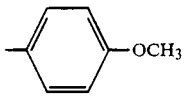  | 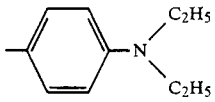  |

-continued
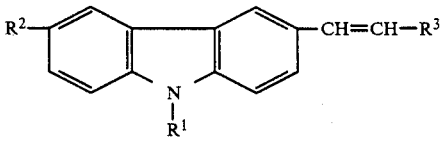
| Compound No. | $-R^2$ | $-R^1$ | $-R^3$ |
|---|---|---|---|
| II-16 | " | " | 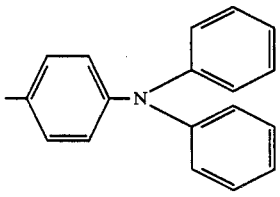 |
| II-17 | " | 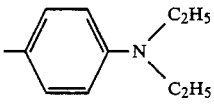 | 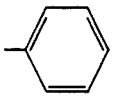 |
| II-18 | " | " | 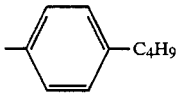 |
| II-19 | " | 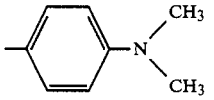 | 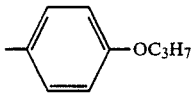 |
| II-20 | " | 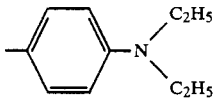 | 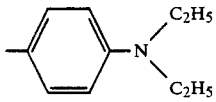 |
| II-21 | " | 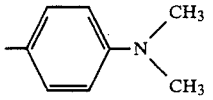 | 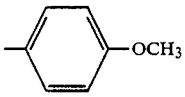 |
| II-22 | $-Cl$ | 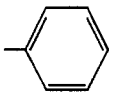 | 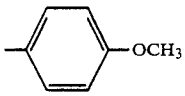 |
| II-23 | $-OCH_3$ | 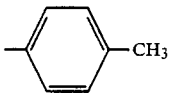 | 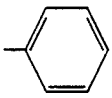 |
| II-24 | $-OH$ | 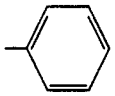 | 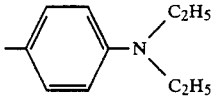 |
| II-25 | 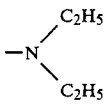 | 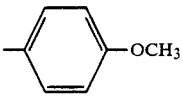 | 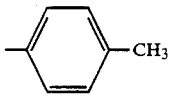 |

-continued
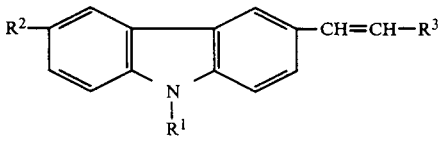
| Compound No. | —R2 | —R1 | —R3 |
|---|---|---|---|
| II-26 | —H | 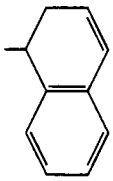 | 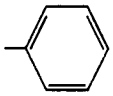 |
| II-27 | " | 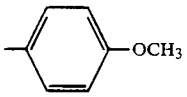  | 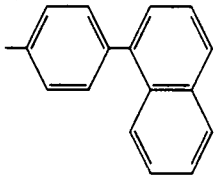 |
| II-28 | " | 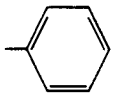 | 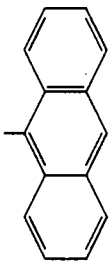 |
| II-29 | " | " | 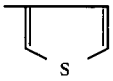  |
| II-30 | " | 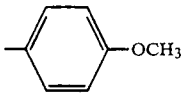  | 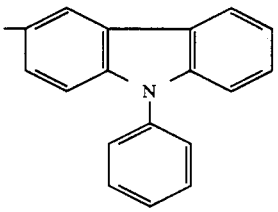  |
| II-31 | —OCH3 | 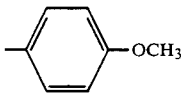  | 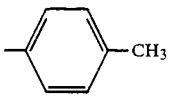  |
| II-32 | " | 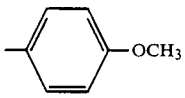  | 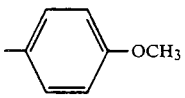  |

-continued

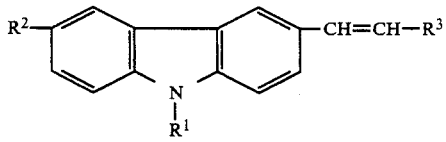

| Compound No. | $-R^2$ | $-R^1$ | $-R^3$ |
|---|---|---|---|
| II-33 | " | " | 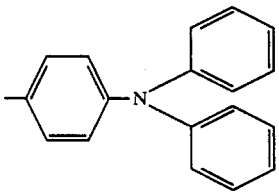 |

Further in the present invention, a photoreceptor comprising at least either a compound expressed by the following general formula [III] or a compound expressed by the following general formula [III'] is preferred.

General formula [III]:

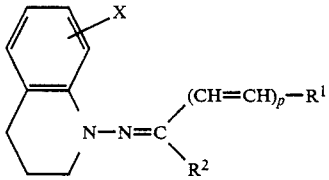

(in which $R^1$: represents a substituted or unsubstituted aryl group, or a substituted or unsubstituted heterocyclic compound;

$R^2$: represents a hydrogen atom, or a substituted or unsubstituted alkyl group, or a substituted or unsubstituted aryl group;

X: represents a hydrogen or halogen atom, an alkyl group, a substituted amino group, or an alkoxy or cyano group; and P: represents an integer of 0 or 1.)

General formula [III']:

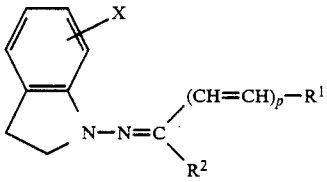

(in which $R^1$, $R^2$, X, and p carry same meanings as above given.)

Nextly, to illustrate the hydrazone compounds expressed by the foregoing general formula [III]'which can be used as carrier transporting materials in the present invention, those having the following structural formula may be mentioned by way of example, but needless to say the useful hydrazone compounds are not limited to those shown.

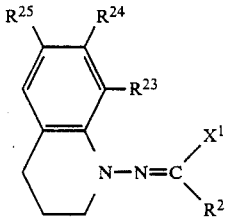

| Compound No. | $-R^{23}$ | $-R^{24}$ | $-R^{25}$ | $-R^2$ | $-X^1$ |
|---|---|---|---|---|---|
| III-1 | —H | —H | —H | —H | 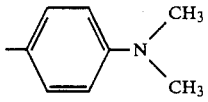 |
| III-2 | " | " | " | " | 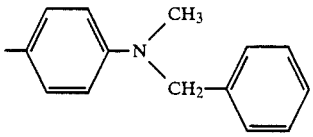 |

-continued
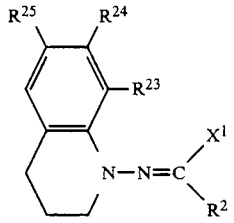
| Compound No. | $-R^{23}$ | $-R^{24}$ | $-R^{25}$ | $-R^{2}$ | $-X^{1}$ |
|---|---|---|---|---|---|
| III-3 | " | " | $-CH_3$ | $-H$ | 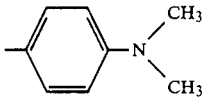 |
| III-4 | " | " | $-H$ | " | " |
| III-5 | " | " | " | " | 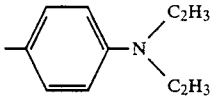 |
| III-6 | " | $-OCH_3$ | " | " | " |
| III-7 | $-H$ | $-H$ | $-H$ | $-H$ | 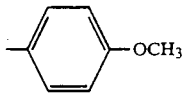 |
| III-8 | " | " | " | " | 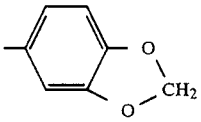 |
| III-9 | " | " | " | " | 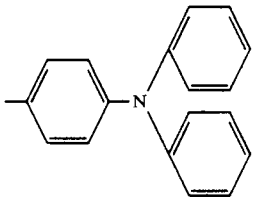 |
| III-10 | " | " | " | " | 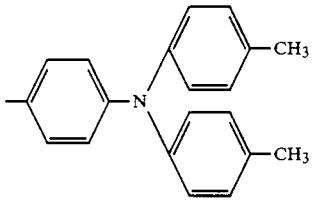 |
| III-11 | " | " | " | " | 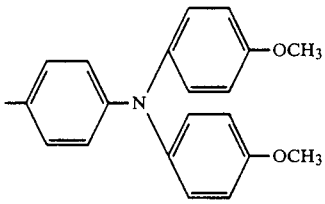 |

-continued
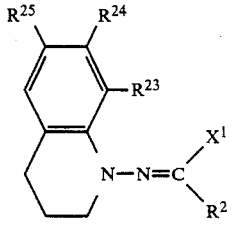
| Compound No. | —$R^{23}$ | —$R^{24}$ | —$R^{25}$ | —$R^2$ | —$X^1$ |
|---|---|---|---|---|---|
| III-12 | " | " | —$CH_3$ | " | 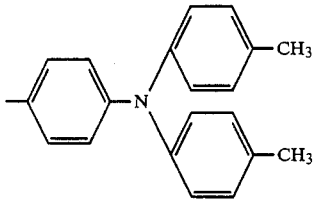 |
| III-13 | " | " | —$OCH_3$ | " | 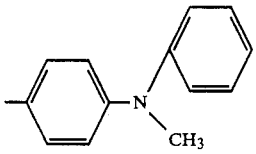 |
| III-14 | —H | —H | —Cl | —H | 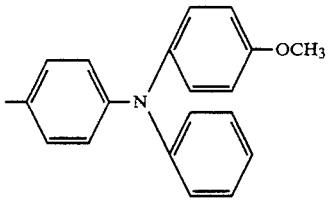 |
| III-15 | " | " | —H | 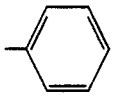 | 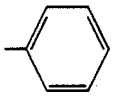 |
| III-16 | " | " | " | " | 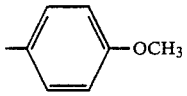 |
| III-17 | " | " | " | —$CH_3$ | 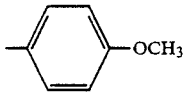 |
| III-18 | " | " | " | " | 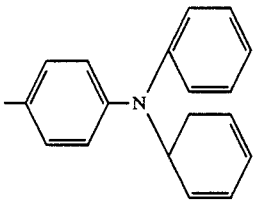 |
| III-19 | " | " | " | 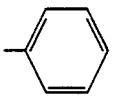 | 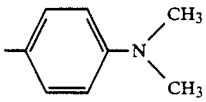 |

-continued
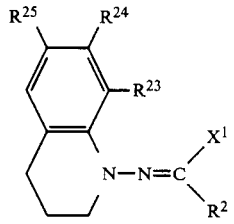
| Compound No. | $-R^{23}$ | $-R^{24}$ | $-R^{25}$ | $-R^{2}$ | $-X^{1}$ |
|---|---|---|---|---|---|
| III-20 | " | " | " | —H | 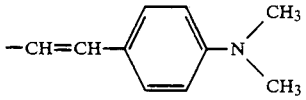 |
| III-21 | —H | —H | —H | —H | 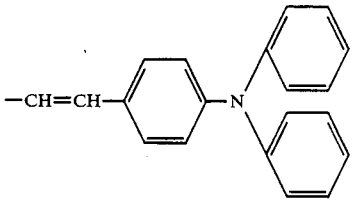 |
| III-22 | $-CH_3$ | " | " | " | 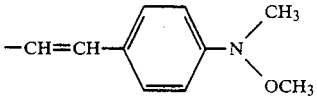 |
| III-23 | —H | " | " | $-CH_3$ | 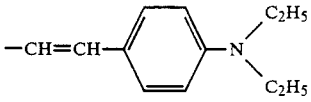 |
| III-24 | " | " | " | —H | 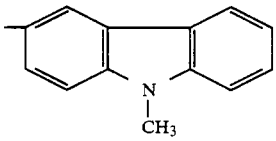 |
| III-25 | " | " | " | " | 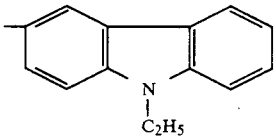 |
| III-26 | " | " | " | " | 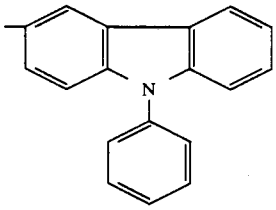 |
| III-27 | " | " | $-CH_3$ | —H | 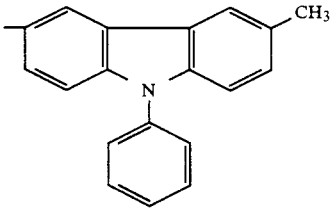 |

-continued
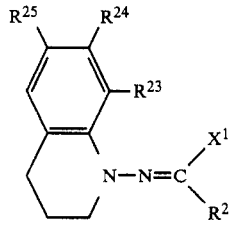
| Compound No. | $-R^{23}$ | $-R^{24}$ | $-R^{25}$ | $-R^{2}$ | $-X^{1}$ |
|---|---|---|---|---|---|
| III-28 | " | " | —H | " | 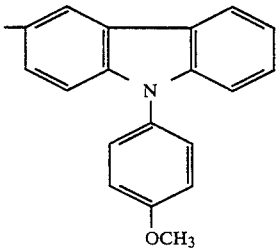 |
| III-29 | " | " | $-CH_3$ | " | 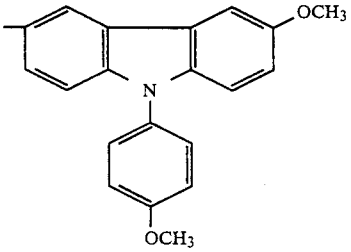 |
| III-30 | " | " | —H | " | 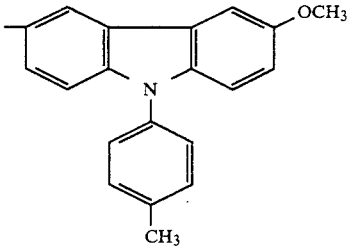 |
| III-31 | " | " | " | " | 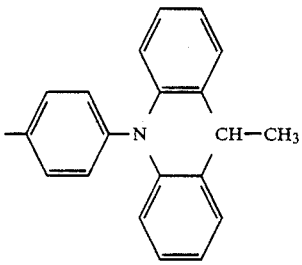 |
| III-32 | —H | —H | —H | —H | 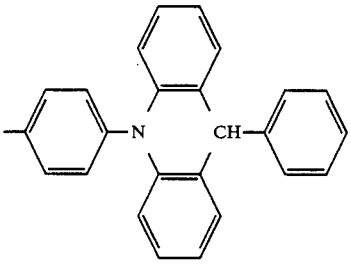 |

-continued
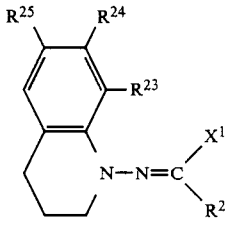
| Compound No. | $-R^{23}$ | $-R^{24}$ | $-R^{25}$ | $-R^{2}$ | $-X^{1}$ |
|---|---|---|---|---|---|
| III-33 | " | " | " | " | 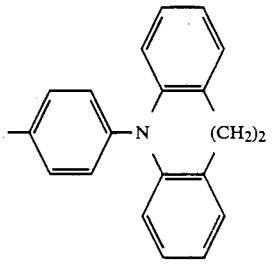 |
| III-34 | " | " | " | " | 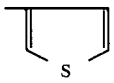 |
| III-35 | " | " | —CN | " | 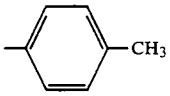 |
| III-36 | " | 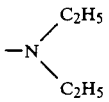 | —H | " | 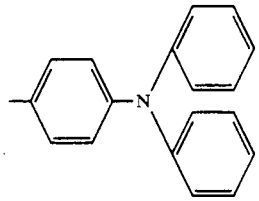 |
| III-37 | $-C_2H_5$ | —H | " | " | 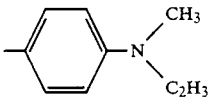 |
| III-38 | —H | —H | —H | —H | 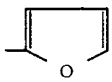 |
| III-39 | " | " | " | " | 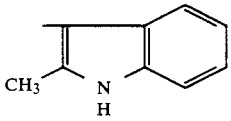 |
| III-40 | " | " | " | " | 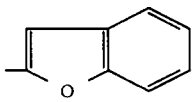 |

-continued

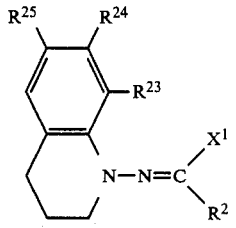

| Compound No. | $-R^{23}$ | $-R^{24}$ | $-R^{25}$ | $-R^{2}$ | $-X^{1}$ |
|---|---|---|---|---|---|
| III-41 | " | " | " | " | 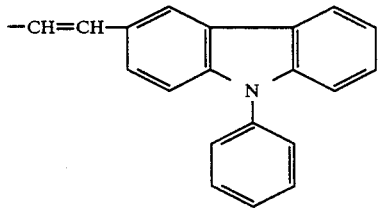 |
| III-42 | $-C_3H_7$ | " | " | $-CH_3$ | 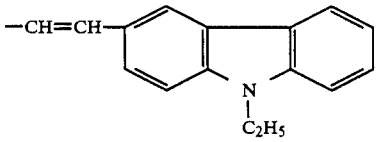 |

To illustrate the hydrazone compounds expressed by the foregoing general formula [III'] which can be used as carrier transporting materials in the present invention, those having the following structural formula may be mentioned by way of example, but needless to say the useful hydrazone compounds are not limited to those shown.

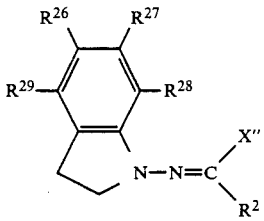

| Compound No. | $-R^{26}$ | $-R^{27}$ | $-R^{28}$ | $-R^{29}$ | $-R^{2}$ | $-X''$ |
|---|---|---|---|---|---|---|
| III'-1 | $-H$ | $-H$ | $-H$ | $-H$ | $-H$ | 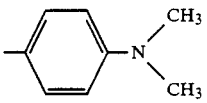 |
| III'-2 | " | " | " | " | " | 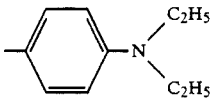 |
| III'-3 | " | " | " | " | " | 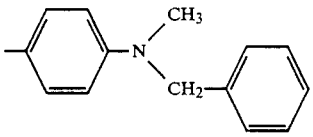 |
| III'-4 | " | " | $-CH_3$ | " | " | 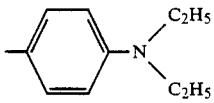 |

-continued
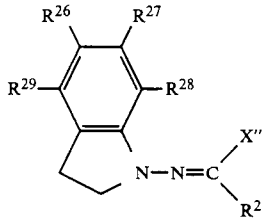
| Compound No. | —R26 | —R27 | —R28 | —R29 | —R2 | —X'' |
|---|---|---|---|---|---|---|
| III'-5 | —H | —H | —H | —H | —H | 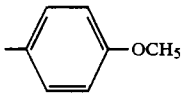 |
| III'-6 | " | " | —OCH3 | " | " | 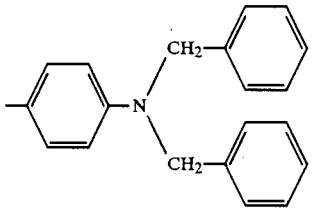 |
| III'-7 | " | " | —H | " | " | 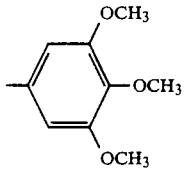 |
| III'-8 | " | " | " | " | " | 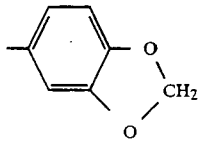 |
| III'-9 | " | " | " | " | " | 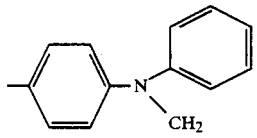 |
| III'-10 | " | " | " | " | " | 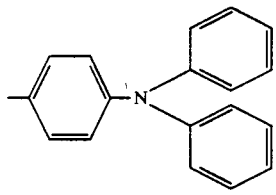 |
| III'-11 | —H | —CH3 | —H | —H | —H | 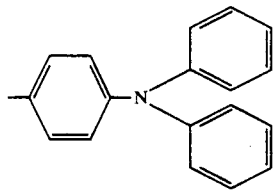 |

-continued
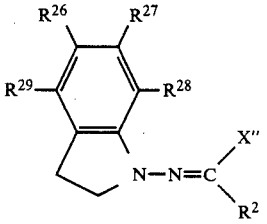
| Compound No. | —$R^{26}$ | —$R^{27}$ | —$R^{28}$ | —$R^{29}$ | —$R^2$ | —X'' |
|---|---|---|---|---|---|---|
| III'-12 | " | —H | " | " | " | 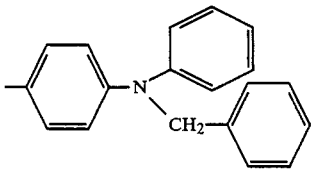 |
| III'-13 | " | " | " | " | " | 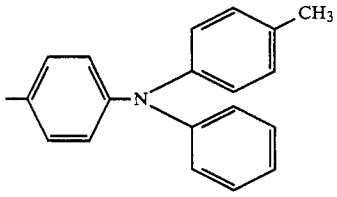 |
| III'-14 | " | " | " | " | " | 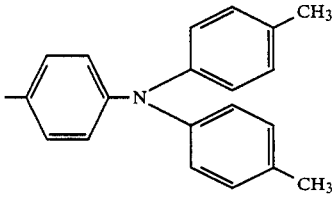 |
| III'-15 | " | " | " | " | " | 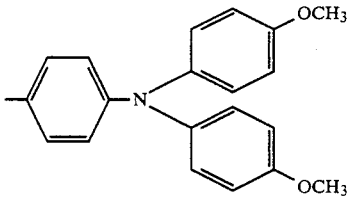 |
| III'-16 | " | —$OCH_3$ | " | " | " | 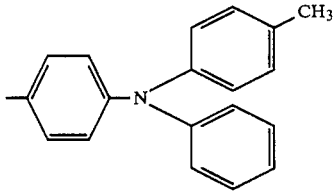 |
| III'-17 | —H | —H | —H | —Cl | —H | 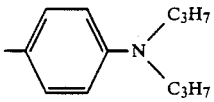 |
| III'-18 | —CH | " | " | —H | —$CH_3$ | 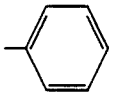 |

-continued
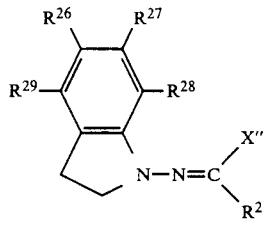
| Compound No. | $-R^{26}$ | $-R^{27}$ | $-R^{28}$ | $-R^{29}$ | $-R^{2}$ | $-X''$ |
|---|---|---|---|---|---|---|
| III'-19 | —H | " | " | " | 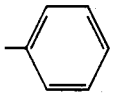 | 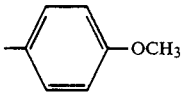 |
| III'-20 | " | " | " | " | $-C_2H_5$ | 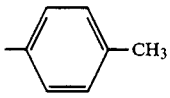 |
| III'-21 | " | " | " | " | 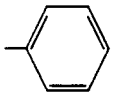 | 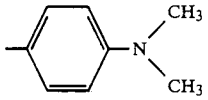 |
| III'-22 | " | " | " | " | $-CH_3$ | 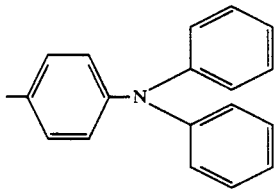 |
| III'-23 | " | " | " | " | —H | —CH=CH 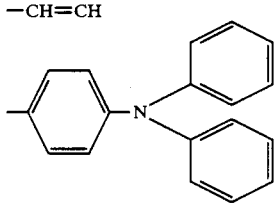 |
| III'-24 | —H | —H | —H | —H | —H | 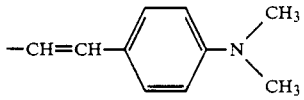 |
| III'-25 | " | " | " | " | " | 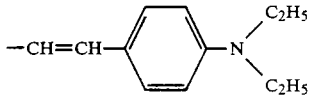 |
| III'-26 | " | " | " | " | " | 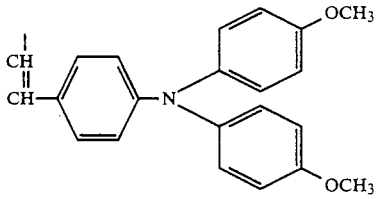 |
| III'-27 | " | " | " | " | $-CH_3$ | 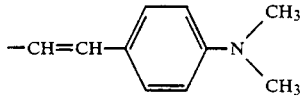 |

-continued
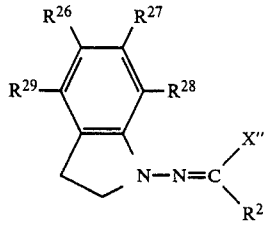
| Compound No. | —R26 | —R27 | —R28 | —R29 | —R2 | —X'' |
|---|---|---|---|---|---|---|
| III'-28 | " | " | " | " | " | 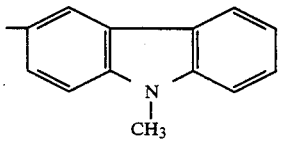 |
| III'-29 | " | " | " | " | " | 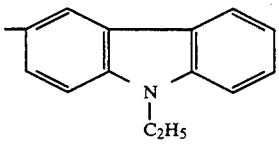 |
| III'-30 | —H | —H | —H | —H | —H | 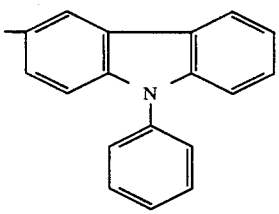 |
| III'-31 | " | " | " | " | " | 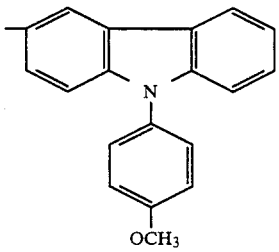 |
| III'-32 | " | " | " | " | " | 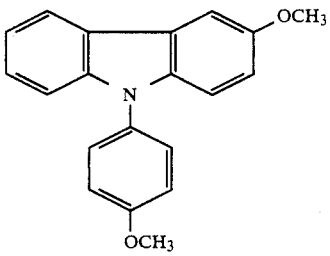 |
| III'-33 | " | " | —CH3 | " | " | 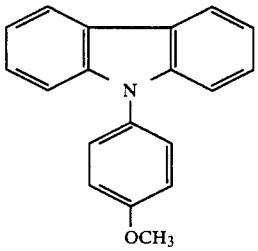 |

-continued
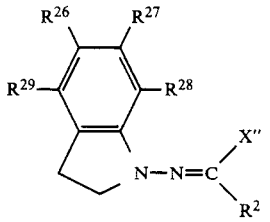
| Compound No. | $-R^{26}$ | $-R^{27}$ | $-R^{28}$ | $-R^{29}$ | $-R^{2}$ | $-X''$ |
|---|---|---|---|---|---|---|
| III'-34 | —H | —H | $-CH_3$ | —H | —H | 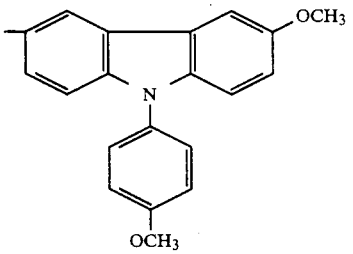 |
| III'-35 | " | " | —H | " | " | 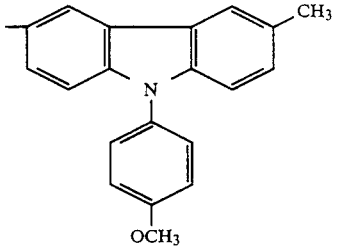 |
| III'-36 | " | $-CH^3$ | " | " | " | 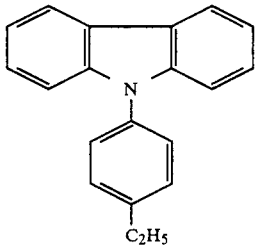 |
| III'-37 | " | —H | " | " | " | 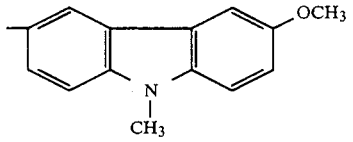 |
| III'-38 | " | " | " | " | " | 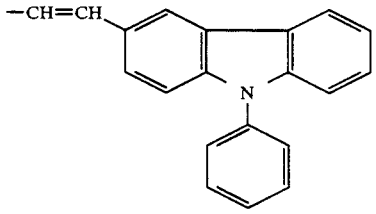 |

-continued
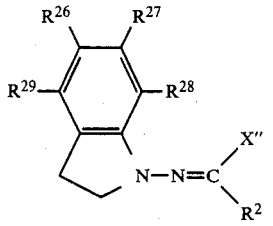
| Compound No. | —R26 | —R27 | —R28 | —R29 | —R2 | —X'' |
|---|---|---|---|---|---|---|
| III'-39 | —H | —H | —H | —H | —H | 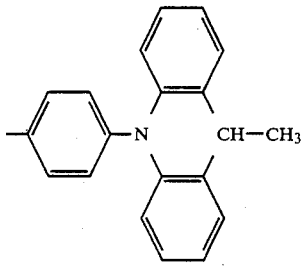 |
| III'-40 | 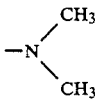 | " | " | " | " | 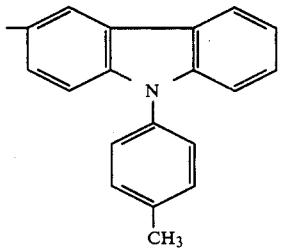 |
| III'-41 | —H | —H | —H | —H | —H | 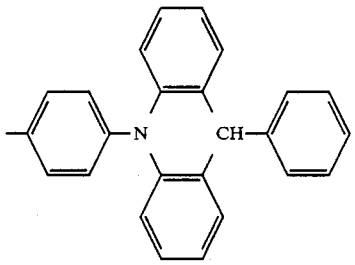 |
| III'-42 | " | " | " | " | " | 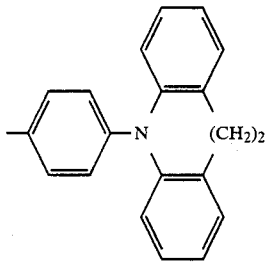 |
| III'-43 | —H | —H | —H | —H | —H | 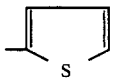 |
| III'-44 | " | " | " | " | " | 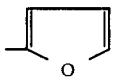 |

-continued

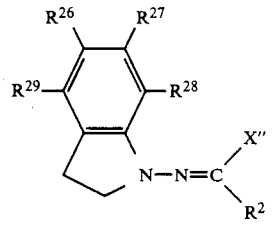

| Compound No. | $-R^{26}$ | $-R^{27}$ | $-R^{28}$ | $-R^{29}$ | $-R^{2}$ | $-X''$ |
|---|---|---|---|---|---|---|
| III'-45 | " | " | " | " | " | 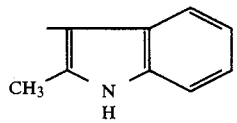 |
| III'-46 | " | " | " | " | " | 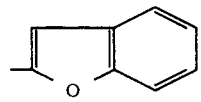 |

In the present invention, hydrazone compounds expressed by the following general formula [IV] can be preferably used as carrier transporting materials.

General formula [IV]:

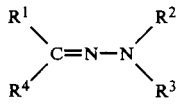

(in which $R^1$: represents a substituted or unsubstituted aryl group, a substituted or unsubstituted carbazolyl group, or a substituted or unsubstituted heterocyclic group; and $R^2$, $R^3$ and $R^4$: represent hydrogen atoms, alkyl groups, substituted or unsubstituted aryl groups, or substituted or unsubstituted aralkyl groups.)

In the general formula [IV], where $R^1$ is an aryl group, or where $R^2$, $R^3$, or $R^4$ is an aryl group or an aralkyl group, it is especially preferable that at least one of the aryl and/or aralkyl groups is substituted by an electron donative group (a substituent group such that the value of $\sigma$ in Hammett's equation is negative), such as amino group, dialkyl amino group, diarylamino group, diaralkylamino group, or alkoxy group.

Presumably, the reason for this may be that these electron donative groups can lower the ionization potential of the compound, thereby facilitating carrier injection from the charge generating material.

It is especially preferable that $R^1$ in the compound is replaced by such electron donative group. From the viewpoint of resonance structure, it is preferable that such substitution is made at a para-position. More favorably, R' is a phenyl group substituted by such electron donative group at the para-position.

In the case where R' is a carbazole group, it si naturally expectable from the molecular structure that aforesaid effect can be satisfactorily achieved. In this conjunction, it is most preferable that the carbazolyl groups are linked at 3-position, that is, their position of bond is at para-position relative to nitrogen molecules.

Where $R^1$ is a heterocyclic group, it is expected that a charge transporting material having unique characteristics can be obtained by taking advantage of the electronic characteristics (electron attracting properties) of the elements which constitute the ring and the unique resonance structure or molecular orbital of the heterocyclic ring.

Considering from the above stated facts, of the hydrazone compounds expressed by the foregoing general formula [IV], those expressed by the following general formulas [IV a] and [IV b] are especially preferred.

General formulas [IV a]

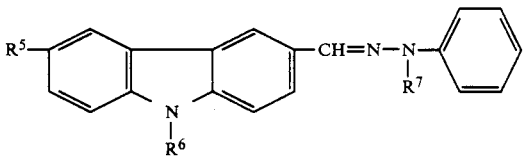

(in which $R^5$: represents a hydrogen or halogen atom, a methyl, an ethyl, a 2-hydroxyethyl, or a 2-chloroethyl group;

$R^6$: represents a methyl, an ethyl, a benzyl, a phenyl, a 2-hydroxyethyl, or a 2-chloroethyl group; and $R^7$: represents a methyl, an ethyl, a benzyl, or a phenyl group, or a substituted phenyl, or a naphthyl group.)

General formulas [IV b]:

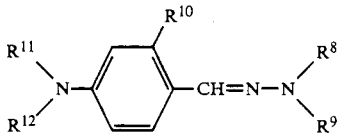

(in which $R^8$ represents a substituted or unsubstituted phenyl or naphthyl group; $R^9$ represents a substituted or unsubstituted alkyl, aralkyl, or aryl group; $R^{10}$ represents a hydrogen group, an alkyl group, or an alkoxy group; $R^{11}$ and $R^{12}$ represent groups consisting of substituted or unsubstituted alkyl, aralkyl, or aryl groups which are identical with or different from each other.)

To illustrate the hydrazone compounds of the foregoing general formula [IV], the following compounds having the following structural formula may be mentioned by way of example. Needless to say, it is understood that the formula [IV] compounds are not limited to those exemplified.

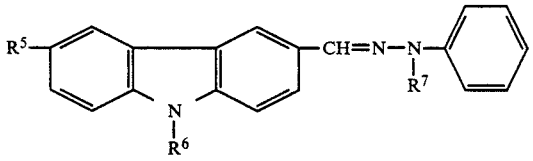

| Compound No. | $-R^5$ | $-R^6$ | $-R^7$ |
|---|---|---|---|
| IV-1 | $-H$ | $-CH_3$ | $-CH_3$ |
| IV-2 | " | " | $-C_2H_5$ |
| IV-3 | " | " | $-CH_2-$ 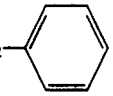 |
| IV-4 | " | " | 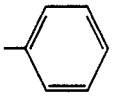 |
| IV-5 | " | $-C_2H_5$ | $-CH_3$ |
| IV-6 | " | " | $-C_2H_5$ |
| IV-7 | " | " | $-CH_2-$ 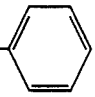 |
| IV-8 | " | " | 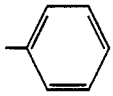 |
| IV-9 | " | $-C_2H_4OH$ | $-CH_3$ |
| IV-10 | " | " | $-C_2H_5$ |
| IV-11 | " | " | $-CH_2-$ 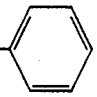 |
| IV-12 | $-Cl$ | " | " |
| IV-13 | $-CH_3$ | $-C_2H_5$ | 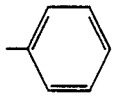 |

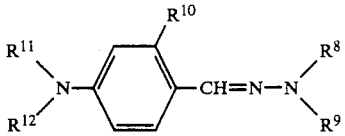

| Compound No. | $-R^{11}$ | $-R^{12}$ | $-R^{10}$ | $-R^8$ | $-R^9$ |
|---|---|---|---|---|---|
| IV-14 | $-C_2H_5$ | $-C_2H_5$ | $-H$ | 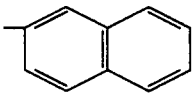 | 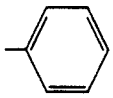 |

-continued
| | | | | | |
|---|---|---|---|---|---|
| IV-15 | " | " | " | 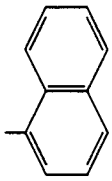 | " |
| IV-16 | " | " | " | " | 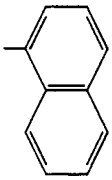 |
| IV-17 | " | " | " | 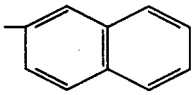 | 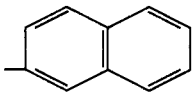 |
| IV-18 | " | " | " | " | 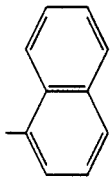 |
| IV-19 | $-(CH_2)_2CH_3$ | $-(CH_2)_2CH_3$ | " | 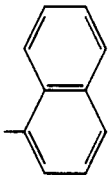 | 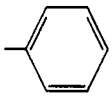 |
| IV-20 | $-(CH_2)_2CH_3$ | $-(CH_2)_2CH_3$ | " | 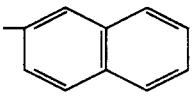 | " |
| IV-21 | 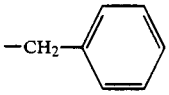 | 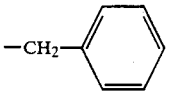 | " | 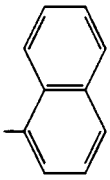 | " |
| IV-22 | 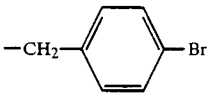 | 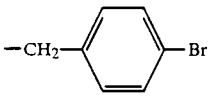 | —H | 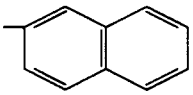 | 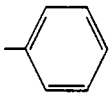 |
| IV-23 | 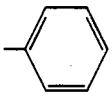 | 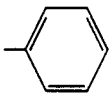 | " | 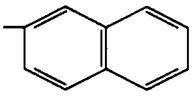 | " |
| IV-24 | $-C_2H_5$ | $-C_2H_4-N(CH_3)_2$ | " | " | 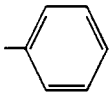 |
| IV-25 | " | $-C_2H_4OCH_3$ | " | " | " |

-continued

| | | | | | |
|---|---|---|---|---|---|
| IV-26 | " | $-C_2H_5$ | $-CH_3$ | 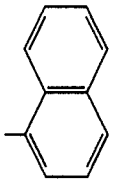 | " |
| IV-27 | " | " | $-OCH_3$ | " | " |
| IV-28 | " | " | $-O(CH_2)_3CH_3$ | " | " |
| IV-29 | 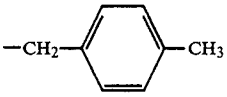 | 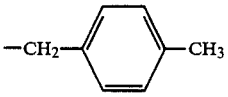 | $-H$ | " | " |
| IV-30 | $-C_2H_5$ | $-C_2H_5$ | " | 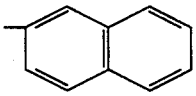 | 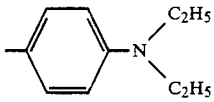 |
| IV-31 | " | " | " | " | 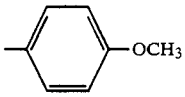 |
| IV-32 | $-C_2H_5$ | $-CH_2-CH_2Cl$ | $-H$ | 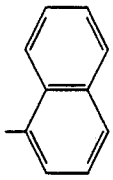 | 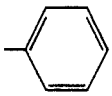 |
| IV-33 | " | $-C_2H_5$ | " | 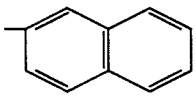 | 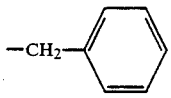 |
| IV-34 | " | " | " | " | $-C_2H_5$ |
| IV-35 | $-C_3H_7$ | $-C_3H_7$ | " | 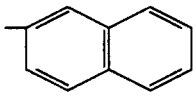 | 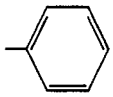 |

Further, for the photoreceptors of the invention, compounds expressed by the following general formula [V] are preferably used.

General formula [V]:

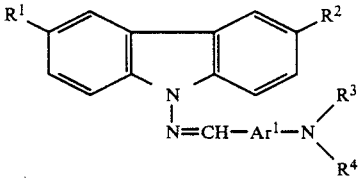

(in which $R^1$ and $R^2$: represent hydrogen or halogen atoms;

$R^3$ and $R^4$: represent substituted or unsubstituted aryl groups; an $Ar^1$: represent substituted or unsubstituted aryl groups.)

To illustrate the compounds of the foregoing general formula [V], those having the following structural formula may be mentioned by way of example. Needless to say, it is understood that the formula [V] compounds are not limited to those exemplified.

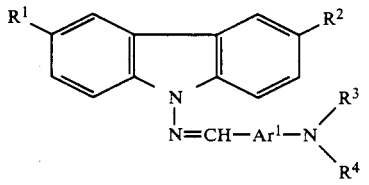
| Compound No. | —R1 | —R2 | —R3 | —R4 | —Ar1 |
|---|---|---|---|---|---|
| V-1 | —H | —H | 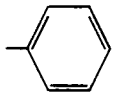 | 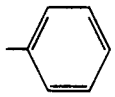 | 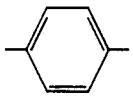 |
| V-2 | " | " | 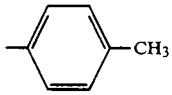 | 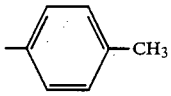 | " |
| V-3 | " | " | " | 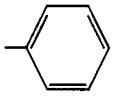 | " |
| V-4 | " | " | 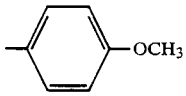 | 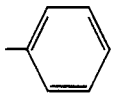 | 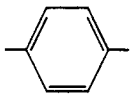 |
| V-5 | " | " | " | 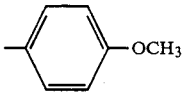 | " |
| V-6 | " | —Cl | 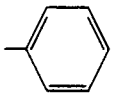 | 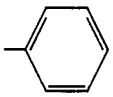 | " |
| V-7 | " | " | 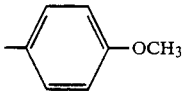 | 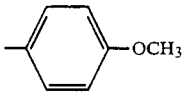 | " |
| V-8 | —H | —Cl | 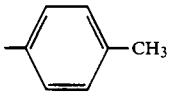 | 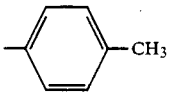 | 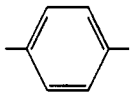 |
| V-9 | " | —H | 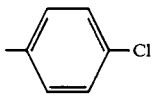 | 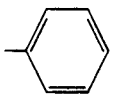 | " |
| V-10 | " | " | 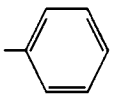 | " | 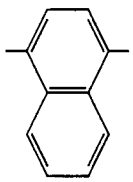 |

-continued

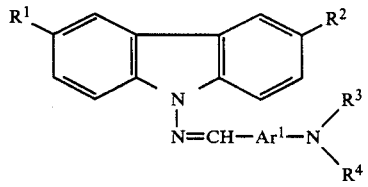

| Compound No. | $-R^1$ | $-R^2$ | $-R^3$ | $-R^4$ | $-Ar^1$ |
|---|---|---|---|---|---|
| V-11 | " | " | 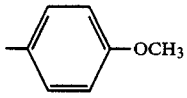 | 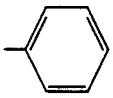 | 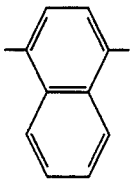 |
| V-12 | " | " | 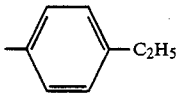 | " | 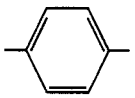 |
| V-13 | " | " | 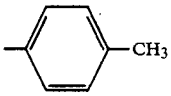 | 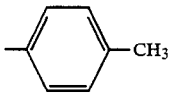 | " |
| V-14 | " | $-Cl$ | 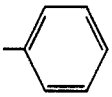 | 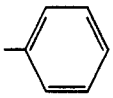 | 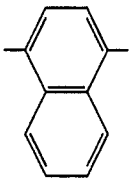 |
| V-15 | " | $-H$ | 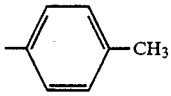 | 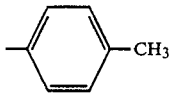 | 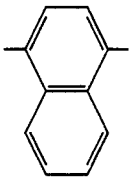 |

For the photoreceptors of the invention, compounds expressed by the following general formula [VI] may also be General formula [VI]:

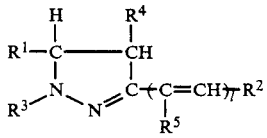

[in which l: 0 or 1;

$R^1$ and $R^2$: substituted or unsubstituted aryl groups;

$R^3$: a substituted or unsubstituted aryl group; or a heterocyclic group; and $R^4$ and $R^5$: hydrogen atoms, alkyl groups having 1–4 carbon atoms, or substituted or unsubstituted aryl or aralkyl groups (provided that in no case $R^4$ and $R^5$ are hydrogen atom numbers at same time and that if l is 0, R is not a hydrogen atom.)]

Of the pyralizone compounds expressed by the foregoing general formula [VI], those expressed by the following general formula [VI a] are especially preferred.

General formula [VI a]:

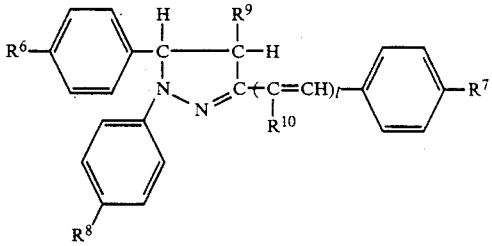

in which l denotes 0 or 1; $R^6$, $R^7$, and $R^8$ represent hydrogen atoms, or amino, dialkyl amino, diaryl amino, diaralkyl amino, or alkoxy groups; and $R^9$ and $R^{10}$ are same as those earlier defined.)

To illustrate the pyralizone compounds of the foregoing general formula [VI], those having the following structural formula may be mentioned by way of example. Needless to say, it is understood that the formula [VI] compounds are not limited to those exemplified.

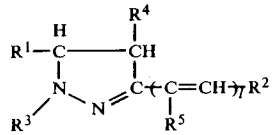
(l = 0 1)
| Compound No. | $-R^1$ | $-R^4$ | $-R^3$ | $-R^5$ | l | $-R^2$ |
|---|---|---|---|---|---|---|
| VI-1 | 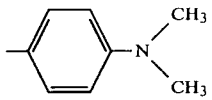 | $-CH_3$ | 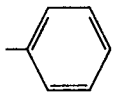 | $-H$ | 1 | 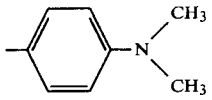 |
| VI-2 | " | $-H$ | " | $-CH_3$ | " | " |
| VI-3 | 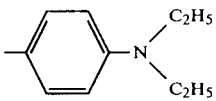 | $-CH_3$ | " | " | " | 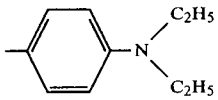 |
| VI-4 | 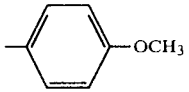 | " | " | $-H$ | " | 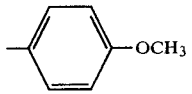 |
| VI-5 | " | $-H$ | " | $-CH_3$ | " | " |
| VI-6 | 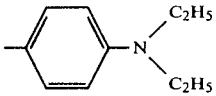 | $-CH_3$ | 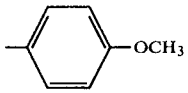 | $-H$ | " | 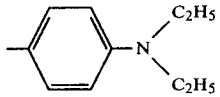 |
| VI-7 | 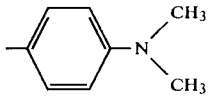 | " | 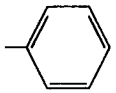 | " | " | 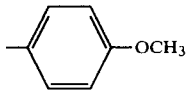 |
| VI-8 | 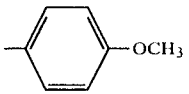 | " | " | " | " | 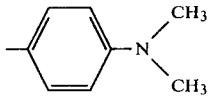 |

-continued
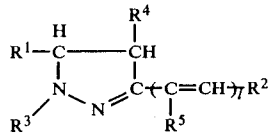
(l = 0 1)
| Compound No. | $-R^1$ | $-R^4$ | $-R^3$ | $-R^5$ | l | $-R^2$ |
|---|---|---|---|---|---|---|
| VI-9 | 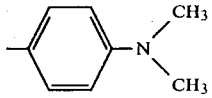 | $-H$ | " | $-CH_3$ | " | 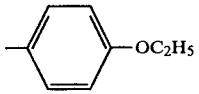 |
| VI-10 | 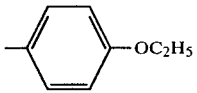 | $-H$ | 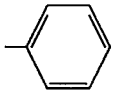 | $-CH_3$ | 1 | 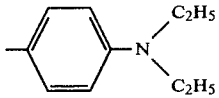 |
| VI-11 | 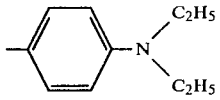 | 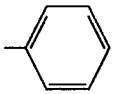 | " | 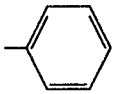 | " | 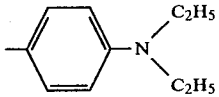 |
| VI-12 | 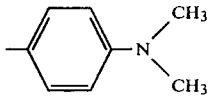 | $-CH_3$ | " | $-H$ | " | 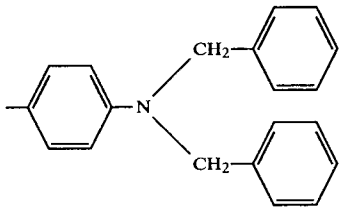 |
| VI-13 | 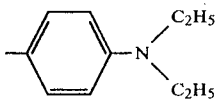 | " | " | $-H$ | 0 | 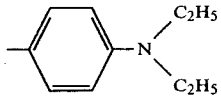 |
| VI-14 | " | $-C_2H_5$ | " | " | 1 | " |

-continued
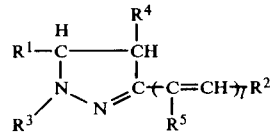
(l = 0 1)
| Compound No. | $-R^1$ | $-R^4$ | $-R^3$ | $-R^5$ | l | $-R^2$ |
|---|---|---|---|---|---|---|
| VI-15 | 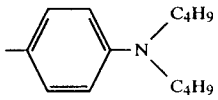 | $-H$ | " | $-C_3H_7$ | " | 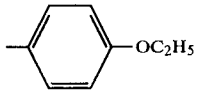 |
| VI-16 | 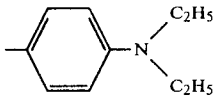 | 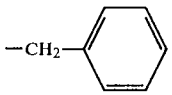 | 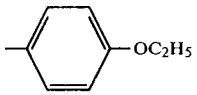 | $-H$ | " | 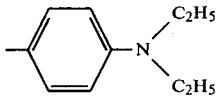 |
| VI-17 | " | $-H$ | 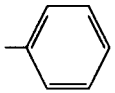 | 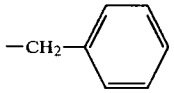 | " | " |
| VI-18 | 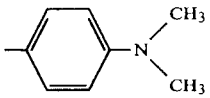 | " | " | $-CH_3$ | " | 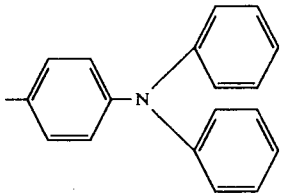 |
| VI-19 | 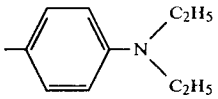 | $-CH_3$ | " | $-H$ | " | 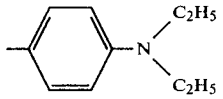 |
| VI-20 | 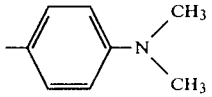 | 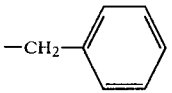 | 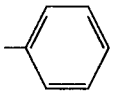 | $-H$ | " | 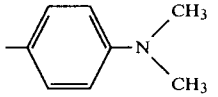 |

-continued
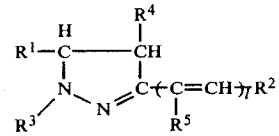
(l = 0 1)
| Compound No. | $-R^1$ | $-R^4$ | $-R^3$ | $-R^5$ | l | $-R^2$ |
|---|---|---|---|---|---|---|
| VI-21 | 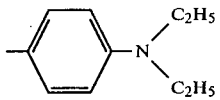 | —H | 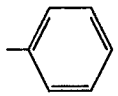 | $-CH_3$ | " | 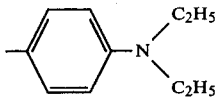 |

In the photoreceptors according to the present invention, the carrier generating layer should contain the carrier generating material within a specified range of proportions to the binder material or, in more concrete terms, carrier generating material/binder material=5–150% (which means 5–150% by weight, preferably 10–100% by weight, of carrier generating material relative to 100% by weight of binder material). On this basis it is possible to provide a positive-charge type photoreceptor which is less subject to residual potential and reduced receptive potential. Deviations from the foregoing range are undesirable. That is, if the proportion of the carrier generating material is excessively small, no favorable photosensitivity is obtainable and there will be increased residual potential; and if the proportion is excessively large, there will be frequent receptive potential drop and increased memory. The proportion of the carrier transporting material in the carrier generating layer is also important. The proportion should be within the following range: carrier transporting material/binder material=20–200% (that is, 20–200% by weight, preferably 50–150% by weight, of carrier transporting material relative to 100 % by weight of binder material). Insofar as the proportion is within this range, the level of residual potential is low and good photosensitivity is obtained, and furthermore the solubility of the carrier transporting material in solvent can be maintained in good order. Deviations from this range are undesirable. That is, if the proportion of the carrier transporting material is excessively small, quality deterioration is likely to occur in respect of residual potential and photosensitivity, which will easily result in image defects, white spots, lack of sharpness, etc.; and if the proportion is excessively large, no good solvent solubility is obtainable, with the result of reduced film strength. The above specified proportional range of the carrier transporting material may be equally applied to the carrier transporting layer.

The relative proportions of said carrier generating material and said carrier transporting material in the carrier generating layer should be preferably 1:0.2–1: 10 (carrier generating material:carrier transporting material), more favorably 1:0.5–1:7, in order to permit the both materials to perform their respective functions effectively.

If the proportion of the carrier generating material deviates from this range on the lower side, there will be lack of sensitivity, and if the proportion deviates on the higher side, the result is decreased carrier transporting capability and lack of sensitivity is also inevitable.

The thickness of the carrier generating layer 2 is preferably 0.6–10 μm, more favorably 1–8 μm. If the thickness is less than 0.6 μm, the surface of the carrier generating layer is liable to mechanical damage during the process of development and/or cleaning in case of repeated use, so that the layer may be partially shaved off, which will often be a cause of dark stripes on a picture image. Further, a thickness of less than 0.6 μm is more likely than not to be a cause of lack of sensitivity. If the thickness of the carrier generating layer is more than 10 μm, generation of heat exciting carriers is enhanced and, accordingly, with the rise of the ambient temperature there will often be receptive potential drop, increased memory effect, and decreased image density.

Further, illumination of long-wave light rays is applied at the absorption end of the carrier generating material, optical carriers may be generated even in the vicinity of the lowermost part of the charge generating layer. In this case, electrons most move through the layer to the surface and as such it is generally unlikely to obtain sufficient transporting capability. Thus, there will often be increased residual potential during repeated use.

The thickness of the carrier transporting layer 3 should be 5–50 μm, preferably 5–30 μm. If the thickness is less than 5 μm, the level of charging potential will be excessively low, and if the thickness is more than 50 μm, the level of residual potential is likely to be excessively large.

The thickness ratio of the carrier generating layer to the carrier transporting layer is preferably 1:(1–30).

When dispersing the carrier generating material to form a photosensitive layer, the carrier generating material is preferably reduced to particles having a mean particle diameter of not more than 5 μm and not less than 0.1 μm, preferably not more than 2 μm and not less than 0.2 μm. If the particle diameter is excessively large, the material cannot be sufficiently dispersed in the layer and particles may partially project through the surface, so that no satisfactory surface smoothness can be obtained. In some case, discharge may occur at projecting particle portions, or toner particles may deposit on such portions, thus causing toner filming.

Carrier generating materials sensitive to long-wave light beams (−700 nm) are subject to surface charge neutralization due to generation of heat exciting carriers in the materials themselves. Presumably, if the particle size of such material is large, the effect of said neutralization is considerable. Therefore, a carrier generating material having high-resistance, high-sensitivity characteristics can be obtained only by reasonably minimizing the particle size. However, it is understood that if the particle diameter is excessively small, particles are likely to aggregate, with the result of increased layer resistance, and increased crystalline defect, which in turn result in decreased sensitivity, lowered repetitive quality, and reduced charging capability. Naturally, there must be a limit in particle size reduction. Therefore, the lower limit of mean particle size should preferably be 0.01 μm.

Further, with a view to achieving increased sensitivity and fatigue reduction during repeated use, it is possible to incorporate one or more kinds of electron receptive material into the photosensitive layer. The electron receptive materials which can be used for this purpose include, for example, succinic anhydride, maleic anhydride, dibromosuccinic anhydride, phthalic anhydride, tetrachlorphthalic anhydride, tetrabromophthalic anhydride, 3-nitrophthalic anhydride, 4-nitrophthalic anhydride, pyromellitic anhydride, mellitic anhydride, tetracyanoehylene, tetracyano quinodimethane, o-dinitrobenzene, m-dinitrobenzene, 1,3,5-trinitrobenzene, paranitrobenzonitrile, picryl chloride, quinone chlorimide, chloranile, bulmanile, dichlorodicyano parabenzoquinone, anthraquinone, dinitro anthraquinone, 9-fluorenylidene [dicyanomethylene malonodinitrile], polynitro-9-fluorenylidene [dicyanomethylene malonodinitrile], polynitro-9-fluorenylidene [dicyanomethylene malonodinitrile], piric acid, o-nitrobenzoate, pentafluorobenzoate, 5-nitro salicylic acid, 3,5-dinitro salicylic acid, phthalic acid, millitic acid, and other compounds having high electron affinity.

The proportion of such electron receptive material to be added is 100:0.01–200 (carrier generating material:

electron receptive material), preferably 100:0.1–100, in weight ratio.

For the support 1 on which aforesaid photosensitive layer is placed, a metal plate, a metallic drum, or a substrate made of paper, plastic film, or the like on which a photoconductive thin layer formed of aluminum, palladium, gold, or the like is laid by coating, deposition, lamination, or otherwise, is used. The intermediate layer which functions as an adhesion layer or a barrier layer is formed of such a high polymeric material as described earlier as a binder resin, or polyvinyl alcohol, ethyl cellulose, carboxy methyl cellulose, or the like.

The electrophotographic photoreceptor of the invention can be obtained in manner as above described. The photoreceptor is advantageous in that where the photosensitivity of the metal-free phthalocyanine used therein is, at its peak wavelength value, within a range of more than 770 nm—less than 790 nm, the photoreceptor is ideal for use as a semiconductor laser photoreceptor, and in that the metal-free photoreceptor, as already described, is very stable in crystal form and is not liable to be transformed into any other crystal form. This fact is not only advantageous from the standpoint of manufacturing the metal-free phthalocyanine of the invention and characteristic quality thereof, but also it serves as a great advantage in the manufacture of electrophotographic photoreceptors and in the use thereof.

EXAMPLES

Concrete examples of the invention will be given below to further illustrate the invention, with comparison with comparative examples.

Firstly, synthesis examples of a metal-free phthalocyanine compound A having characteristics shown in FIGS. 1 and 2, and a metal-free phthalocyanine compound B having characteristics shown in FIGS. 3 to 5, and a synthesis example of a $\tau$-type metal-free phthalocyanine compound will be given.

<Synthesis Example 1>

50 g of lithium phthalocyanine was added to 600 ml of fully agitated concentrated sulfuric acid at 0° C. Then, the mixture was stirred at same temperature for 2 hours. The resulting solution was then filtered through a crude sintered glass funnel, being then gradually poured into 4 liter of ice and water under agitation. After being allowed to stand for a few hours, the mixture was filtered and the resulting mass was washed with water until it was neutralized. Subsequently, the mass was washed with methanol several times and then dried in air. The dried powdery mass was subjected to extraction with acetone in a continuous extraction unit for 24 hours, and was dried into blue powder.

In the above process, separation was repeated to insure salt residue relative to lithium. Thus, 30.5 g of blue powder was obtained. The powder had an X-ray diffraction pattern which agreed with the X-ray diffraction pattern of an $\alpha$-type phthalocyanine compound which was described in a previously published material.

30 g of the metal-free $\alpha$-type phthalocyanine compound thus obtained was charged into a porcelain ball mill having an inner capacity of 900 m which was half full with balls of 13/16 inch dia, and was subjected to milling at approximately 80 rpm for 164 hours. As a result, a metal-free phthalocyanine compound A was obtained. This compound showed an X-ray diffraction spectrum given in FIG. 1.

<Synthesis Example 2>

The metal-free phthalocyanine of Synthesis Example 1 was put into a ball mill, together with 200 ml of organic solvents, such as tetrahydrofuran and 1,2-dichloroethane, and was again subjected to milling for 24 hours. Removal of organic solvents and drying were carried out with respect to the post-milling dispersion liquid, and as a result 28.2 g of metal-free phthalocyanine compound B was obtained. This compound showed the X-ray diffraction spectrum given in FIG. 3.

Synthesis Example 3

As $\alpha$-type metal-free phthalocyanine compound ("Monolight Fastbul GS", made by ICI) was extracted three times by heated dimethyl formaldehyde, being thereby refined. Through this operation the refined product was transformed into $\beta$-type. Nextly, a part of the $\beta$-type metal-free phthalocyanine compound was dissolved in concentrated sulfuric acid, and the resulting solution was poured into iced water and was allowed to precipitate, whereby it was transformed into $\alpha$-type. The precipitate was washed with ammonium was and methanol, and was dried at 10° C. Then, the above refined $\alpha$-type metal-free phthalocyanine compound, together with attrition assistant and dispersant, was put into a sand mill and was kneaded at 100°±20° C. for 15–25 hours. Through this operation the compound was transformed into $\tau$-type in crystal form. After this transformation was confirmed, the compound was remove from the mill. Attrition assistant and dispersant were completely removed with water and methanol, and then the compound was dried. Thus, a $\tau$-type metal-free phthalocyanine in blue crystal was obtained. This phthalocyanine showed the X-ray diffraction spectrum given in FIG. 10.

Examples 1–11, Comparative Examples 1–3

On a photoconductive support formed of an aluminum foil laminated polyester film was laid an intermediate layer of 0.05 μm in thickness formed of a vinyl chloride-vinyl acetate-maleic anhydride copolymer "Eslec MF-10" (made by Sekisui Chemical Co., Ltd.). Then, a solution prepared by dissolving a carrier transporting material shown in FIG. 8 and a binder resin (polycarbonate: "Panlite L-1250") in 67 m of 1,2-dichloroethane was coated on said intermediate layer, a carrier transporting layer being thereby formed. Then, a dispersion liquid which was obtained by adding to 67 ml of 1,2-dichloroethane such carrier generating materials of 1 μm mean particle dia, carrier transporting materials, and binder resin as shown in FIG. 8 and allowing same to be dispersed for 12 hours was coated on the carrier transporting layer, then dried, whereby a carrier generating layer was formed. Thus, various electrophotographic photoreceptors was produced.

Each of the electrophotographic photoreceptors thus obtained was mounted in a static tester "EPA-8100" (made by Kawaguchi Denki Seisakusho, and the following tests were carried out. The photosensitive layer was electrified for 5 seconds by corona discharge from an electrification unit to which a voltage of +6 KV was applied, and was then allowed to stand for 5 seconds. Then, the surface was the photosensitive layer was illuminated with a light beam of 780 nm spectrally distributed by a spectroscope, in order to find out necessary amount of exposure for decaying the surface potential of the photosensitive layer to ½, that is, half-decaying exposure amount E1/2. Also, measurements were made of values for receptive potential $V_A$ during electrification by the corona discharge and residual potential $V_R$ after 10 lux. sec exposure.

A photosensitive layer corresponding to each of the photosensitive layers used in the examples was formed on an A drum, and same was mounted on a remodelled type of laser printer LP - 3010 (Konica Corporation) (with a semiconductor laser beam used). Image evaluation was carried out with this (in which CD denotes image density; R denotes resolution).

| | |
|---|---|
| ◎: | density satisfactorily high, resolving power very good. (CD ≧ 1.2, R ≧ 6.0) |
| ○: | density and resolving power, both good. (1.2 ≧ CD ≧ 0.7, 6.0 ≧ R ≧ 4.0) |
| X: | density low, resolving power not sufficient. In addition, fog and white or dark spots. |

CD measurements were made by "Sakura" densitometer (Model PDA - 65: Konica Corporation), and R measurements were made by "Sakura" densitometer (Model PDA - 5: Konica Corporation). For both CD and R, evaluation was made by measuring reflection density on the basis of white paper density=0.0.

More specifically for R evaluation, measurement was made in the following manner. A resolving power chart was measured by a microdensitometer of slit 500μ×20μ. Criterion for resolving power chart was: rating to be given on the basis of a resolving power chart with which the following equation has a response of more than 30%. Where image portion density of copy image is $D_{min}^{copy}$, non-image portion density thereof is $D_{min}^{copy}$, image portion density of original is $D_{max}^{orig}$, and non-image portion density thereof is $D_{min}^{orig}$, $$\frac{\dfrac{D_{max}^{copy} - D_{min}^{copy}}{D_{max}^{copy} + D_{min}^{copy}}}{\dfrac{D_{max}^{orig} - D_{min}^{orig}}{D_{max}^{orig} + D_{min}^{orig}}} \geqq 30\ (\%)$$

From the measurement results, it is apparent that the test samples of Examples 1~11 according to the present invention exhibited vary favorable electrophotographic characteristics as compared with comparative examples 1~3.

More particularly, use of the metal-free phthalocyanine of the invention as C G M, and addition of C T M to the carrier generating layer, have great effect on the performance characteristics and provide very remarkable advantages, such as increased charge potential, improved potential stability, and improved photosensitivity, thus making the photoreceptor highly suitable for use as a positive-charge type photoreceptor. Tests using semiconductor laser witnessed high density, high resolving power, and improved long-wave range sensitivity with the photoreceptor of the invention.

Examples 12~22, Comparative Example 4

Electrophotographic photoreceptors were prepared in same way as in Examples 1~11 and Comparative Example 3 respectively, except that the carrier generating materials used therein were changed to metal-free phthalocyanine compound B, and they were tested in same way as previously made. Results were obtained as shown in FIG. 9.

From the results, it is apparent that test samples of Examples 12~22 according to the invention all exhibited very satisfactory results, whereas the test sample of Comparative Example 4 in which no carrier transporting material was added were unsatisfactory in performance characteristics.

Examples I-1~I-11, Comparative Examples I-1~I-5

On a photoconductive support formed of an aluminum foil laminated polyester film was laid an intermediate layer of 0.05 μm in thickness formed of a vinyl chloride-vinyl acetate-maleic anhydride copolymer "Eslec MF-10" (made by Sekisui Echical Co., Ltd.). Then, a solution prepared by dissolving a carrier transporting material shown in FIG. 11 and a binder resin (polycarbonate: "Panlite L-1250") in 67 ml of 1,2-dichloroethane was coated on said intermediate layer, a carrier transporting layer being thereby formed. Then, a dispersion liquid which was obtained by adding to 67 ml of 1,2-dichloroethane such carrier generating materials of 1 μmean particle dia, carrier transporting materials, and binder resin as shown in FIGS. 12, 13 and allowing same to be dispersed for 12 hours was coated on the carrier transporting layer, then dried, whereby a carrier generating layer was formed. Thus, various electrophotographic photoreceptors was produced.

Each of the electrophotographic photoreceptors thus obtained was mounted in a static tester "EPA-8100" (made by Kawaguchi Denki Seisakusho), and the following tests were carrier out. The photosensitive layer was electrified for 5 seconds by corona discharge from an electrification unit to which a voltage of +6 KV was applied, and was then allowed to stand for 5 seconds. Then, the surface of the photosensitive layer was illuminated with a light beam of 780 nm spectrally distributed by a spectroscope, in order to find out necessary amount of exposure for decaying the surface potential of the photosensitive layer to ½, that is, half-decaying exposure amount E ½. Also, measurements were made of values for receptive potential $V_A$ during electrification by the corona discharge and residual potential $V_R$ after 10 lux. sec exposure.

A photosensitive layer corresponding to each of the photosensitive layers used in the examples was formed on an Al drum, and same was mounted on a remodelled type of laser printer LP-3010 (Konica Corporation) (with a semiconductor laser beam used). Image evaluation was carried out with this (in which CD denotes image density; R denotes resolution).

| | |
|---|---|
| ◎: | density satisfactorily high, resolving power very good. (CD ≧ 1.2, R ≧ 6.0) |
| ○: | density and resolving power, both good. (1.2 > CD ≧ 0.7, 6.0 ≧ R ≧ 4.0) |
| X: | density low, resolving power not sufficient. In addition, fog and white or dark spots. |

CD measurements were made by "Sakura" densitometer (Model PDA-65:Konica Corporation), and R measurements were made by "Sakura" densitometer (Model PDA-5: Konica Corporation). For both CD and R, evaluation was made by measuring reflection density on the basis of white paper density=0.0.

More specifically for R evaluation, measurement was made in the following manner. A resolving power chart was measured by a microdensitometer of slit 500μ×20μ. Criterion for resolving power chart was: rating to be given on the basis of a resolving power chart with which the following equation has a response of more than 30%. Where image portion density of copy image is $D_{max}^{copy}$, non-image portion density thereof is $D_{min}^{copy}$, image portion density of original is $D_{max}^{orig}$, and non-image portion density thereof is $D_{min}^{orig}$, $$\frac{\dfrac{D_{max}^{copy} - D_{min}^{copy}}{D_{max}^{copy} + D_{min}^{copy}}}{\dfrac{D_{max}^{orig} - D_{min}^{orig}}{D_{max}^{orig} + D_{min}^{orig}}} \geqq 30\ (\%)$$

From the measurement results, it is apparent that the test samples of Examples I-1~I-11 according to the present invention exhibited very favorable electrophotographic characteristics as compared with comparative examples I-1~I-5.

More particularly, use of the metal-free phthalocyanine of the invention as C G M, and addition of C T M to the carrier generating layer, have great effect on the performance characteristics and provide very remarkable advantages, such as increased charge potential, improved potential stability, and improved photosensitivity, thus making the photoreceptor highly suitable for use as a positive-charge type photoreceptor. Tests using semiconductor laser witnessed high density, high resolving power, and improved long-wave range sensitivity with the photoreceptor of the invention.

Examples I-12~I-22, Comparative Examples 1-6, 1-7

Electrophotographic photoreceptors were prepared in same way as in Examples I-1~I-11 and Comparative Examples I-1~I-3 respectively, except that the carrier generating materials used therein were changed to metal-free phthalocyanine compound B, and they were tested in same way as previously made. Results were obtained as shown in FIG. 12.

From the results, it is apparent that test samples of Examples I-12~I-22 according to the invention all exhibited very satisfactory results, whereas the test samples of Comparative Example I-7 in which no carrier transporting material was added were unsatisfactory in performance characteristics.

Examples I-23~I-34, Comparative Examples 1-8 I-11

On a photoconductive support formed of an aluminum foil laminated polyester film was laid an intermediate layer of 0.05 μm in thickness formed of a vinyl chloride vinyl acetate-maleic anhydride copolymer "Eslec MF-10" (made by Sekisui Chemical Co., Ltd.). Then, a solution prepared by dissolving each of such carrier generating materials and each of such carrier transporting materials as shown in FIG. 13, each of mean particle diameter 1 μm. and a binder resin (polycarbonate: "Panlite L - 1250") in 67 ml of 1,2-dichloroethane was coated on said intermediate layer, with drying followed, a photosensitive layer being thereby formed. In this way various electrophotographic photoreceptors were produced.

With these electrophotographic photoreceptors, tests were made in same way as earlier described, and results as shown in FIG. 13 were obtained.

From the results, it can be seen that in the case of such single layer photoreceptors, those of Examples I-23~I-34 according to the invention in which metal-free phthalocyanine compound A and a styryl compound were added exhibited satisfactory performance, whereas those of Comparative Examples I-9 in which no carrier transporting material was added to the photosensitive layer, and those of Comparative Examples in which no styryl compound was used, had no satisfactory characteristics. It can be also seen from Comparative Examples I-10 and I-10 that where materials other than those of the present invention were used, the results would be unsatisfactory.

Examples I-35 I-46, Comparative Examples I-12, I-13

Electrophotographic photoreceptors were produced in same as in Examples I-23~I-34, Comparative Examples I-8, I-9, except that the carrier generating materials used therein were changed to metal-free phthalocyaninee compound B. Tests were made in same way as already described, and results shown in FIG. 14 were obtained.

From the results, it can be seen that test samples of Examples I-35~I-46 all showed good results, whereas those of Comparative Example 14 in which no carrier transporting material was added to the photosensitive layer and Comparative Example I-12 in which no styryl compound was used had no satisfactory performance characteristics.

Examples I-47~I-57, Comparative Examples I-14~I-17

The styryl compound used in Examples I-1~I-11 was changed to aforementioned another amine derivative. CTM in Comparative Example I-17 was changed to the one shown in FIG. 15. With these exceptions, electrophotographic photoreceptors were produced in same manner as above described. Tests were carried out in same way as above. Results shown in FIG. 15 were obtained.

From the results, it can be seen that test samples of Examples I-47~I-57 all showed good results, whereas those of Comparative Example I-15 in which no carrier transporting material was added to the carrier generating layer, Comparative Example I-14 in which no styryl compound was used, and Comparative Examples I-16, I-17 in which materials other than those of the invention were used, had no satisfactory performance characteristics.

Examples I-58~I-68, Comparative Examples I-18, I-19

Electrophotographic photoreceptors were produced in same as in Examples I-47~I-57, Comparative Examples I-14, I-15, except that the carrier generating materials used therein were changed to metal-free phthalocyanine compound B. Tests were made in same way as already described, and results shown in FIG. 16 were obtained.

From the results, it can be seen that test samples of Examples I-58~I-68 all showed good results, whereas those of Comparative Example I-19 in which no carrier transporting material was added to the carrier generating layer and Comparative Example I-18 in which no amine derivativee was used had no satisfactory performance characteristics.

Examples I-69~I-80, Comparative Examples I-20, I-21

The styryl compound used in Examples I-23~I-34 was changed to aforementioned another amine derivative. CTM in Comparative Example I-14 was changed to the one shown in FIG. 17. With these exceptions, electrophotographic photoreceptors were produced in same manner as above described. Tests were carried out in same way as above. Results shown in FIG. 17 were obtained.

From the results, it can be seen that test samples of Examples I-69~I-80 all showed good results, whereas those of Comparative Example I-20, I-21 in which materials other than those of the invention were used had no sufficient performance characteristics.

Examples I-81~I-92

Electrophotographic photoreceptors were produced in same as in Examples I-69~I-80 except that the carrier generating material used therein was changed to metal-free phthalocyanine compound B, and tests were carried out in same way as above described. Results as shown in FIG. 18 were obtained.

From the results, it can be seen that test samples of Examples I-81~I-92 all showed good results Examples II-1~II-11, Comparative Examples II-1~II-5

On a photoconductive support formed on an aluminum foil laminated polyester film was laid an intermediate layer of 0.05 μm in thickness formed of a vinyl chloride-vinyl acetate-maleic anhydride copolymer "Eslec MF-10" (made by Sekisui Chemical Co., Ltd.). Then, a solution prepared by dissolving a carrier transporting material shown in FIG. 19 and a binder resin (polycarbonate: "Panlite L-1250") in 67 ml of 1,2-dichloroethane was coated on said intermediate layer, a carrier transporting layer being thereby formed. Then, a dispersion liquid which was obtained by adding to 67 m~ of 1,2-dichloroethane such carrier generating materials of 1 μm mean particle dia, carrier transporting materials, and binder resin as shown in FIGS. 20, 21 and allowing same to be dispersed for 12 hours was coated on the carrier transporting layer, then dried, whereby a carrier generating layer was formed. Thus, various electrophotographic photoreceptors was produced.

From the measurement results, it is apparent that the test samples of Examples II-1~II-11 according to the present invention exhibited very favorable electrophotographic characteristics as compared with Comparative Examples II-1~II-5. More particularly, use of the metal-free phthalocyanine of the invention as C G M, and addition of carbazole derivative as C T M to the carrier generating layer, have great effect on the performance characteristics and provide very remarkable advantages, such as increased charge potential, improved potential stability, and improved photosensitivity, thus making the photoreceptor highly suitable for use as a positive-charge type photoreceptor. Tests using semiconductor laser witnessed high density, high resolving power, and improved long-wave range sensitivity with the photoreceptor of the invention.

Examples II-12~II-22, Comparative Examples II-6, II-7

Electrophotographic photoreceptors were produced in same as in Examples II-1~II-11, Comparative Examples II-1~II-3, except that the carrier generating materials used therein were changed to metal-free phthalocyanine compound B. Tests were made in same way as already described, and results shown in FIG. 20 were obtained.

From the results, it can be seen that test samples of Examples II-12~II-22 all showed good results, whereas those of Comparative Examples II-17 in which no carrier transporting material was added to the carrier generating layer and Comparative Example II-6 in which no carbazole derivative was used had no satisfactory performance characteristics.

Examples II-23~II-34, Comparative Examples II-8, II-9

On a photoconductive support formed on an aluminum foil laminated polyester film was laid an intermediate layer of 0.05 μm in thickness formed of a vinyl chloride-vinyl acetate-maleic anhydride copolymer "Eslec MF-10" (made by Sekisui Chemical Co., Ltd.). Then, a solution prepared by dissolving each of such carrier generating materials and each of such carrier transporting materials as shown in FIG. 21, each of mean particle diameter 1 μm, and a binder resin (polycarbonate: "Panlite L-1250") in 67 ml of 1,2-dichloroethane was coated on said intermediate layer, with drying followed, a photosensitive layer being thereby formed. In this way various electrophotographic photoreceptors was produced.

With these electrophotographic photoreceptors, tests were made in same way as earlier described, and results as shown in FIG. 21 were obtained.

From the results, it can be seen that in the case of such single layer photoreceptors, those of Examples II-23~II-34 according to the invention in which metal-free phthalocyanine compound A and a carbazole derivative were added exhibited satisfactory performance, whereas those of Comparative Examples II-9 in which no carrier transporting material was added to the photosensitive layer, and those of Comparative Examples II-10, II-11 in which no carbazole derivative was used, had no satisfactory characteristics. It can be also seen from Comparative Examples II-10 and II-11 that where materials other than those of the present invention were used as CGM, the results would be unsatisfactory.

Examples II-35~II-46, Comparative Examples II-12, II-13

Electrophotographic photoreceptors were produced in same as in Examples II-23~II-34, Comparative Examples II-8, II-9, except that the carrier generating materials used therein were changed to metal-free phthalocyanine compound B. Tests were made in same way as already described, and results shown in FIG. 22 were obtained.

From the results, it can be seen that test samples of Examples II-35~II-46 all showed good results, whereas those of Comparative Example II-13 in which no carrier transporting material was added to the photosensitive layer and Comparative Examples II-12 in which no carbazole derivative was used had no satisfactory performance characteristics.

Examples III-1~III-9, Comparative Examples III-1, III-2

On a photoconductive support formed on an aluminum foil laminated polyester film was laid an intermediate layer of 0.05 μm in thickness formed of a vinyl chloride-vinyl acetate-maleic anhydride copolymer "Eslec MF-10" (made by Sekisui Chemical Co., Ltd.). Then, a solution prepared by dissolving a carrier transporting material shown in FIG. 10 and a binder resin (polycarbonate: "Panlite L-1250") in 67 ml of 1,2-dichloroethane was coated on said intermediate layer, a carrier transporting layer being thereby formed. Then, a dispersion liquid which was obtained by adding to 67 ml of 1,2-dichloroethane such carrier generating materials of 1 μm mean particle dia, carrier transporting materials, and binder resin as shown in FIGS. 23 and allowing same to be dispersed for 12 hours was coated on the carrier transporting layer, then dried, whereby a carrier generating layer was formed. Thus, various electrophotographic photoreceptors was produced.

From the measurement results, it is apparent that the test samples of Examples III-1~III-9 according to the present invention exhibited very favorable electrophotographic characteristics as compared with Comparative Examples III-1, III-2.

More particularly, use of the metal-free phthalocyaninee of the invention as C G M, and addition of hydrazone compound [III] as C T M to the carrier generating layer, have great effect on the performance characteristics and provide very remarkable advantages, such as increased charge potential, improved potential stability, and improved photosensitivity, thus making the photoreceptor highly suitable for use as a positive-charge type photoreceptor. Tests using semiconductor laser witnessed high density, high resolving power, and improved long-wave range sensitivity with the photoreceptor of the invention.

Examples III-10~III-12

Electrophotographic photoreceptors were produced in same way as in Examples III-1~III-9 except that the carrier generating material used therein was changed to metal-free phthalocyanine compound B. Tests were carried out in same manner as earlier described. Results as shown in FIG. 24 were obtained.

From the results, the test samples of Examples III-10~III-12 all had good performance characteristics.

Examples III-13~III-18, Comparative Examples III-3~III-4

On a photoconductive support formed of an aluminum foil laminated polyester film was laid an intermediate layer of 0.05 μm in thickness formed of a vinyl chloride-vinyl acetate-maleic anhydride copolymer "Eslec MF-10" (made by Sekisui Chemical Co., Ltd.).

Then, a solution prepared by dispersing a carrier generating material, a carrier transporting material, and a binder resin, polycarbonate (polycarbonate: "Panlite L-1250") in 67 ml, all of mean particle diameter 1 μm, to 67 ml of 1,2-dichloroethane and dispersing the mixture in a ball mill for 12 hours was coated on said intermediate layer, then the coat was dried, a photosensitive layer being thereby formed. Thus, photoreceptors were prepared.

With these photoreceptors were tested in same manner as already described. Results as shown in FIG. 25 were obtained.

From the results, it can be seen that in the case of such single layer photoreceptors, those of Examples III-13~III-18 according to the invention showed satisfactory results, whereas those of Comparative Examples II-9 in which no carrier transporting material was added to the photosensitive layer, and those of Comparative Examples III-3, III-4 in which no metal-free phthalocyanine compound was used had no satisfactory performed characteristics.

Examples III-19, III-20

Electrophotographic photoreceptors were produced in same way as in Examples III-13~III-18 except that the carrier generating material used therein was changed to metal-free phthalocyanine compound B, and tests were carried out in same as above described. Results as shown in FIG. 26 were obtained.

From the results, it can be seen that test samples of Examples III-19, III-20 all showed satisfactory results.

Examples III-21~III-29, Comparative Examples III-5~III-6

Electrophotographic photoreceptors were produced in same way as in Examples III-1~III-9 except that the hydrozone compound [III] used therein was changed to hydrazone compound [III'] shown in FIG. 27, and tests were carried out in same way as above described. Results as shown in FIG. 27 were obtained.

From the results, it can be seen that test samples of Examples III-21~III-29 all showed satisfactory results, whereas those of Comparative Examples III-5, III-6 in which materials other than those of the invention were used did not show any satisfactory characteristics.

Examples III-30~III-32

Electrophotographic photoreceptors were produced in same way as in Examples III-21~III-29 except that the carrier generating material used therein was changed to metal-free phthalocyanine compound B, and tests were carried out in same way as above described. Results as shown in FIG. 28 were obtained.

From the results, it can be seen that test samples of Examples III-30~III-32 all showed satisfactory results.

Examples III-33~III-38, Comparative Examples III-7~III-8

Electrophotographic photoreceptors were produced in same way as in Examples III-13~III-18 except that hydrazone compound [III] used there was changed to hydrazone compound [III'], and tests were carried out in same manner as above described. Results as shown in FIG. 29 were obtained.

From the results, it can be seen that test samples of Examples III-33~III-38 all showed satisfactory results, whereas those of Comparative Examples III-7, III-8 in which no metal-free phthalocyanine compound A was used did not show any satisfactory characteristics.

Examples III-39~III-40

Electrophotographic photoreceptors were produced in same way as in Examples III-33~III-38 except that the carrier generating material used therein was changed to metal-free phthalocyanine compound B, and tests were carried out in same way as above described.

From the results, it can understood that test samples of Examples III-39, III-40 all showed good results.

BRIEF DESCRIPTION OF THE DRAWINGS

FIGS. 1 to 30 are illustrative of the present invention.

FIGS. 1 and 3 are spectral views showing X-ray diffraction spectral patterns of two examples of metal-free phthalocyanines;

FIGS. 2 and 4 are spectral views showing near-infrared spectral patterns of two examples of metal-free phthalocyanines;

FIG. 5 is a near-infrared spectral view of a metal-free phthalocyanine;

FIGS. 6 and 7 are partial sectional views of separated layer type photoreceptors;

FIGS. 8, 9, 11, 12, 13, 14, 15, 16, 17, 18, 19, 20, 21, 22, 23, 24, 25, 26, 27, 28, 29, and 30 are views showing changes in characteristics of various electrophotographic receptors according to their compositions for purposes of comparison; and FIG. 10 is a spectral view showing X-ray diffraction spectral pattern of a conventional $\tau$-type metal-free phthalocyanine.

In the drawings,

Figure 1:
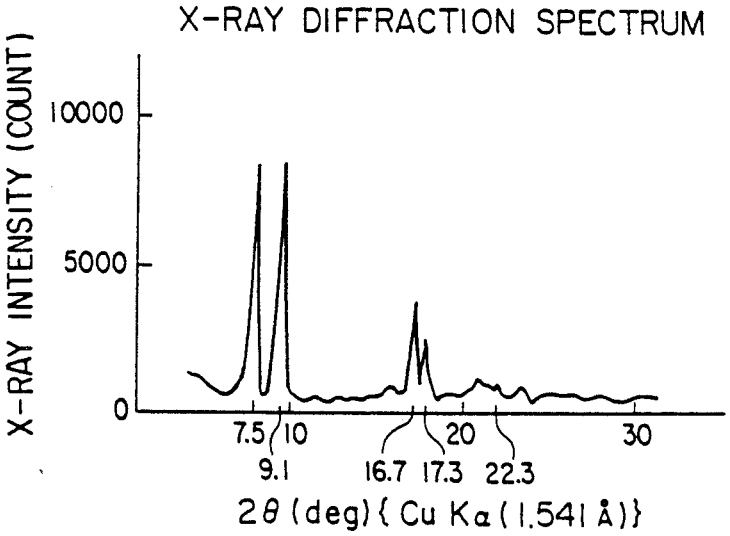
Figure 3:
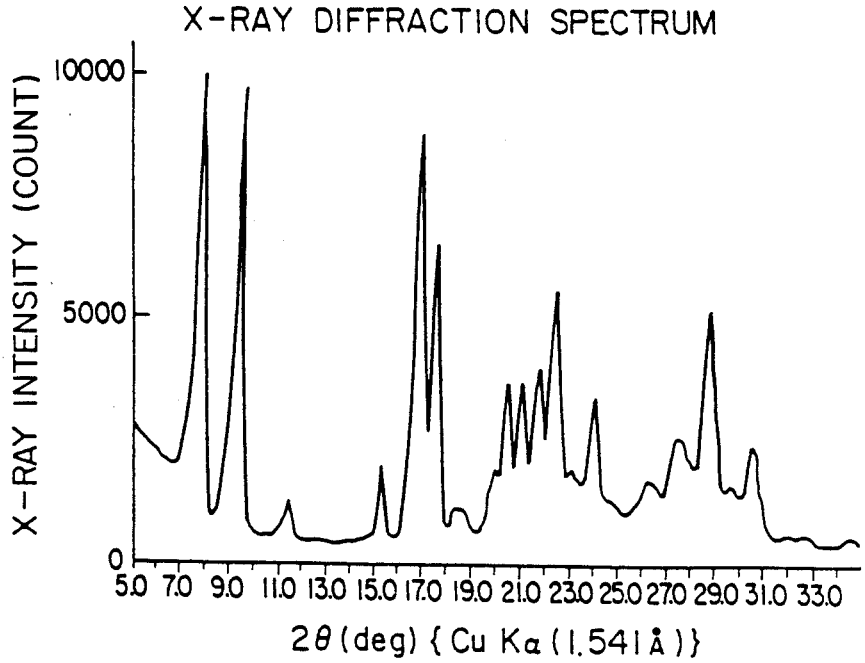
Figure 2:
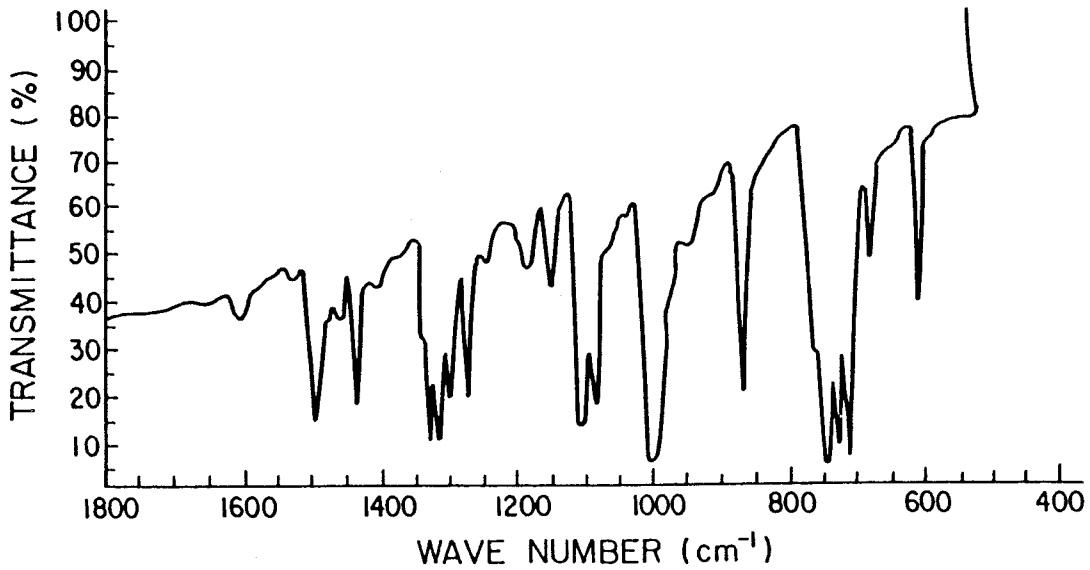
Figure 4:
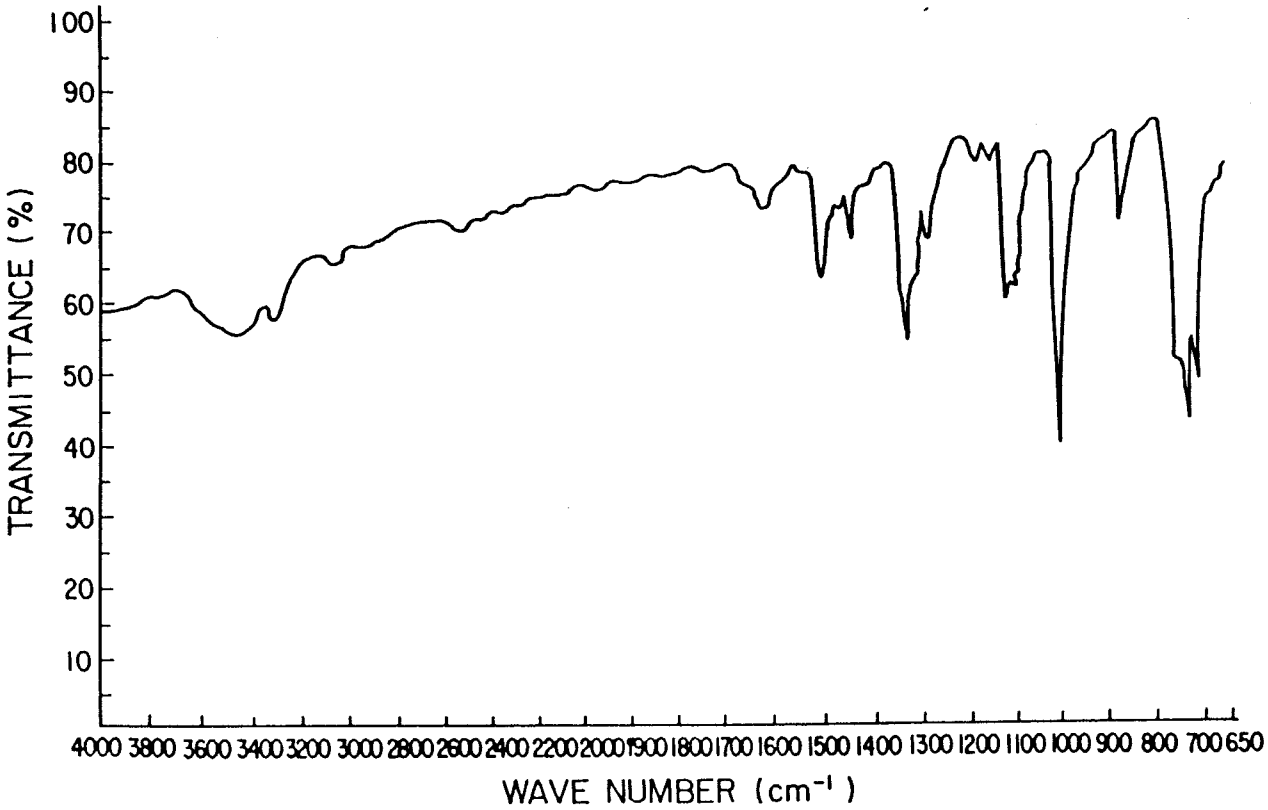
Figure 5:
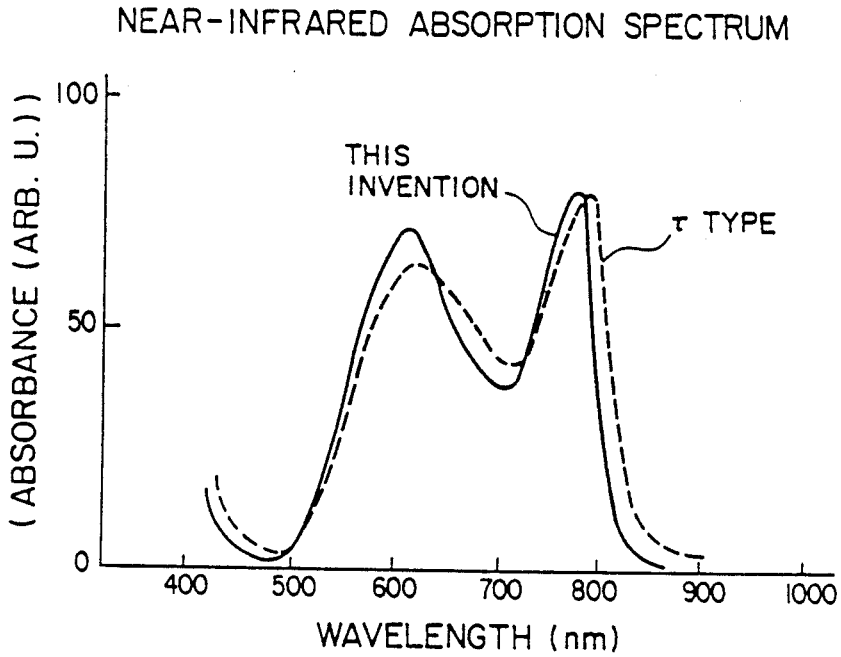
Figure 6:
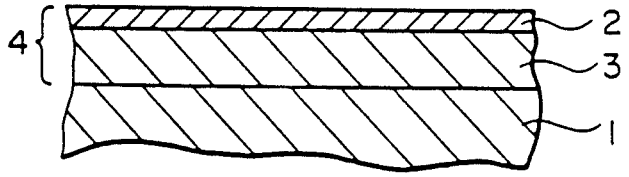
Figure 7:
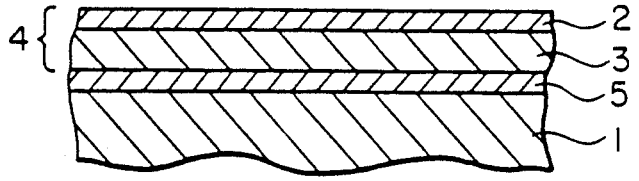
Figure 10:
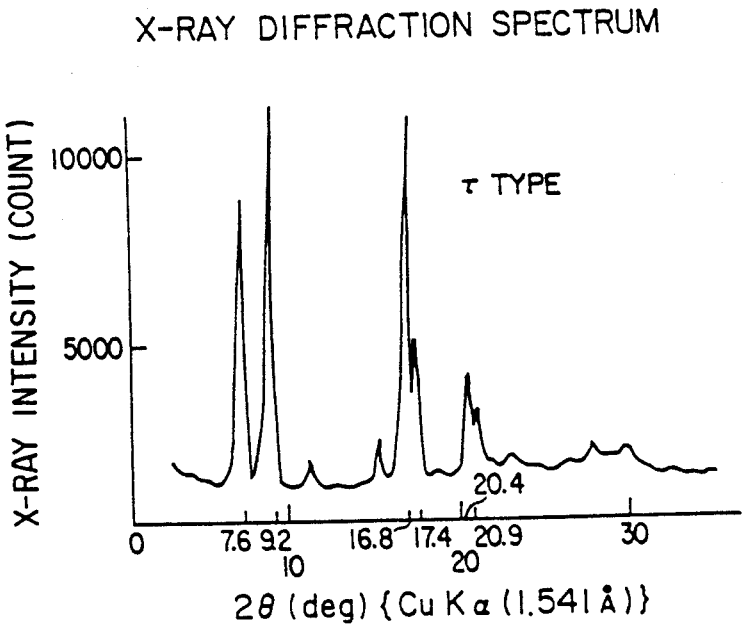

1 . . . photoconductive support;
2 . . . carrier generating layer;
3 . . . carrier transporting layer;
4 . . . photosensitive layer;
5 . . . intermediate layer; and
6 . . . layer

What is claimed is:

1. In a photoreceptor including a carrier transporting layer containing a carrier transporting material and a binder material, and a carrier generating layer containing a carrier generating material and a binder material, the layers being provided in this order, characterized in that said carrier generating layer has a thickness of 1 to 10 $\mu$m and contains a metal-free phthalocyanine having main peaks of Bragg angles $2\theta$ at least at 7.5 degrees$\pm$0.2 degrees, 9.1 degrees$\pm$0.2 degrees, 16.7 degrees$\pm$0.2 degrees, 17.3 degrees$\pm$0.2 degrees, and 22.3 degrees$\pm$0.2 degrees in relation to Cuk$\alpha$ characteristic X rays (wavelength 1541 Å), and in that said carrier generating layer also contains a carrier transporting material.

2. In a photoreceptor as set forth in claim 1 wherein said carrier transporting material is at least either a compound expressed by the following general formula [I] or a compound expressed by the following general formula [I']:

General formula [I]:

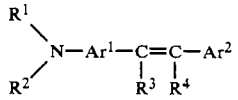

(in which $R^1$ and $R^2$: represent a substituted or unsubstituted alkyl or aryl group; for a substituent group, an alkyl, an alkoxy, a substituted amino, or a hydroxyl group, a halogen atom, or an aryl group is used.

$Ar^1$ and $Ar^2$: represent a substituted or unsubstituted aryl group; for a substituent group, a halogen atom, a hydroxy, an alkyl, an alkoxy, a substituted amino, or an aryl group is used.

$R^3$ and $R^4$: represent a substituted or unsubstituted aryl group or hydrogen atom; for a substituent group, a halogen atom, a hydroxy, an alkyl, an alkoxy, a substituted amino, or an aryl group is used.)

General formula [I']

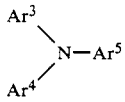

(in which $Ar^3$ and $Ar^4$: represent a substituted or unsubstituted phenyl group; for a substituent group, a halogen atom, an alkyl, a nitro, or an alkoxy group is used.

$Ar^5$: represents a substituted or unsubstituted phenyl, naphthyl, anthryl, fluorenyl, or heterocyclic group; for a substituent group, an alkyl, an alkoxy group, a halogen atom, a hydroxyl, an aryloxy, an aryl, an amino, a nitro, a piperidino, a morpholino, a naphthyl, an anthryl, or a substituted amino group is used. Provided, however, that an acryl, an alkyl, an aryl, or an aralkyl group is used as a substituent group for a substituted amino group.)

3. The photoreceptor as set forth in claim 1 wherein said carrier transporting material is a compound expressed by the following general formula [II]:

General formula [II]:

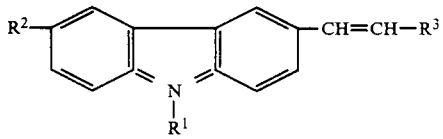

(in which $R^1$: represents a substituted or unsubstituted aryl group, $R^2$: represents a hydrogen or halogen atom, or a substituted or unsubstituted alkyl, alkoxy, amino, substituted amino, or hydroxyl group, and $R^3$: represents a substituted or unsubstituted aryl group, or a substituted or unsubstituted heterocyclic group.)

4. The photoreceptor as set forth in claim 1 wherein said carrier transporting material is at least either a compound expressed by the following general formula [III] or a compound expressed by the following general formula [III']:

General formula [III]:

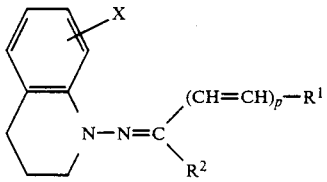

(in which $R^1$: represents a substituted or unsubstituted aryl group, or a substituted or unsubstituted heterocyclic group, $R^2$: represents a hydrogen atom, a substituted or unsubstituted alkyl group, or a substituted or unsubstituted aryl group, X: represents a hydrogen or halogen atom, an alkyl group, a substituted amino group, an alkoxy group, or a cyano group, and p: represents an integer of 0 or 1.)

General formula [III']:

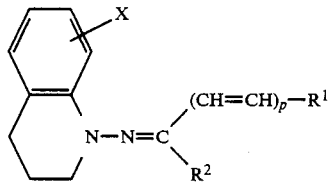

(in which $R^1$, $R^2$, X, and p respectively have the same meanings as those given in [III] above.)

5. The photoreceptor as set forth in claim 1 wherein said carrier transporting material is a compound expressed by the following general formula [IV]:

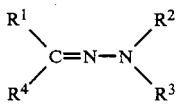

(in which $R^1$: represents a substituted or unsubstituted aryl group, a substituted or unsubstituted carbazolyl group, or a substituted or unsubstituted heterocyclic group, $R^2$, $R^3$, and $R^4$: represent a hydrogen atom, an alkyl group, a substituted or unsubstituted aryl group, or a substituted or unsubstituted aralkyl group.)

6. The photoreceptor as set forth in claim 1 wherein said carrier transporting material is a compound expressed by the following general formula [V]:

General formula [V]:

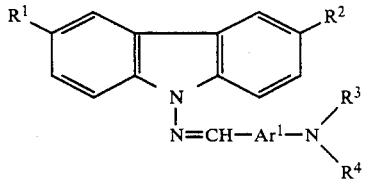

(in which $R^1$ and $R^2$: represent a hydrogen atom or a halogen atom;

$R^3$ and $R^4$: represent a substituted or unsubstituted aryl group;

$Ar^1$: represents a substituted or unsubstituted arylene group.)

7. The photoreceptor as set forth in claim 1 wherein said carrier transporting material is a compound expressed by the following general formula [VI]:

General formula [VI]:

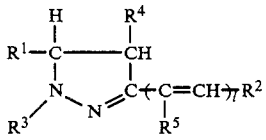

(in which l: represents 0 or 1;

$R_1$ and $R^2$: represent a substituted or unsubstituted aryl group;

$R^3$: represent a substituted or unsubstituted aryl group or a heterocyclic group;

$R^4$ and $R^5$: represent a hydrogen atom, an alkyl group having 1–4 carbon atoms, or a substituted or unsubstituted aryl or aralkyl group (provided that $R^4$ and $R^5$ are in no case hydrogen atoms at the same time and that where said l is 0, $R^4$ is not a hydrogen atom.)]

* * * * *